US007914959B2

(12) United States Patent
Inaba et al.

(10) Patent No.: US 7,914,959 B2
(45) Date of Patent: Mar. 29, 2011

(54) IMAGE BEARING MEMBER, IMAGE FORMING METHOD, AND IMAGE FORMING APPARATUS

(75) Inventors: Yoshinori Inaba, Numazu (JP); Tetsuro Suzuki, Fuji (JP); Hiroshi Tamura, Susono (JP); Hidetoshi Kami, Numazu (JP); Tetsuya Toshine, Numazu (JP); Yukio Fujiwara, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 762 days.

(21) Appl. No.: 11/563,710

(22) Filed: Nov. 28, 2006

(65) Prior Publication Data

US 2007/0196749 A1 Aug. 23, 2007

(30) Foreign Application Priority Data

Nov. 28, 2005 (JP) ..... 2005-342062

(51) Int. Cl.
*G03G 5/043* (2006.01)

(52) U.S. Cl. ..... 430/58.2; 430/66

(58) Field of Classification Search ..... 430/58.2, 430/66

See application file for complete search history.

(56) References Cited

U.S. PATENT DOCUMENTS

| | | | |
|---|---|---|---|
| 4,801,517 A | 1/1989 | Frechet et al. | |
| 4,806,443 A | 2/1989 | Yanus et al. | |
| 4,935,487 A | 6/1990 | Yanus et al. | |
| 4,956,440 A | 9/1990 | Limburg et al. | |
| 5,030,532 A | 7/1991 | Limburg et al. | |
| 5,155,200 A | 10/1992 | Limburg et al. | |
| 5,322,753 A | 6/1994 | Tamura et al. | |
| 5,356,743 A | 10/1994 | Yanus et al. | |
| 5,488,137 A | 1/1996 | Tamura et al. | |
| 5,492,784 A | 2/1996 | Yoshikawa et al. | |
| 5,608,010 A | 3/1997 | Tamura et al. | |
| 5,871,876 A | 2/1999 | Ikuno et al. | |
| 6,030,733 A | 2/2000 | Kami et al. | |
| 6,066,428 A | 5/2000 | Katayama et al. | |
| 6,151,468 A | 11/2000 | Kami et al. | |
| 6,194,535 B1 | 2/2001 | Katayama et al. | |
| 6,210,848 B1 | 4/2001 | Nagai et al. | |
| 6,861,188 B2 | 3/2005 | Ikegami et al. | |
| 6,936,388 B2 | 8/2005 | Suzuki et al. | |
| 7,018,755 B2 | 3/2006 | Ikegami et al. | |
| 7,371,490 B2 * | 5/2008 | Tamoto et al. | 430/58.7 |
| 7,381,511 B2 * | 6/2008 | Ikegami et al. | 430/58.85 |
| 7,556,903 B2 * | 7/2009 | Yanagawa et al. | 430/66 |
| 2004/0053152 A1 | 3/2004 | Nagai et al. | |

(Continued)

FOREIGN PATENT DOCUMENTS

| | | |
|---|---|---|
| JP | 52-036016 | 3/1977 |

(Continued)

OTHER PUBLICATIONS

U.S. Appl. No. 12/000,239, filed Dec. 11, 2007, Fujiwara, et al.

(Continued)

*Primary Examiner* — Hoa V Le

(74) *Attorney, Agent, or Firm* — Oblon, Spivak, McClelland, Maier & Neustadt, L.L.P.

(57) ABSTRACT

An image bearing member including a substrate, a photosensitive layer, provided overlying the substrate and a cross linking charge transport layer provided overlying the photosensitive layer, wherein the area of the photosensitive layer which is most distant from the substrate contains a charge transport material, a binder resin and a filler.

17 Claims, 3 Drawing Sheets

U.S. PATENT DOCUMENTS

| | | | | |
|---|---|---|---|---|
| 2004/0248024 | A1 | 12/2004 | Suzuki et al. | |
| 2004/0253527 | A1 | 12/2004 | Suzuki et al. | |
| 2005/0008957 | A1* | 1/2005 | Ikegami et al. | 430/56 |
| 2005/0053853 | A1 | 3/2005 | Sugino et al. | |
| 2005/0106483 | A1 | 5/2005 | Shoshi et al. | |
| 2005/0118518 | A1 | 6/2005 | Ikegami et al. | |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0170272 | A1 | 8/2005 | Suzuki et al. | |
| 2005/0175911 | A1 | 8/2005 | Tamoto et al. | |
| 2005/0181291 | A1 | 8/2005 | Kami et al. | |
| 2005/0196193 | A1 | 9/2005 | Tamoto et al. | |
| 2005/0221210 | A1 | 10/2005 | Suzuki et al. | |
| 2005/0238987 | A1 | 10/2005 | Ohshima et al. | |
| 2005/0266325 | A1 | 12/2005 | Yanagawa et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2005/0287465 | A1 | 12/2005 | Ohshima et al. | |
| 2006/0014093 | A1 | 1/2006 | Li et al. | |
| 2006/0014096 | A1 | 1/2006 | Ohshima et al. | |
| 2006/0051689 | A1 | 3/2006 | Suzuki et al. | |
| 2006/0068308 | A1 | 3/2006 | Ohshima et al. | |
| 2006/0093955 | A1 | 5/2006 | Ohshima et al. | |
| 2006/0110668 | A1 | 5/2006 | Kawasaki et al. | |
| 2006/0160003 | A1 | 7/2006 | Nagai et al. | |
| 2006/0177749 | A1 | 8/2006 | Tamoto et al. | |

FOREIGN PATENT DOCUMENTS

| | | | | |
|---|---|---|---|---|
| JP | 56-048637 | | 5/1981 | |
| JP | 01-241559 | | 9/1989 | |
| JP | 02-005069 | | 1/1990 | |
| JP | 04-011627 | | 1/1992 | |
| JP | 04-175337 | | 6/1992 | |
| JP | 04-175760 | | 6/1992 | |
| JP | 04-176767 | | 6/1992 | |
| JP | 04-183719 | | 6/1992 | |
| JP | 04-281461 | | 10/1992 | |
| JP | 04-320420 | | 11/1992 | |
| JP | 05-019497 | | 1/1993 | |
| JP | 05-060503 | | 3/1993 | |
| JP | 05-070595 | | 3/1993 | |
| JP | 05-094049 | | 4/1993 | |
| JP | 05-113688 | | 5/1993 | |
| JP | 05-216249 | | 8/1993 | |
| JP | 05-310904 | | 11/1993 | |
| JP | 06-045770 | | 2/1994 | |
| JP | 06-234836 | | 8/1994 | |
| JP | 06-234837 | | 8/1994 | |
| JP | 06-234838 | | 8/1994 | |
| JP | 06-234839 | | 8/1994 | |
| JP | 06-234840 | | 8/1994 | |
| JP | 06-234841 | | 8/1994 | |
| JP | 06-236050 | | 8/1994 | |
| JP | 06-236051 | | 8/1994 | |
| JP | 06-239049 | | 8/1994 | |
| JP | 06-295077 | | 10/1994 | |
| JP | 07-101912 | | 1/1995 | |
| JP | 7-10912 | | 2/1995 | |
| JP | 07-056274 | | 3/1995 | |
| JP | 2509292 | | 4/1996 | |
| JP | 08-176293 | | 7/1996 | |
| JP | 08-208820 | | 8/1996 | |
| JP | 08-211640 | | 8/1996 | |
| JP | 08-253568 | | 10/1996 | |
| JP | 08-262779 | | 10/1996 | |
| JP | 08-269183 | | 10/1996 | |
| JP | 2591793 | | 12/1996 | |
| JP | 2596588 | | 1/1997 | |
| JP | 2596589 | | 1/1997 | |
| JP | 09-062019 | | 3/1997 | |
| JP | 09-071642 | | 3/1997 | |
| JP | 09-087376 | | 3/1997 | |
| JP | 09-104746 | | 4/1997 | |
| JP | 09-110974 | | 4/1997 | |
| JP | 09-110976 | | 4/1997 | |
| JP | 09-157378 | | 6/1997 | |
| JP | 09-221544 | | 8/1997 | |
| JP | 09-227669 | | 9/1997 | |
| JP | 09-235367 | | 9/1997 | |
| JP | 09-241369 | | 9/1997 | |
| JP | 09-268226 | | 10/1997 | |
| JP | 09-272735 | | 10/1997 | |
| JP | 09-302084 | | 11/1997 | |
| JP | 09-302085 | | 11/1997 | |
| JP | 09-328539 | | 12/1997 | |
| JP | 10-073944 | | 3/1998 | |
| JP | 2000-066425 | | 3/2000 | |
| JP | 3183353 | | 4/2001 | |
| JP | 3189914 | | 5/2001 | |
| JP | 3224031 | | 8/2001 | |
| JP | 2004-302450 | | 10/2004 | |
| JP | 2004-302451 | | 10/2004 | |
| JP | 2004-302452 | | 10/2004 | |
| JP | 2005115353 | * | 4/2005 | 5/7 |

OTHER PUBLICATIONS

U.S. Appl. No. 11/616,523, filed Dec. 27, 2006, Fujiwara, et al.
U.S. Appl. No. 12/035,016, filed Feb. 21, 2008, Iwamoto, et al.
U.S. Appl. No. 12/047,011, filed Mar. 12, 2008, Kami, et al.
U.S. Appl. No. 11/855,510, filed Sep. 14, 2007, Kami, et al.
U.S. Appl. No. 11/855,553, filed Sep. 11, 2007, Inaba, et al.

* cited by examiner

IMAGE BEARING MEMBER, IMAGE FORMING METHOD, AND IMAGE FORMING APPARATUS

BACKGROUND OF THE INVENTION

1. Field of the Invention

The present invention relates to an image bearing member, an image forming method and an image forming apparatus.

2. Discussion of the Background

Recently, organic image bearing members (organic photoconductor (OPC)) have been superseding inorganic image bearing members in the application to photocopiers, facsimile machines, laser printers and their multi-functional machines according to their good performance and various kinds of merits. Specific reasons are, for example, optical characteristics, for example, the width of the optical absorption wavelength range and the amount of optical absorption, electric characteristics, for example, the high sensitivity and the stable charging characteristics, the wide range of selection for materials, easy manufacturing, low cost, and non-toxicity.

On the other hand, the diameter of an image bearing member has been recently reduced according as the size of an image forming apparatus is reduced. On top of that, high-speed performance and maintenance-free have been required. Therefore, an image bearing member having a high durability is demanded. An organic image bearing member includes a photosensitive layer mainly formed of a low molecular weight charge transport material and an inactive polymer. Such an image bearing member is soft in general. This leads to a problem that, while an organic image bearing member is repeatedly used in the electrophotographic process, abrasion thereof tends to occur due to the mechanical burden on the organic image bearing member received from a developing system and a cleaning system. In addition, toner particles have been reduced to obtain quality images, which requires improvement on the cleaning property and leads to increase in the hardness of the rubber for use in a cleaning blade and the contact pressure thereof to an image bearing member. This is one of the causes which accelerate the abrasion of an image bearing member. Such abrasion of an image bearing member degrades electric characteristics thereof, for example, sensitivity and chargeability. Thereby, image density deteriorates and the background fouling occurs, resulting in abnormal images. In addition, scars locally made on an image bearing member due to the abrasion invite poor cleaning performance, which leads to fouling in a streak manner on an image. In the current status, abrasion and scars on an image bearing member determines the timing of exchange thereof.

Therefore, it is inevitable to decrease the amount of the abrasion to improve the durability of an organic image bearing member. Furthermore, to impart an excellent cleaning property and transferability, an organic image bearing member having a good surface property is desired. This is an imminent issue to be solved in this area.

As a method of improving an anti-abrasion property of a photosensitive layer, published unexamined Japanese patent application No. (hereinafter referred to as JOP) S56-48637 describes a surface layer containing a curing binder. JOP S64-1728 describes a surface layer in which a polymer type charge transport material is used. JOP H04-281461 describes a surface layer in which an inorganic filler is dispersed.

In the method described in JOP S56-48637, due to an insufficient compatibility with the charge transport material and the presence of impurities, for example, polymerization initiator and unreacted remaining groups, the remaining voltage tends to rise and the image density tends to deteriorate.

In addition, the methods described in JOPs S64-1728 and H04-281461 possibly improve the anti-abrasion property of an organic image bearing member but do not improve the anti-abrasion property to a level desired therefor.

Furthermore, in the method described in JOP H04-281461, the remaining voltage easily rises due to the trapped charge present on the surface of an inorganic filler, which leads to the tendency of the deterioration of the image density.

These methods do not sufficiently provide an organic image bearing member with the total durability desired therefor including electric durability and mechanical durability.

Furthermore, Japanese patent No. (hereinafter referred to as JP) 3262488 describes an image bearing member containing a polyfunctional curing type acrylate monomer to improve the anti-abrasion property and anti-damage property described in JOP S56-48637. In this image bearing member, the protective layer, which is provided on the photosensitive layer, contains a polyfunctional curing type acrylate monomer. However, only there is a description that the protective layer can contain a charge transport material. Furthermore, when a surface layer simply contains a charge transport material having a low molecular weight, a problem of the compatibility with the cured material arises, which causes problems such that the charge transport material having a low molecular weight precipitates, cracking occurs and the mechanical strength deteriorates. In addition, to improve the compatibility, it is also described that a polycarbonate resin is added to the surface layer but as a result, the content of the cured material decreases and a sufficient anti-abrasion property is not obtained. Furthermore, with regard to the image bearing member in which the surface layer does not contain a charge transport material, there is a description that the surface layer is made to be thin to address the decrease in the voltage on the irradiated portion. However, because the image bearing member has a thin surface layer, the life thereof is short. Furthermore, since the environmental stability of such an image bearing member is low, the charged voltage and the voltage at irradiated portions significantly vary depending on the temperature and humidity. Therefore, it is difficult to maintain a sufficient value.

As an anti-abrasion technology for a photosensitive layer replacing these, JP 3194392 describes a method in which a charge transport layer is formed by a liquid of application containing a monomer having a double linkage of C—C, a charge transport material having a double linkage of C—C, and a binder resin. This image bearing member has a good combination of anti-abrasion property and electric characteristics and draws attention. However, when a non-reactive binder resin is used, the binder resin and a cured material formed through the reaction between the monomer and the charge transport material are not sufficiently compatible, causing phase reparation. This tends to lead to the formation of a convexo-concave surface during cross-linking and result in a bad cleaning performance. Additionally, the binder resin prevents the curing of the monomer. The specifically described monomers are di-functional so that the obtained cross linking density is not sufficient and the anti-abrasion property is not satisfactory. Furthermore, even when a reactive binder resin is used, since the monomer and the binder resin have a low number of functional groups, it is difficult to have a good combination of the content of linked charge transport materials and the cross-linking density and obtain sufficient electric characteristics and anti-abrasion properties.

JOP 2004-66425 describes a photosensitive layer containing a compound cured from a positive hole carrier transport compound having at least two chain-reaction polymeric functional groups in one molecular. However, since this photosensitive layer contains bulky positive hole carrier transport compounds having at least two chain reaction polymeric functional groups, distortion may occur in the cured material, which invites a high internal stress and leads to the roughness of the surface layer and the occurrence of cracking over time. Resultantly, the photosensitive layer does not have a sufficient durability.

Furthermore, JOPs 2004-302450, 2004-302451 and 2004-302452 describe a cross linking charge transport layer cured from a radical polymeric monomer having at least three functional groups which does not have a charge transport structure and a radical polymeric monomer having one functional group which has a charge transport structure. The radical polymeric monomer having one functional group which has a charge transport structure imparts electric and mechanical durability and also restrains the occurrence of cracking in the photosensitive layer. However, a monomer having a relatively large number of acrylic groups is used to improve anti-abrasion property when this cross linking charge transport layer is formed. Thereby, the volume contraction ascribable to a cured acryl compound is significant, which may cause insufficient adhesion between the cross linking charge transport layer and a photosensitive layer, which is provided therebelow. As a result, when such an image bearing member is used in an image forming apparatus having a large mechanical hazard to an image bearing member, a problem arises that the cross linking charge transport layer detaches and a sufficient anti-abrasion property is not maintained for an extended period of time.

JOP H02-5069 describes a method in which the durability of an organic image bearing member having a low mechanical strength is improved and the detachment of a surface layer is prevented by providing an intermediate layer formed of a metal dispersion layer having a low resistance on the organic image bearing member and an amorphous carbon hydride layer having a high mechanical strength on the intermediate layer as a surface layer by a plasma polymerization method. However, this method is to achieve the object of preventing deterioration of the surface of an organic image bearing member caused by exposure thereof to a plasma having a high energy. Furthermore, metal particulates dispersed in the intermediate layer is low resistant so that charges can be flow in the latitude direction, which inhibits the formation of an appropriate image.

JPs 2932679 and 2990788 describe a technology of providing an inorganic thin film protective layer on a rough surfaced photosensitive layer. The protective layer provided on the image bearing member described in JOP 2932679 is an inorganic thin film and therefore does not have a sufficient effect on the organic cross linking type protective layer of the present invention. In addition, the object of the improvement described in JP2990788 is to prevent the occurrence of image noise, film deficiency, toner filming, etc., which is totally different from the object and the effect of the image bearing member of the present invention.

SUMMARY OF THE INVENTION

Because of these reasons, the present inventors recognize that a need exists for an image bearing member which can form quality images over an extended period of time, an image forming method using the image bearing member and the image forming apparatus having the image bearing member.

Accordingly, an object of the present invention is to provide an image bearing member which can form quality images over an extended period of time, an image forming method using the image bearing member and the image forming apparatus having the image bearing member.

Briefly the object and other objects of the present invention as hereinafter described will become more readily apparent and can be attained, either individually or in combination thereof, by an image bearing member including a substrate, a photosensitive layer, provided overlying the substrate and a cross linking charge transport layer provided overlying the photosensitive layer and the portion (area) of the photosensitive layer which is most distant from the substrate contains a charge transport material, a binder resin and a filler.

It is preferred that, in the image bearing member mentioned above, the photosensitive layer has a surface roughness Ra of from 0.3 to 0.7 μm before the cross linking charge transport layer is formed thereon.

It is still further preferred that, in the image bearing member mentioned above, the filler has a particle diameter of from 0.005 to 0.5 μm.

It is still further preferred that, in the image bearing member mentioned above, the filler has a refraction index of from 1.2 to 2.8.

It is still further preferred that, in the image bearing member mentioned above, the filler is at least one particulate selected from the group consisting of aluminum oxide, silicon oxide, titanium oxide, silicone resins and melamine resins.

It is still further preferred that, in the image bearing member mentioned above, the binder resin is a bisphenol based polycarbonate or a polyarylate resin.

It is still further preferred that, in the image bearing member mentioned above, the cross linking charge transport layer is formed by curing a liquid of application containing a radical polymeric monomer having at least three functional groups which does not have a charge transport structure, a radical polymeric compound having one functional group which has a charge transport structure, and a reactive silicon compound having a repeated unit of a radical polymeric functional group and a dimethyl siloxane structure.

It is still further preferred that, in the image bearing member mentioned above, the cross liking type charge transport layer has a thickness of from 1 to 10 μm.

It is still further preferred that, in the image bearing member mentioned above, the functional groups of the radical polymeric monomer having at least three functional groups which does not have a charge transport structure is at least one of an acryloyloxy group and a methacryloyloxy group.

It is still further preferred that, in the image bearing member mentioned above, the ratio (M/F) of the molecular weight (M) of the radical polymeric monomer having at least three functional groups which does not have a charge transport structure to the number of functional groups (F) is not greater than 250.

It is still further preferred that, in the image bearing member mentioned above, the functional group of the radical polymeric compound having one functional group which has a charge transport structure is either of an acryloyloxy group or a methacryloyloxy group.

It is still further preferred that, in the image bearing member mentioned above, the charge transport structure of the radical polymeric compound having one functional group which has a charge transport structure is triarylamine structure.

It is still further preferred that, in the image bearing member mentioned above, the functional group of the radical polymeric compound having one functional group which has a charge transport structure is at least one kind of the following represented by a chemical structure (1) and a chemical structure (2):

Chemical Structure (1)

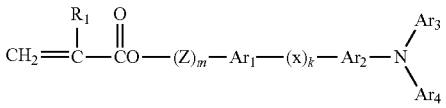

Chemical structure (2)

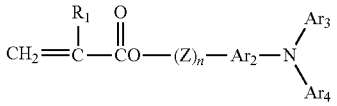

wherein $R_1$ represents one of hydrogen atom, a halogen atom, a substituted or non-substituted alkyl group, a substituted or non-substituted aralkyl group, a substituted or non-substituted aryl group, cyano group, nitro group, alkoxy group, —$COOR_7$, wherein $R_7$ represents hydrogen atom, a substituted or non-substituted alkyl group, a substituted or non-substituted aralkyl group, and a substituted or non-substituted aryl group, a halogenized carbonyl group or $CONR_8R_9$ ($R_8$ and $R_9$ independently represent one of hydrogen atom, a halogen atom, a substituted or non-substituted alkyl group, a substituted or non-substituted aralkyl group and a substituted or non-substituted aryl group, $Ar_1$ and $Ar_2$ independently represent a substituted or non-substituted arylene group, $Ar_3$ and $Ar_4$ independently represent a substituted or non-substituted aryl group, X represents one of a substituted or non-substituted alkylene group, a substituted or non-substituted cycloalkylene group, a substituted or non-substituted alkylene ether group, oxygen atom, sulfur atom, and vinylene group, k represents 0 or 1, Z represents a substituted or non-substituted alkylene group, a substituted or non-substituted bivalent alkylene ether group, and a bivalent alkyleneoxy carbonyl group, and m and n represent an integer of from 0 to 3.

It is still further preferred that, in the image bearing member mentioned above, The image bearing member according to claim 8, the radical polymeric compound having one functional group which has a charge transport structure is represented by at least one kind of the following chemical structure (3):

Chemical structure 3

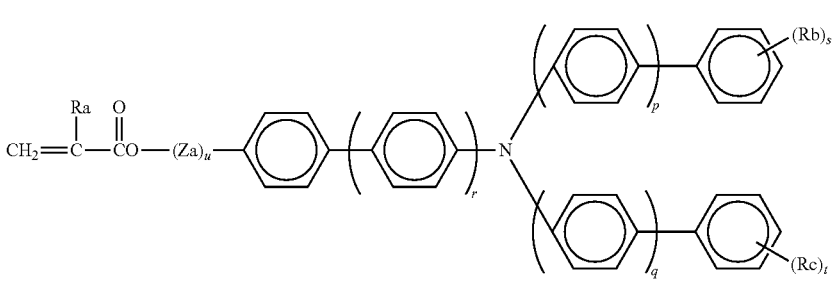

wherein r, p and q independently represent 0 or 1, Ra represents hydrogen atom or methyl group, Rb and Rc represent a hydrogen atom or an alkyl group having 1 to 6 carbon atoms, s and t independently represent an integer of from 1 to 3, each of Rb and Rc can be different when s and t are 2 or 3, Za represents methylene group, ethylene group, —$CH_2CH_2O$—, —$CHCH_3CH_2O$—, or —$C_6H_5CH_2CH_2$—, and u represents 0 or 1.

As another aspect of the present invention, the present invention provides an image forming method including charging the image bearing member mentioned above, irradiating the image bearing member to form a latent electrostatic image thereon, developing the latent electrostatic image with a developer, cleaning the surface of the image bearing member and transferring the developed image to a recording medium.

As another aspect of the present invention, the present invention provides an image forming apparatus including the image bearing member mentioned above, a charging device for charging the image bearing member, an irradiating device for irradiating the image bearing member to form a latent electrostatic image thereon, a developing device for developing the latent electrostatic image with a developer, a cleaning device for cleaning the surface of the image bearing member and a transferring device for transferring the developed image to a recording medium.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
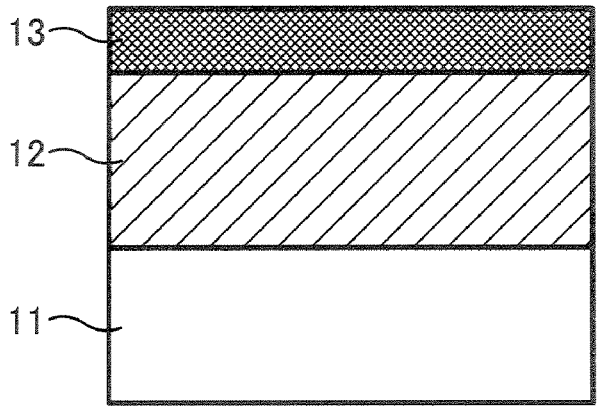
FIG. 1 is a diagram illustrating an example of the cross section of the image bearing member for use in the present invention.

The present invention will be described below in detail with reference to several embodiments and the accompanying drawings.

The image bearing member of the present invention includes an electroconductive substrate on which at least a photosensitive layer and a cross linking charge transport layer are accumulated in this order. The area in the photosensitive layer most distant from the substrate contains at least a charge transport material, a binder resin and a filler. The present invention is effective to a photosensitive layer containing these charge transport material, binder resin and filler in all layer.

Therefore, the photosensitive layer of the present invention forms a surface having a fine convexo-concave structure. The surface are a relatively increases in comparison with the case of a photosensitive layer in which a filler is not contained. Accordingly, the adhesion strength increases as the adhesion area between the photosensitive layer and the cross linking charge transport layer increases. That is, the image bearing member of the present invention has an increasingly improved adhesion between the photosensitive layer and the cross linking charge transport layer due to the anchor effect of the filler. Therefore, an image bearing member which has a high durability and can produce quality images over an extended period of time can be obtained.

In addition, the filler for use in the area in the photosensitive layer of an image bearing member most distant from the substrate is typified into an organic filler and an inorganic filler. There is no specific limit to those fillers as long as the anchor effect is recognized for the cross linking charge transport layer. These fillers can be used alone or in combination. These fillers can be dispersed by using a suitable dispersing device for a liquid of application for a photosensitive layer.

In the present invention, the surface roughness Ra of a photosensitive layer before a cross linking charge transport layer is accumulated thereon is preferably from 0.3 to 0.7 μm in terms of improving the adhesion between the photosensitive layer and the cross linking charge transport layer. Thereby, a fine convexo-concave structure due to the filler can be continually formed on the surface of the photosensitive layer as an area having continuity. Therefore, when a cross linking charge transport layer is formed, the adhesion areas for the photosensitive layer increases. As a result, the adhesion is deduced to increase. In the present invention, an image bearing member which has a high durability and can produce quality images for an extended period of time can be obtained due to the anchor effect mentioned above.

The surface roughness Ra in the present invention represents the centerline average roughness measured according to the method described in JIS B0601: 1982. The values (Ra) relating to this surface roughness are the arithmetic means for the values in the areas (at least 5 areas) arbitrarily selected from the surface of an image bearing member.

Centerline Average Roughness (Ra)

Centerline average roughness (Ra) represents a value (μm) obtained from the following relationship (1) wherein the portion of the measuring length L is extracted from the rough curve along the centerline direction and the centerline of the extracted portion is set to be X axis, the direction of the axial magnification is set to be Y axis and the roughness curve is represented by y=f(x).

Relationship (1)

$$Ra = \frac{1}{L}\int_0^L |f(x)|dx$$

The centerline represents a straight line which is drawn in parallel with the average line of a roughness curve in such a manner that the areas enclosed between this straight line and the roughness curve are equal for both sides relative to the straight line.

The surface roughness Ra of the photosensitive layer relating to the present invention is measured according to JIS B0601: 1982 using a surface texture and contour measuring instrument (SURFCOM 1400D, manufactured by Tokyo Seimitsu Co., Ltd.) with a measuring length of 2 mm, a measuring speed of 0.06 mm/s and a cutoff wavelength of 0.8 mm. The surface roughness Ra in the present invention is a calculated value based on two dimensional form. In consideration of the measuring error, the surface roughness Ra of a photosensitive layer is obtained by measuring the surface roughness of 3 points selected along the rotation axis direction of the image bearing member and another 3 points selected along the circumference direction thereof and averaging the 6 measured values.

The surface of the area in the photosensitive layer relating to the present invention which is most distant from the substrate is preferred to have a surface roughness Ra of from 0.3 to 0.7 μm. This surface roughness Ra is determined considering the following. That is, the surface of the photosensitive layer on which a cross linking charge transport layer is provided is preferred to be smooth in terms of the infusion property of a photocarrier. Thereby, the contact between the photosensitive layer and the cross linking layer is improved and the transportability of the photocarrier is ameliorated, resulting in amelioration of the quality of images. On the other hand, in terms of the sustainability of an image bearing member, it is preferred to form a photosensitive layer having a surface of a convexo-concave structure to increase the surface area. Thereby, the adhesion between the photosensitive layer and the cross linking charge transport layer is improved so that a highly durable image bearing member can be obtained. As the condition satisfying both these requisites, the surface roughness Ra is determined to be from 0.3 to 0.7 μm. A surface roughness that is excessively small may cause the deterioration of the adhesion. A surface roughness that is excessively large may invite the rise in the voltage at the irradiated portion of an image bearing member.

As the writing light source in the electrophotography process using the image bearing member of the present invention, semiconductor lasers (LD) having an oscillation wavelength of from about 780 nm to about 800 nm and light emitting diodes (LED) having an oscillation wavelength of 740 nm can be typically and representatively used. In addition, in the present invention, LDs or LEDs having an oscillation wavelength of from 400 to 450 nm, which can be adopted in the digital recording format by which writing density and image definition can be improved, can be also used. These light sources have an extremely narrow light intensity wavelength distribution. However, their oscillation peak wavelength moves to the long wavelength side or the short wavelength side by a few or several nm due to, for example, the temperature environment and the manufacturing lot. Therefore, when an LD or LED having such a short wavelength is used as a light source, the photosensitive layer of an image bearing member is preferred to sufficiently permeate light having a wavelength of from 380 to 480 nm. In addition, judging from the light intensity wavelength distribution characteristics described above, it is not necessary for the photosensitive layer to permeate the total range of the wavelength of from 380 to 800 nm but sufficient to permeate at least one desired homogeneous light in this range. The permeation ratio of a writing light is preferably not less than 50%, and more preferably not less than 90%.

As described above, in the area (portion) of the photosensitive layer of the image bearing member of the present invention which is most distant from the substrate, it is desired to secure the transmission property for a writing light in the wavelength range of from 380 to 800 nm. The filler contained in this area has a refraction index different from that of the binder resin for use in the photosensitive layer. Therefore, the photosensitive layer itself tends to be non-transparent. To address this drawback, the transparency of the photosensitive layer is improved by, for example, reducing the particle diameter of the used filler to be as fine as possible. This means, when the particle diameter of a filler is smaller than the wavelength of a writing light, the filler does not actually scatter the light, that is, the photosensitive layer is transparent in a practical sense. The average particle diameter of the filler is preferably from 0.005 to 0.5 μm in terms of the light transmission mentioned above of the photosensitive layer. It is more preferred that the particle diameter is adjusted to be from 0.2 to 0.4 μm. An average particle diameter of a filler in the photosensitive layer that is extremely large not only degrades the transparent property of the layer and the dispersion property of the filler but also may disturb a latent electrostatic image formed on an image bearing member, resulting in the deterioration of the image quality. To the contrary, an average particle diameter of a filler in the photosensitive layer that is extremely small weaken the binding force with a binder resin in the photosensitive layer. In addition, since the filler in the photosensitive layer is extremely densely arranged when the photosensitive layer is formed, the filler can trap charges when the charges move, which causes the deterioration of optical extinction characteristics and the rise in the remaining voltage. Furthermore, the filler easily agglomerates in the preparation process of a liquid of application for a photosensitive layer so that the obtained photosensitive layer is not uniform in layer quality. These drawbacks can be solved by making the average particle diameter of a filler to be from 0.2 to 0.4 μm.

The average particle diameter of a filler represents the average primary particle diameter in the present invention.

As the method of measuring the average primary particle diameter, known methods can be used. For example, there can be used a laser diffraction and scattering method using the intensity distribution pattern of diffracted and scattered light varying depending on the particle diameter and a method of measuring a specific surface area using a gas absorption method. Especially, the specific surface area measured by a gas absorption method does not depend on the state of agglomeration and objectively evaluates the size of a primary particle. In the method, gas molecules whose absorption occupying area is already known are absorbed in the surface of powder particles of a target material at the temperature of liquid nitrogen and the specific surface area of the target material is obtained from the absorption amount. Among them, a method of obtaining the average primary particle diameter by Brunauer-Emmett-Teller (BET) specific surface area and the true specific gravity of particles is most popular. In the specific surface area measured by using a BET method based on low temperature low humidity physical absorption of an inert gas, there are the one point BET method, which is simple and easy, and the multiple BET method, which is more reliable than the one point BET method. These measuring modes are selected according to the specific surface area of particles. When measuring particles having a large specific surface area, the multiple point BET method which can adopt a large total surface area (from about 100 to about 300 $m^2$) is preferred.

The primary particle diameter of a filler can be calculated by measurement using a surface area measuring device (QUANTASORB, model QA-14, manufactured by Quantachrome Instruments), etc.

The refraction index of the filler is preferably from 1.2 to 2.8 and more preferably from 1.2 to 1.6. Thereby, it is possible to make the difference between the refraction indices of the filler and a binder resin. A refraction index of a filler that is excessively small or large degrades the light transmission of the photosensitive layer. This causes the deterioration of dot representation by image irradiation and image quality. The refraction index of a filler can be obtained by, for example, dipping particles in a liquid which can change the refraction index little by little to obtain the refraction index of the liquid at which the particle interface is indistinct. The refraction index or the index of refraction represents the average refraction index measured according to ASTMD-1218 or its equivalents using Abbe refractometry under the condition of a temperature range of from 24.5 to 25.5° C. and 589 nm, unless otherwise specified.

Organic fillers and inorganic fillers can be used as the materials of the filler added to improve the adhesion between the photosensitive layer and the cross linking charge transport layer. Any organic fillers can be used and specific examples thereof include fluorine resin particulates, for example, polytetrafluoroethylene, silicone resin particulates, a-carbon particulates and melamine resin particulates. Among them, organic fillers having a high dispersion property and by which the rise of the residual voltage is small are preferred. As such organic fillers, melamine resin particulates and silicone resin particulates are suitable. Specific examples of the inorganic fillers include powder of metal, for example, copper, tin, aluminum and indium, metal oxides, for example, silica, tin oxide, zinc oxide, titanium oxide, alumina, zirconia, indium oxide, antimony oxide, bismuth oxide, calcium oxide, tin oxide doped with antimony, and indium oxide doped with tin, metal fluorides, for example, tin fluoride, calcium fluoride and aluminum fluoride, potassium titanate, and arsenic nitride.

Among these organic fillers and inorganic fillers, inorganic materials, especially metal oxides are advantageous to improve the quality of images in terms of light scattering. Furthermore, a filler having a high electric insulation property is preferred as the filler which hardly causes image blur. Especially, a filler that has a specific resistance of not less than $10^{10}\Omega\cdot cm$ is preferred in light of image definition. When an electroconductive filler is added in the area of the photosensitive layer most distant from a substrate, charges move in the horizontal direction due to the decrease of the resistance of the surface, which tends to cause image blur. Specific examples of such fillers include alumina, titanium oxide, zirconia and silica. Among these, a type alumina, which has a high insulation property, high thermal stability and hexagonal close-packed structure having a high hardness characteristic, is especially preferred in terms of restraint of the occurrence of image blur, etc. Zinc oxide is a specific example of an electroconductive filler having a specific resistance of not greater than $10^{10}\Omega\cdot cm$ or a filler having a relatively low specific resistance. These fillers can be used in combination. It is not possible to completely classify fillers by their material because the specific resistance thereof may be different. It is desired to select a filler according to the specific resistance thereof.

The specific resistance of a filler can be obtained by using a measuring device having the same structure as described in FIG. 1 of JOP H05-94049 and FIG. 1 of JOP H05-113688.

Specific examples of the binder resin contained in the area of the photosensitive layer relating to the present invention most distant from a substrate include polystyrenes, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins and ethyl cellulose resins. These can be used alone or mixed for use in combination. In the image bearing member of the present invention, the adhesion effect between a photosensitive layer and a cross linking charge transport layer is improved by adding an inorganic filler and/or an organic filler to mainly increase the surface area of the photosensitive layer and using the filler and a binder resin in combination. The binder resin, which is the main material of the photosensitive layer media, plays an important role in heightening the effect. That is, since the binder resin has a great impact on not only the residual voltage and the image definition but also the dispersion property of the filler, etc., the selection of the binder resin is extremely important. Among these binder resins, polycarbonate resins, especially, bisphenol type polycarbonate resins and polyarylate resins are especially effectively used.

The inorganic filler material mentioned above can be dispersed by using a typical method, for example, a ball mill, high pressure liquid collision, an attritor, a sand mill and supersonic. Among these, using a ball mill in which impurities hardly commingle from outside, is preferred in terms of dispersion property. With regard to the media for use in the inorganic filler, known media, for example, zirconia, alumina, and agate, which are typically used, can be used.

The addition amount of a filler in the photosensitive layer is suitably selected according to the light transmission, the application method and desired layer thickness of a component thereof. Any addition amount is allowed as long as the transparency of the layer is maintained when a cross linking charge transport layer is formed. In terms of maintaining the surface roughness of a photosensitive layer just before a cross linking charge transport layer is formed to impart a sufficient adhesion property between the photosensitive layer and the cross linking charge transport layer, the addition amount of a filler is not greater than 100 parts by weight, preferably from 0.001 to 100 parts by weight and more preferably from 5 to 30 parts by weight based on 100 parts of a resin. When the addition amount of a filler is too small, desired adhesion property is not obtained. In addition, an addition amount of a filler that is too large tends to result in the deterioration of the quality of images caused by, for example, the rise in the residual voltage, the occurrence of image blur, and the deterioration of the image definition. Furthermore, an addition of a filler that is extremely large may increase the mutual interaction between the fillers, which causes the deterioration of the dispersion property.

In the present invention, since the layer thickness of the area of a photosensitive layer which is most distant from a substrate varies depending on the layer structure of an image bearing member, the description is provided according to the following layer structure.

FIG. 1 is a diagram illustrating an example of the image bearing member of the present invention. The image bearing member includes an electroconductive substrate 11 and a photosensitive layer 12, which is formed on the electroconductive substrate 11. The photosensitive layer 12 is of a single layered structure while having a charge generating function and a charge transport function simultaneously. The photosensitive layer 12 contains a filler in all layer or the surface portion thereof. Furthermore, a cross linking charge transport layer 13 is formed on the surface of the photosensitive layer 12.

Figure 2:
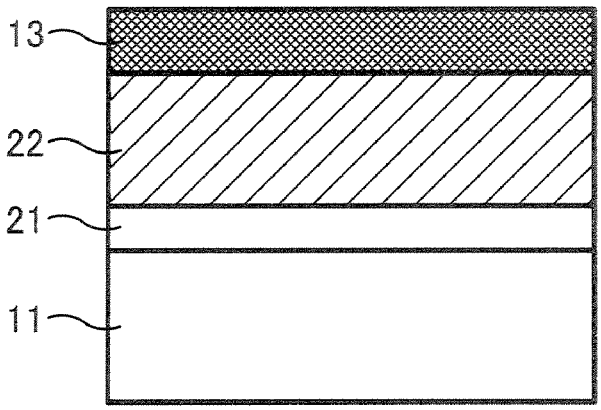
FIG. 2 is another example of the cross section of the image bearing member for use in the present invention.

FIG. 2 is a diagram illustrating another example of the image bearing member of the present invention. The image bearing member has an electroconductive substrate 11 and a photosensitive layer of an accumulated structure in which a charge transport layer 22 having a charge transport function is accumulated on a charge generating layer 21 having a charge generating function. The charge transport layer 22 contains a filler in all layer or the surface portion thereof. Furthermore, a cross linking charge transport layer 13 is formed on the surface of the charge transport layer 22.

The photosensitive layer for use in the present invention can be applicable to a single layered structure and an accumulated layered structure in which a charge generating layer is accumulated on a charge transport layer.

Among the layer structure of the image bearing member of the present invention, the photosensitive layer having an area containing fillers which is most distant from a substrate, is described first.

The photosensitive layer of an accumulated layer structure has a charge transport layer containing fillers in all layer or the surface layer thereof. The charge transport layer simultaneously has an anchor effect for a cross linking charge transport layer and a charge transport function. The area of the charge transport layer most distant from the substrate can be formed by applying and drying a liquid of application in which a filler imparting an anchor effect, a charge transport material having a charge transport function and a binder resin are dissolved or dispersed in a suitable solvent.

The fillers mentioned above can be used as the filler imparting an anchor effect.

The charge transport material having a charge transport function can contain a low molecular weight charge transport material. Positive hole transport materials can be used as the low molecular weight charge transport material.

Specific examples of the positive hole transport materials include electron donating materials, for example, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diarylmethane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bis stilbene derivatives, and enamine derivatives. These positive hole transport materials can be used alone or can be mixed in combination for usage.

In addition to the examples mentioned above, other specific examples of the binder resin include thermoplastic resins or thermocuring resins, for example, polyamide resins, polyurethane resins, epoxy resins, polyketone resins, silicone resins, acryl resins, polyvinyl butyral resins, polyvinyl formal resins, polyvinyl ketone resins, poly(N-vinylcarbazolee) resins, polyacrylamide resins, polyvinyl toluene resins, melamine resins, urethane resins, phenol resins and alkyd resins.

In addition, charge transport polymer materials having a charge transport function, for example, polymer materials, for example, polycarbonate resins, polyester resins, polyurethane resins, polyether resins, polysiloxane resins, and acryl resins which have arylamine skeleton, benzidine skeleton, hydrazone skeleton, carbazolee skeleton, stilbene skeleton, pyrazoline skeleton, etc.; and polymer materials having polysilane skeleton, can be used as the binder resin. When a charge transport polymer material is used, it is possible to restrain the dissolution of a charge transport layer occurring when a cross linking charge transport layer is applied. These binder resins and charge transport polymer materials having a charge transport function can be used alone or in combination.

Specific examples of the binder resin are charge transport materials set forth in, for example, JOPs H01-001728, H01-009964, H01-013061, H01-019049, H01-241559, H04-

011627, H04-175337, H04-183719, H04-225014, H04-230767, H04-320420, H05-232727, H05-310904, H06-234836, H06-234837, H06-234838, H06-234839, H06-234840, H06-234841, H06-239049, H06-236050, H06-236051, H06-295077, H07-056374, H08-176293, H08-208820, H08-211640, H08-253568, H08-269183, H09-062019, H09-043883, H09-71642, H09-87376, H09-104746, H09-110974, H09-110976, H09-157378, H09-221544, H09-227669, H09-268226, H09-272735, H09-302084, H09-302085 and H09-328539.

Specific examples of the charge transport polymer materials having a charge transport function include polysilylenes set forth in JOP S63-285552, H05-19497, H05-70595 and H10-73944.

The addition amount of a charge transport material is preferably from 20 to 300 parts by weight, and more preferably from 40 to 150 parts by weight based on 100 parts of a binder resin. A charge transport polymer material can be used alone or in combination with a binder resin.

A plasticizing agent and a leveling agent can be added to a liquid of application for a charge transport layer including the area of the charge transport layer most distant from the substrate, if desired.

Specific examples of the plasticizing agent include dibutyl phthalate and dioctyl phthalate, which are used for typical resins. The addition amount of the plasticizing agent is preferably from 0 to 30 parts by weight based on 100 parts by weight of a binder resin.

Specific examples of the leveling agent include silicone oils, for example, dimethyl silicone oil and methyl phenyl silicone oil, and polymers or oligomers having perfluoroalkyl groups in its branch chain. The addition amount of the leveling agent is preferably from 0 to 1 part by weight based on 100 parts by weight of a binder resin.

The area can be formed by a typical method, for example, a dip coating method, a spray coating method, a beat coating method, a nozzle coating method, a spinner coating method and a ring coating method. Among these, a spray coating method is preferred especially in terms of uniformity of the applied layer.

It is possible to form a protective layer by coating a liquid of application in an amount enough to cover the desired thickness of the protective layer at one time. However, it is preferred to separately coat a liquid of application at least twice to obtain a multiple layered protective layer in terms of uniform dispersion of a filler existing in the layer. Thereby, the effect of the reduction of the residual voltage, the improvement on image definition and the amelioration of anti-abrasion property is promoted furthermore.

The thickness of a charge transport layer is preferably from 5 to 40 μm and more preferably from 1 to 30 μm. The thickness of the area of the charge transport layer most distant from a substrate is preferably from 1 to 10 μm and more preferably from 1 to 8 μm.

As a method of forming a charge generating layer, it is possible to use a vacuum thin layer manufacturing method and a casting method from a solution dispersion system.

Specific examples of the vacuum thin layer manufacturing method include a vacuum deposition method, a glow discharging decomposition method, an ion plating method, a sputtering method, and a reactive sputtering method and a chemical vacuum deposition (CVD) method. Both inorganic materials and organic materials can be used for forming a charge transport layer.

When a casting method is used, if desired, it is possible to form a charge generating layer by applying a suitably diluted liquid dispersion obtained by dispersing an inorganic material or an organic material in a solvent together with a binder resin using a dispersing device. Specific examples of the solvent include tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butyl acetate. Specific examples of the dispersing device include a ball mill, an attritor, a sand mill, and a bead mill. In addition, if desired, a leveling agent, for example, dimethyl silicone oil and methylphenyl silicone oil, can be added to the liquid dispersion mentioned above. Furthermore, the application mentioned above is performed by a dip coating method, a spray coating method, a bead coating method and a ring coating method.

In the present invention, the thickness of the charge transport layer is preferably from 0.01 to 5 μm and more preferably from 0.05 to 2 μm.

The photosensitive layer having a single layered structure contains fillers in all layer or the surface layer thereof. The photosensitive layer simultaneously has an anchor effect for a cross linking charge transport layer, a charge generating function and a charge transport function. The area of the photosensitive layer most distant from the substrate can be formed by applying and drying a liquid of application in which a filler imparting an anchor effect, a charge generating material having a charge generating function, a charge transport material having a charge transport function and a binder resin are dissolved or dispersed in a suitable solvent to the photosensitive layer which does not contain the filler or to an electroconductive substrate.

The fillers mentioned above can be used as the filler imparting an anchor effect.

It is possible to use an inorganic material and an organic material as the charge generating material having a charge generating function.

Specific examples of the inorganic materials include crystal selenium, amorphous selenium, selenium-tellurium, selenium-tellulium-halogen, selenium-arsenic compounds and amorphous silicon. With regard to the amorphous silicon, amorphous silicon in which the dangling bonding is terminated by hydrogen atoms and halogen atoms or boron atoms and phosphorous atoms are doped are suitably used.

On the other hand, known materials can be used as the organic materials. Specific examples thereof include phthalocyanine based pigments, for example, metal phthalocyanine and non-metal phthalocyanine, azulenium salt pigments, methine squaric acid pigments, azo pigments having carbazolee skeleton, azo pigments having triphenyl amine skeleton, azo pigments having dibenzothiophene skeleton, azo pigments having fluorenone skeleton, azo pigments having oxadiazole skeleton, azopigments having bisstilbene skeleton, azopigments having distyryl oxadiazole skeleton, azo pigments having distyryl carbazolee skeleton, perylene based pigments, anthraquinone based or polycyclic quinone pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

In addition, as low molecular weight charge transport materials having a charge transport function, electron transport materials can be used in combination other than the positive hole transport materials mentioned above.

Specific examples of the charge transport material include electron accepting materials, for example, chloroanyl, bromoanyl, tetracyanoethylene, tetracyano quinodimethane, 2,4,7-trinitro-9-fluorenone, 2,4,5,7-tetranitro-9-fluorenone, 2,4, 5,7-tetranitroxanthone, 2,4,8-trinitrothioxanthone, 2,6,8-trinitro-4H-indeno[1,2-b]thiophene-4-one, 1,3,7-trinitro dibenzothiophen-5,5-dioxide, and diphenoquinone derivatives. These can be used alone or in combination.

The examples mentioned above can be used as the binder resins and the charge transport polymer materials having a charge transport function which are used for the area of the photosensitive layer most distant from a substrate. Among these, when a charge transport polymer material is used, it is possible to restrain the dissolution of the photosensitive layer occurring when a cross linking charge transport layer is coated. These binder resins and the charge transport polymer materials having a charge transport function can be used alone or in combination.

In addition, the plasticizing agents and the leveling agents mentioned above, etc., can be added to the liquid of application for a photosensitive layer, if desired.

The content of the charge generating material in a photosensitive layer is preferably from 1 to 30 weight %. The content of the charge transport material therein is preferably from 1 to 70 weight %. The content of the binder resin therein is preferably from 20 to 80 weight %.

The thickness of a photosensitive layer is preferably from 5 to 30 μm and more preferably from 10 to 25 μm. In addition, the thickness of the area of a photosensitive layer containing a filler which is most distant from a substrate is preferably from 1 to 10 μm and more preferably from 1 to 8 μm.

An electroconductive substrate having a volume resistivity of $10^{10}\Omega\cdot$cm is usable. For example, there can be used plastic or paper having a film form or cylindrical form covered with a metal such as aluminum, nickel, chrome, nichrome, copper, gold, silver, and platinum, or a metal oxide, for example, tin oxide and indium oxide by depositing or sputtering. Also a board formed of aluminum, an aluminum alloy, nickel, and a stainless metal can be used. Furthermore, a tube which is manufactured from the board mentioned above by a crafting technique, for example, extruding and extracting, and surface-treatment, for example, cutting, super finishing and grinding is also usable. In addition, the endless nickel belt and the endless stainless belt set forth in JOP S52-36016 can be used as the electroconductive substrate. In addition thereto, a substrate formed of plastic or paper having a film or cylindrical form and an electroconductive layer provided thereon in which electroconductive powder is dispersed in a binder resin can be used as the electroconductive substrate for use in the present invention.

As the electroconductive powder, carbon black, acetylene black, powder of metal, for example, nickel, nichrome, copper, zinc and silver, and metal oxide powder, for example electroconductive zinc oxides and ITO can be used.

As the binder resin in which electroconductive powder is dispersed, there can be used thermoplastic resins, thermal curing reins and optical curing resins, for example, polystyrene, copolymers of styrene and acrylonitrile, copolymers of styrene and butadiene, copolymers of styrene and maleic anhydrate, polyesters, polyvinyl chloride, copolymers of vinyl chloride and vinyl acetate, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly(N-vinylcarbazolee) resins, acryl resins, silicone resins, epoxy resins, melamine resins, urethane resins, phenol resins and alkyd resins.

The electroconductive layer can be formed by application of a liquid in which electroconductive powder and a binder resin are dispersed in a solvent, for example, tetrahydrofuran, dichloromethane, methylethyl ketone and toluene.

Also, a substrate formed of a heat contraction tube containing electroconductive powder on which an electroconductive layer is formed can be used as the electroconductive substrate. Specific examples of the materials for the heat contraction tube include polyvinylchloride, polypropylene, polyester, polystyrene, polyvinylidene chloride, polyethylene, chlorinated rubber, and TEFLON®.

As to the image bearing member of the present invention, when a cross linking charge transport layer is formed on the surface of a photosensitive layer, an intermediate layer can be provided to restrain the commingling of the composition of the photosensitive layer to the cross linking charge transport layer. The intermediate layer can restrain disadvantages caused by the commingling. Such disadvantages are, for example, the inhibition of the curing reaction and the formation of a cross linking charge transport layer having a convexo-concave surface.

In general, such an intermediate layer mainly contains a binder resin. Specific examples of the binder resin include polyamide, alcohol soluble nylon, water soluble polyvinyl butyral and polyvinyl alcohol. It is possible to use the typical coating methods mentioned above when forming such an intermediate layer. The thickness of the intermediate layer is from 0.05 to 2 μm.

As to the image bearing member of the present invention, an undercoating layer can be provided between the electroconductive substrate and the photosensitive layer. In general, such an undercoating layer is mainly formed of a resin. Considering the case in which a photosensitive layer is formed on the intermediate layer (i.e., resin) using a solvent, the resin is preferably hardly soluble in a typically used organic solvent. Specific examples of such resins include water soluble resins, for example, polyvinyl alcohol, casein, and sodium polyacrylate, alcohol soluble resins, for example, copolymerized nylon and methoxymethylized nylon and curing resins which form a three-dimensional mesh structure, for example, polyurethane, melamine resins, phenol resins, alkyd-melamine resins and epoxy resins. In addition, fine powder pigments of metal oxides exemplified by titanium oxide, silica, alumina, zirconium oxide, tin oxide and indium oxide can be added to the undercoating layer to prevent the occurrence of moiré, reduce the residual voltage and so on.

The undercoating layer can be formed by using the same solvents and the same coating methods as those for the photosensitive layer. Furthermore, silane coupling agents, titanium coupling agents and chromium coupling agents can be used in the undercoating layer. In addition, $Al_2O_3$ formed by anodic oxidization, organic compounds, for example, polyparaxylylene (parylene), which are formed by a vacuum thin layer manufacturing method, and inorganic materials, for example, $SiO_2$, $SnO_2$, $TiO_2$, ITO and $CeO_2$ can be also used in the undercoating layer. The thickness of the undercoating layer is from 0 to 5 μm.

In addition, in the present invention, to improve the anti-environment properties, especially to prevent the reduction in the sensitivity and the rise in the residual voltage, an anti-oxidizing agent can be added to each layer of the surface layer, the photosensitive layer (charge generating layer and charge transport layer), undercoating layer, etc.

Specific examples of such anti-oxidizing agents include the following: phenol based compounds, for example, 2,6-di-t-butyl-p-cresol, butylated hydroxyl anisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester and tocopherol; Paraphenylene diamines, for example, N-phenyl-N' isopropyl-p-phenylene diamine, N,N'-di-(sec-butyl)-p-phenylene diamine, N-phenyl-N-sec-butyl-p-phenylene diamine, N,N'-di-isopropyl-p-phenylene diamine, and N,N'-dimethyl-N,N'-di-(t-butyl)-p-phenylene diamine; Hydroquinones, for example, 2,5-di-t-octyl hydroquinone, 2,6-di-dodecyl hydroquinone, 2-dodecyl hydroquinone, 2-dodecyl-5-chloro hydroquinone, 2-t-octyl-5-methyl hydroquinone, 2-(2-octadecenyl)-5-methyl hydroquinone; Organic sulfur compounds, for example, dilauryl-3,3-thiodipropionate, distearyl-3,3'-thiodipropionate, and ditetradecyl-3,3'-thiodipropionate; and organic phosphorus compounds, for example, triphenyl phosphine, tri(nonylphenyl)phosphine, tri(dinonylphenyl)phosphine, tricresyl phosphine and tri(2,4-dibutylphenoxy)phosphine.

These compounds are known as anti-oxidizing agents for rubber, plastic, and oil and marketed products thereof can easily be obtained. The addition amount of the anti-oxidizing agent in the present application is from 0.01 to 10% by weight based on the total amount of the layer to which the anti-oxidizing agent is added.

Next, the composition materials for a liquid of application for the cross linking charge transport layer for use in the present invention will be described.

In the present invention, the radical polymeric functional groups of the radical polymeric monomer having at least three functional groups without having a charge transport structure is preferably acryloyloxy group and/or methacryloyloxy group.

A compound having at least three acryloyloxy groups can be obtained by conducting an esterization reaction or an ester conversion reaction using, for example, a compound having at least three hydroxyl groups therein and an acrylic acid (salt), a halide acrylate and an ester of acrylic acid. Similarly, a compound having at least three methacryloyloxy groups can be obtained. In addition, the radical polymeric functional groups in a radical polymeric monomer having at least three functional groups without having a charge transport structure can be the same or different from each other.

Specific examples of the radical polymeric monomer having at least three functional groups without having a charge transport structure include trimethylol propane triacrylate (TMPTA), trimethylol propane trimethacrylate, hydroxy propyl acrylate (HPA) modified trimethylol propane triacrylate, ethyleneoxy (EO) modified trimethylol propane triacrylate, propyleneoxy (PO) modified trimethylol propane triacrylate, caprolactone modified trimethylol propane triacrylate, hydroxy propyl acrylate (HPA) modified trimethylol propane triacrylate, pentaerythritol triacrylate, pentaerythritol tetra acrylate (PETTA), glycerol triacrylate, epichlorohydrin (ECH) modified glycerol triacrylate, ethyleneoxy (EO) modified glycerol triacrylate, propyleneoxy (PO) modified glycerol triacrylate, tris(acryloxyethyl) isocyanulate, dipenta erythritol hexaacrylate (DPHA), caprolactone modified dipenta erythritol hexaacrylate, dipenta erythritol hydroxy pentaacrylate, alkyl modified dipenta erythritol pentaacrylate, alkyl modified dipenta erythritol tetraacrylate, alkyl modified dipenta erythritol triacrylate, dimethylol propane hexaacrylate (DTMPTA), penta erythritol ethoxy tetraacrylate, ethyleneoxy (EO) modified phosphoric acid triacrylate, and 2,2,5,5-tetrahydroxy methyl cyclopentanone hexaacrylate. These can be used alone or in combination.

In addition, the radical polymeric monomer having at least three functional groups without having a charge transport structure preferably has a ratio (molecular weight/the number of functional groups) of the molecular weight to the number of functional groups in the monomer is not greater than 250 to form a dense cross linking structure in a cross linking charge transport layer. When the ratio (molecular weight/the number of functional groups) is too large, a cross linking charge transport layer is soft, which may result in the deterioration of the anti-abrasion property. Therefore, among the monomers mentioned above, it is not preferred to singly use a monomer having a modified functional group, for example, HPA, EO and PO, when the modified functional group is extremely long.

In addition, the addition amount of the radical polymeric monomer having at least three functional groups without having a charge transport structure is from 20 to 80% by weight and preferably from 30 to 70% by weight based on the total weight of a cross linking charge transport layer. When the addition amount is too small, the density of three-dimensional cross linking in the cross linking charge transport layer tends to be small, which may degrade the anti-abrasion characteristic thereof. When the addition amount is too large, the content of a charge transport compound decreases, which may result in the deterioration of the electric characteristics. Desired electric characteristics and anti-abrasion property vary depending on the process. Therefore, it is difficult to jump to any conclusion but considering the balance of both characteristics, the addition amount is preferably from 30 to 70% by weight.

The radical polymeric monomer having a functional group and a charge transport structure for use in the present invention represents a monomer having a positive hole structure, for example, triaryl amine, hydrazone, pyrazoline and carbazolee, or an electron transport structure, for example, an electron suction aromatic ring having, for example, condensed polycyclic quinone, diphenoquinone, a cyano group and a nitro group and also having a radical polymeric functional group. The radical polymeric functional group is preferably acryloyloxy group or methacryloyloxy group. The charge transport structure is preferably a triaryl amine structure.

In the present invention, as the radical polymeric monomer having a functional group and a charge transport structure, it is preferred to use at lease either of the compounds represented by the chemical structures (1) and (2). Thereby, the electric characteristics, for example, sensitivity and residual voltage, are preferably maintained.

[Chemical Structure 1]

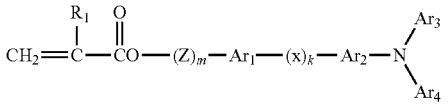

Chemical Structure (1)

[Chemical Structure 2]

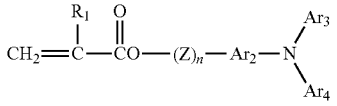

Chemical Structure (2)

In the Chemical structures (1) and (2), $R_1$ represents one of hydrogen atom, a halogen atom, a substituted or non-substituted alkyl group, a substituted or non-substituted aralkyl group, a substituted or non-substituted aryl group, cyano group, nitro group, alkoxy group, —$COOR_7$, wherein $R_7$ represents hydrogen atom, a substituted or non-substituted alkyl group, a substituted or non-substituted aralkyl group, and a substituted or non-substituted aryl group, a halogenized carbonyl group or $CONR_8R_9$ ($R_8$ and $R_9$ independently represent one of hydrogen atom, a halogen atom, a substituted or non-substituted alkyl group, a substituted or non-substituted aralkyl group and a substituted or non-substituted aryl group, $Ar_1$ and $Ar_2$ independently represent a substituted or non-substituted arylene group, $Ar_3$ and $Ar_4$ independently represent a substituted or non-substituted aryl group, X represents one of a substituted or non-substituted alkylene group, a substituted or non-substituted cycloalkylene group, a substituted or non-substituted alkylene ether group, oxygen atom, sulfur atom, and vinylene group, k represents 0 or 1, Z represents a substituted or non-substituted alkylene group, a substituted or non-substituted bivalent alkylene ether group, and a bivalent alkyleneoxy carbonyl group, and m and n represent an integer of from 0 to 3.

Specific examples of the substitution groups in the compounds represented by the Chemical structures (1) or (2) are as follows: the alkyl group of $R_1$ is, for example, methyl group, ethyl group, propyl group, and butyl group. The aryl group thereof is, for example, phenyl group and naphthyl group. The aralkyl group thereof is, for example, benzyl group, phenethyl group, naphthyl methyl group. The alkoxy group thereof is, for example, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group and an aralkyl group such as benzyl group and phenethyl group. Among these substitution groups, hydrogen atom and methyl group are preferred.

$Ar_3$ and $Ar_4$ represent a substituted or non-substituted aryl group. Specific examples thereof include condensed polycyclic hydrocarbon groups, non-condensed ring hydrocarbon groups and heterocyclic groups.

Specific examples of the condensed polycyclic hydrocarbon groups include a group in which the number of carbons forming a ring is not greater than 18, for example, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluoranthenyl group, acephenantrirenyl group, aceantrirenyl group, triphenylene group, pyrenyl group, chrysenyl group, and naphthacenyl group.

Specific examples of the non-condensed ring hydrocarbon groups include a single-valent group of monocyclic hydrocarbon compounds, for example, benzene, diphenyl ether, polyethylene diphenyl ether, diphenylthio ether and phenylsulfone, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include a single-valent group, for example, carbazole, dibenzofuran, dibenzothiophene, oxadiazole, and thiadiazole.

The substituted or non-substituted aryl groups represented by $Ar_3$ and $Ar_4$ can have a substitution group. Specific examples thereof are as follows:

(1) a halogen atom, cyano group, and nitro group;

(2) an alkyl group, preferably a straight chained or side chained alkyl group having 1 to 12, more preferably 1 to 8 and furthermore preferably from 1 to 4 carbons. These alkyl groups can have a fluorine atom, a hydroxyl group, an alkoxy group having 1 to 4 carbons, a phenyl group or a phenyl group substituted by a halogen atom, an alkyl group having 1 to 4 carbon atoms or an alkoxy group having 1 to 4 carbon atoms. Specific examples thereof include methyl group, ethyl group, n-butyl group, 1-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) an alkoxy group (—$OR_2$), wherein $R_2$ is the alkyl group represented in (2). Specific examples thereof include methoxy group, ethoxy group, n-propoxy group, i-propoxy group, t-butoxy group, n-butoxy group, s-butoxy group, i-butoxy group, 2-hydroxy ethoxy group, benzyl oxy group and trifluoromethoxy group;

(4) an aryloxy group. As an aryl group, phenyl group, and naphthyl group are included. These can contain an alkoxy group having 1 to 4 carbon atoms, an alkyl group having a 1 to 4 carbon atoms or a halogen atom as a substitution group. Specific examples include phenoxy group, 1-naphthyloxy group, 2-naphthyloxy group, 4-methoxyphenoxy group, and 4-methylphenoxy group;

(5) an alkyl mercapto group or an aryl mercapto group. Specific examples thereof include methylthio group, ethylthio group, phenylthio group, and p-methylphenylthio group;

(6) Substitution group represented by —$NR_3R_4$:$R_3$ and $R_4$ independently represent a hydrogen atom, the alkyl group defined in (2), or an aryl group. Specific examples of the aryl groups include phenyl group, biphenyl group, or naphthyl group. These can contain an alkoxy group having 1 to 4 carbon atoms, an alkyl group having 1 to 4 carbon atoms or a halogen atom as a substitution group. $R_3$ and $R_4$ can share a linkage to form a ring.

Specific examples thereof include amino group, diethyl amino group, N-methyl-N-phenyl amino group, N,N-diphenyl amino group, N,N-di(tril) amino group, dibenzyl amino group, piperidino group, morpholino group, and pyrrolidino group;

(7) an alkylene dioxy group or an alkylene dithio such as methylene dioxy group and methylene dithio group; and (8) a substituted or non-substituted styryl group, a substituted or non-substituted β-phenyl styryl group, diphenyl aminophenyl group, ditolyl aminophenyl group, etc.

The arylene group represented by $Ar_1$ and $Ar_2$ are divalent groups derived from the aryl group represented by $Ar_3$ and $Ar_4$.

Specific examples of the alkylene group represented by X include a straight chained or branch chained alkylene group having 1 to 12 carbon atoms, preferably 1 to 8 carbon atoms and more preferably from 1 to 4 carbon atoms. These alkylene groups can further have fluoro group, hydroxyl group, cyano group, an alkoky group having 1 to 4 carbon atoms, phenyl group or a phenyl group substituted by a halogen group, an alkyl group having 1 to 4 carbon atoms or an alkoxy group having 1 to 4 carbon atoms. Specific examples thereof include methylene group, ethylene group, n-butylene group, isopropylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylphenyl ethylene group, and 4-biphenyl ethylene group.

Specific examples of the cycloalkylene groups represented by X include cyclic alkylene group having 5 to 7 carbon atoms. These cyclic alkylene groups can have fluorine atom, hydroxyl group, an alkyl group having 1 to 4 carbon atoms, and an alkoxy group having 1 to 4 carbon atoms. Specific examples thereof include cyclohexylidene group, cyclohexylene group, and 3,3-dimethyl cyclohexylidene group.

Specific examples of the oxyalkylene group represented by X include oxyalkylene groups, for example, ethyleneoxy group and propyleneoxy group, alkylenedioxy groups derived from ethylene glycol, propylene glycol, etc., and di(oxyalkylene)oxy groups or poly(oxyalkylene) groups derived from diethylene glycol, tetraethylene glycol, tripropylene glycol, etc. Alkylene groups of the oxyalkylene groups can have hydroxyl group, methyl group, ethyl group, etc.

The vinylene groups represented by X are, for example, substitution groups represented by the following chemical structure.

[Chemical structures 4]

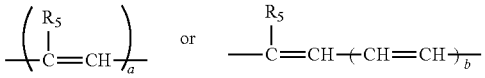

wherein, $R_5$ represents hydrogen atom or an alkyl group (same as the alkyl groups defined in (2) mentioned above) and aryl group (same as the aryl groups represented by $Ar_3$ and $Ar_4$ mentioned above), a represents 1 or 2 and b is an integer of from 1 to 3.

The alkylene group and oxyalkylene group represented by Z are, for example, the same as those represented by X. Specific examples of the functional groups represented by Z formed by combining an oxyalkylene group and carbonyl group include a caprolactone modified group.

In the present invention, the radical polymeric monomer having a functional group with a charge transport structure is more preferably the compound represented by the following chemical structure (3).

obtained by copolymerizing with a radical polymeric monomer having at least 3 functional groups without a charge transport structure. There are two kinds of cross linking chains. One is referred to as inter-molecule cross-linking in which the cross linking chain is formed between a polymer and another polymer. The other is referred to as internal cross linking in which the cross linking chain is formed between a portion and another portion in the main chain present in a polymer in a folded state. Whether a radical polymeric compound having at least 3 functional groups with a charge transport structure is present in a main chain or in a cross-linking chain, the triaryl amine structure suspending from the chain portion has at least three aryl groups disposed in the radial directions from the nitrogen atom therein. Such a triaryl amine structure is bulky and does not directly bind with the chain portion but suspends from the chain portion via carbonyl group, etc. That is, the triaryl amine structure is stereoscopically fixed in a flexible state. Therefore, these triaryl amine structures can be adjacent to each other with a moderate space in a cured resin. Therefore, the structural distortion in a molecule is slight. In addition, when the structure is used in the cross linking charge transport layer of an image bearing member, it can be deduced that the internal molecular structure can have a structure in which there are relatively few disconnections in the charge transport route.

[Chemical structure 3]

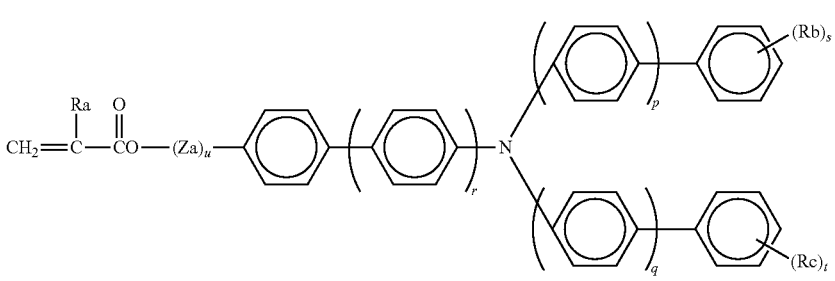

r, p and g independently represent 0 or 1, Ra represents hydrogen atom or methyl group, Rb and Rc represent a hydrogen atom or an alkyl group having 1 to 6 carbon atoms, s and t independently represent an integer of from 1 to 3, each of Rb and Rc can be different when s and t are 2 or 3, Za represents methylene group, ethylene group, —$CH_2CH_2O$—, —$CHCH_3CH_2O$—, or —$C_6H_5CH_2CH_2$—, and u represents 0 or 1.

Among the compounds represented by Chemical structure (3), the compounds in which each of Rb and Rc is independently a methyl group or an ethyl group are preferred.

The radical polymeric monomer for use in the present invention having a functional group with a charge transport structure represented by the chemical structures (1), (2) and especially (3) is present in the main chain and also a cross linking chain between the main chains in a cured resin

[Chemical Structures 5]

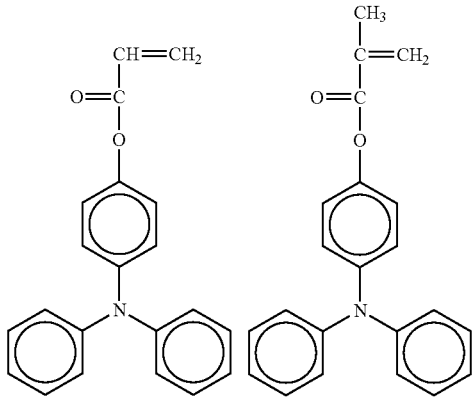

No. 1 No. 2

-continued
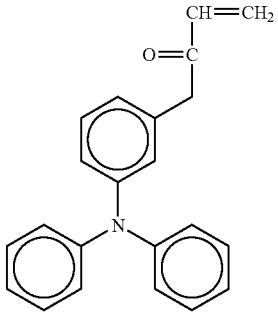
No. 3
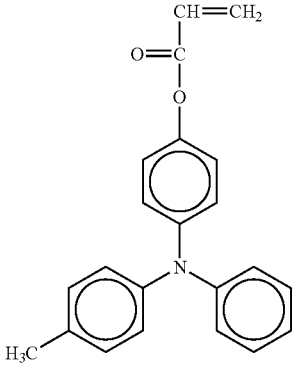
No. 4
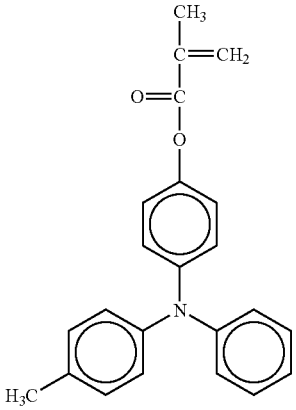
No. 5
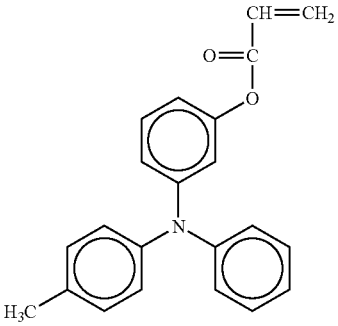
No. 6
-continued
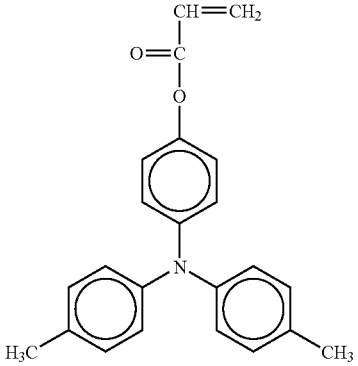
No. 7
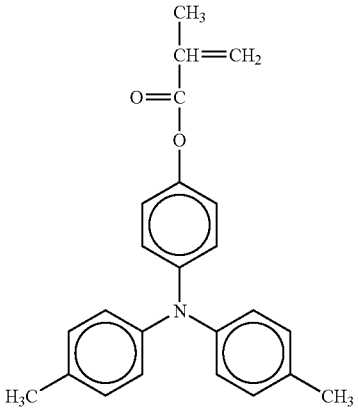
No. 8
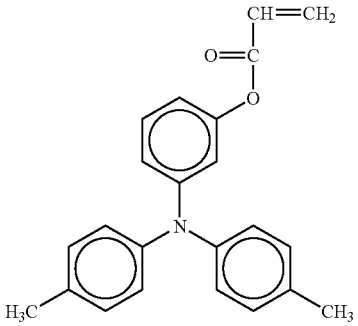
No. 9
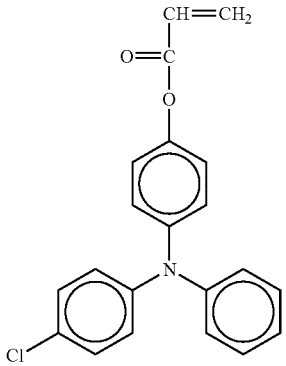
No. 10

-continued
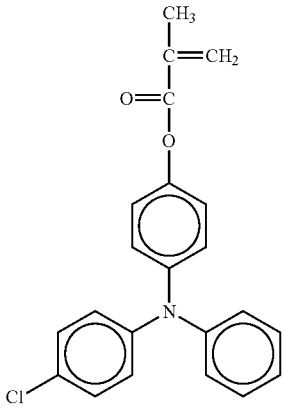
No. 11
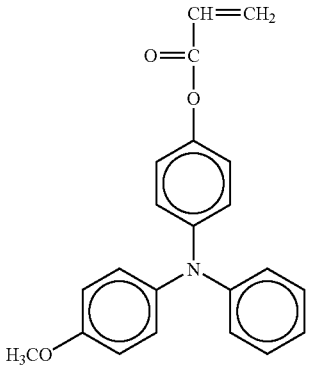
No. 12
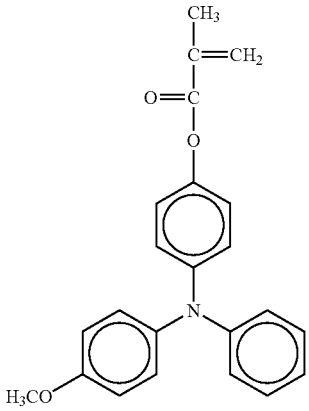
No. 13
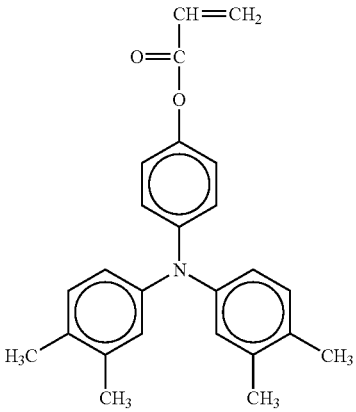
No. 14
-continued
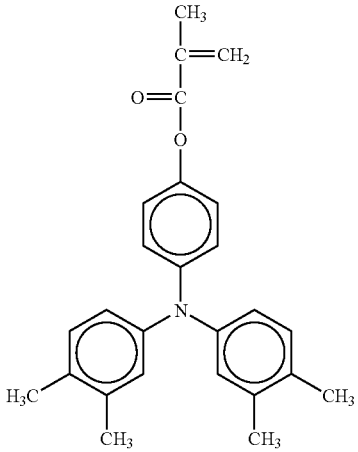
No. 15
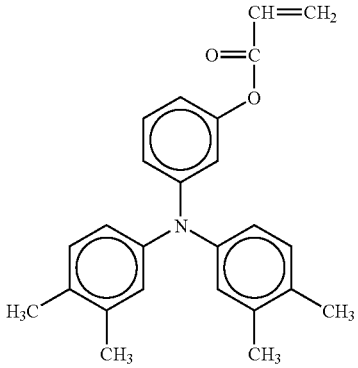
No. 16
[Chemical Structures 6]
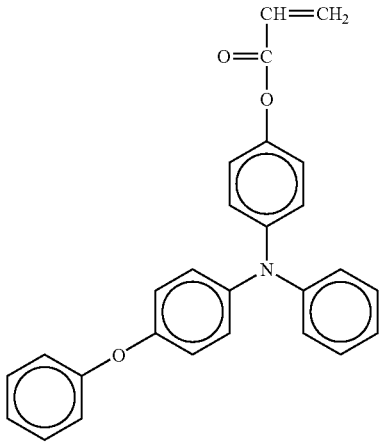
No. 17

-continued
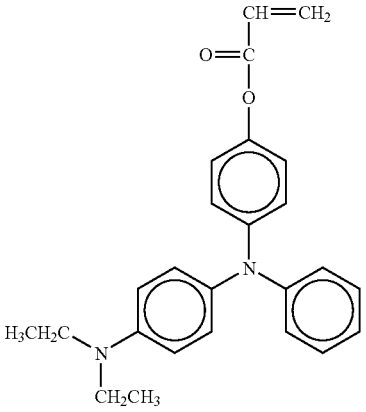
No. 18
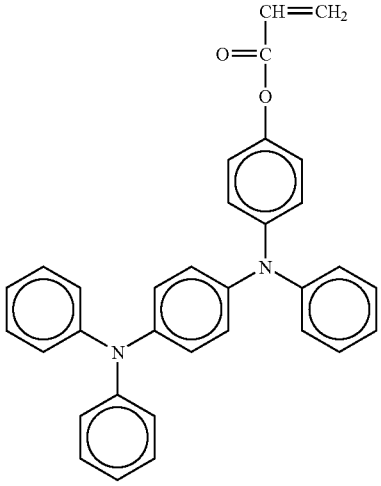
No. 19
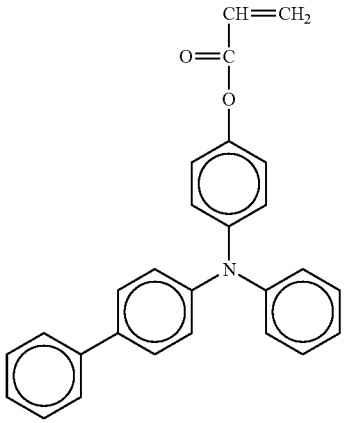
No. 20
-continued
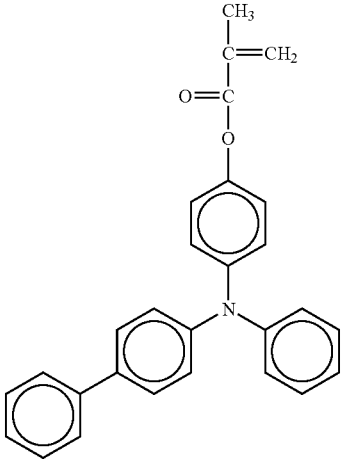
No. 21
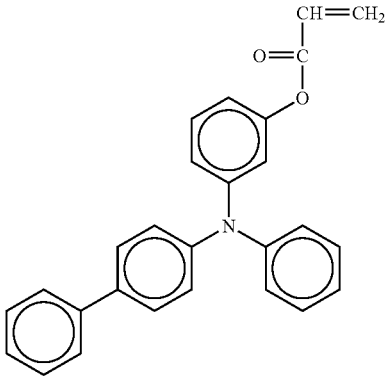
No. 22
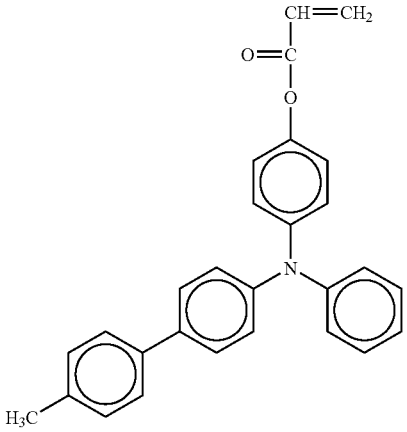
No. 23

-continued
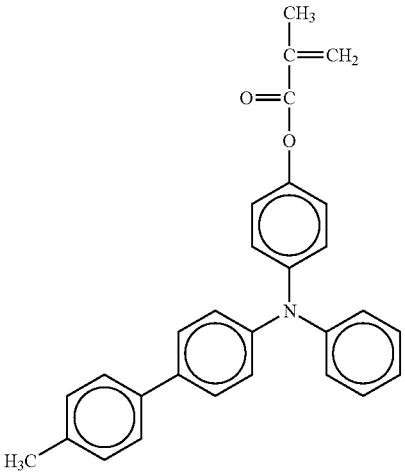
No. 24
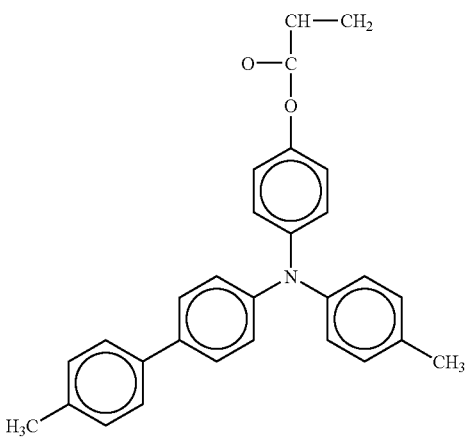
No. 25
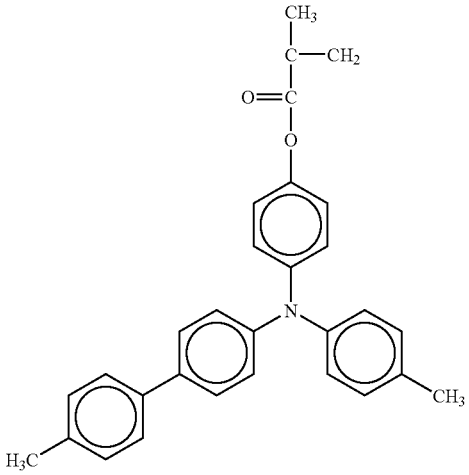
No. 26
-continued
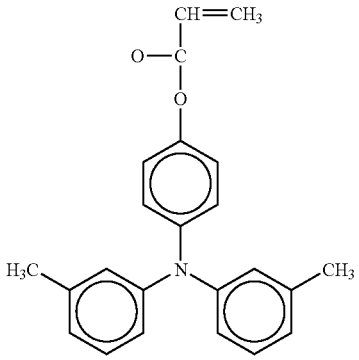
No. 27
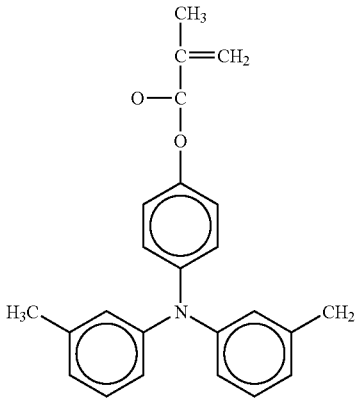
No. 28
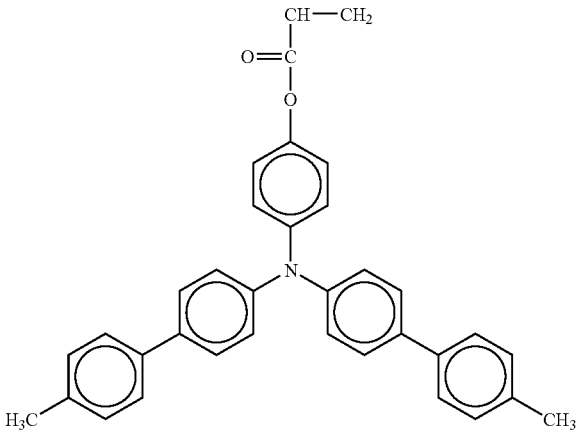
No. 29

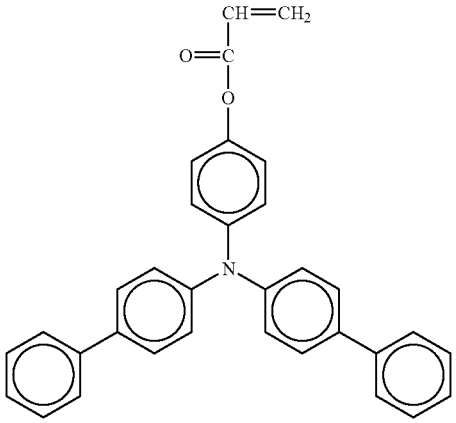
No. 30
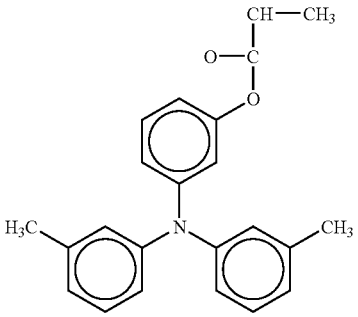
No. 31
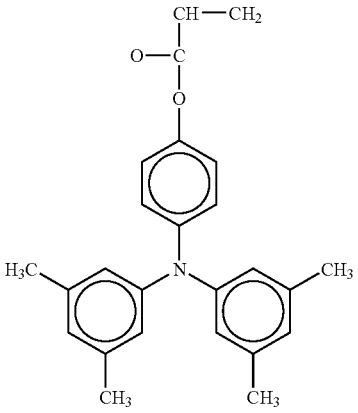
No. 32
[Chemical Structures 7]
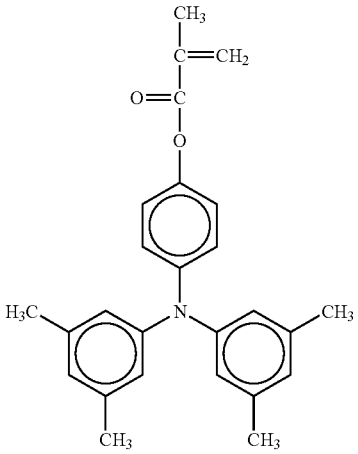
No. 33
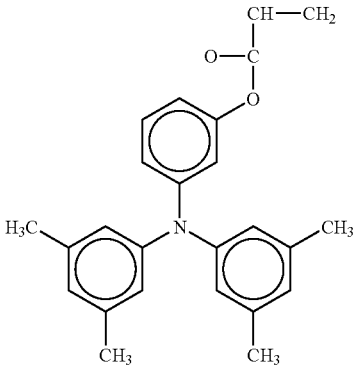
No. 34
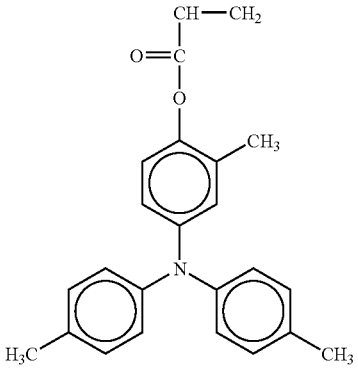
No. 35

-continued
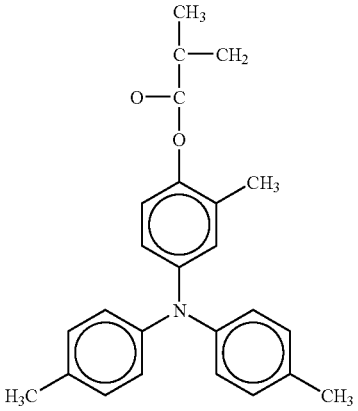
No. 36
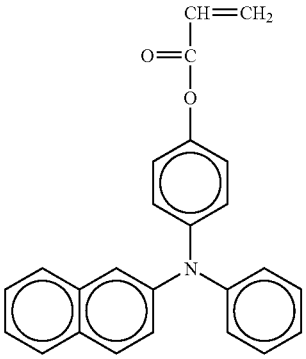
No. 37
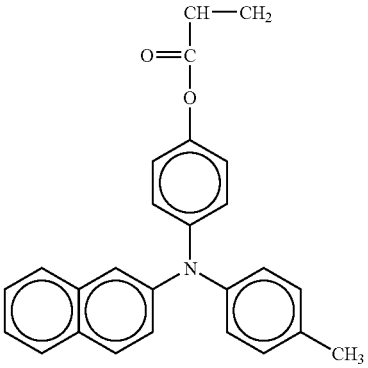
No. 38
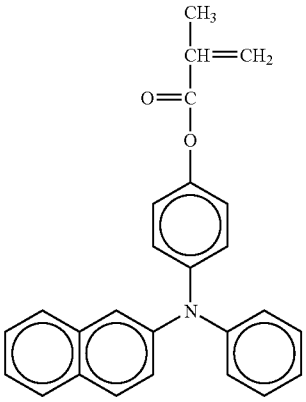
No. 39
-continued
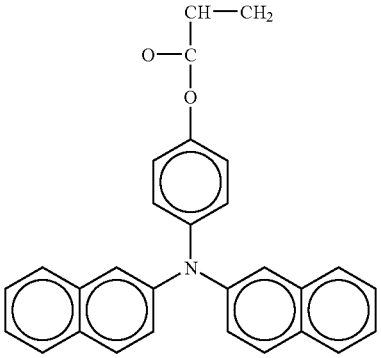
No. 40
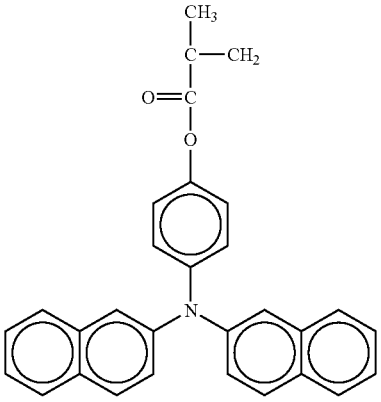
No. 41
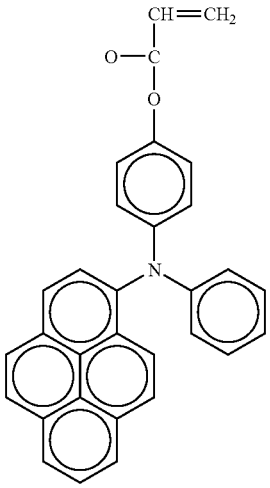
No. 42

-continued
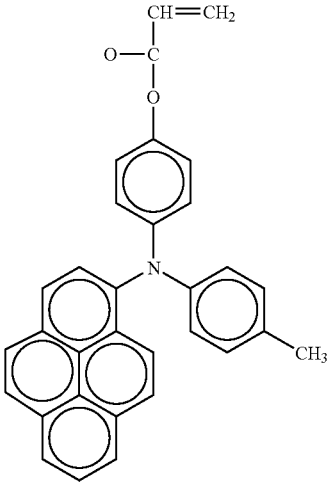
No. 43
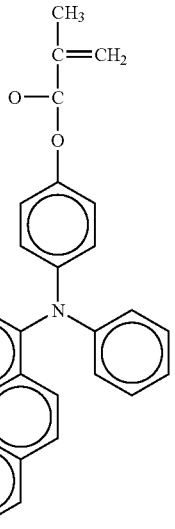
No. 44
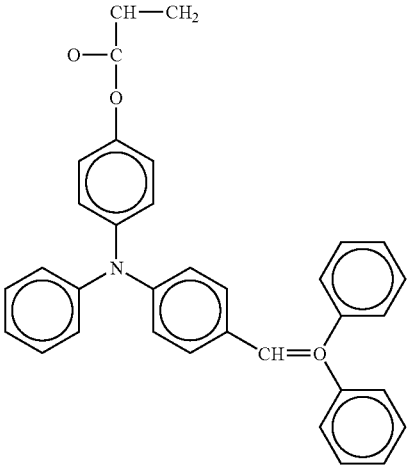
No. 45
-continued
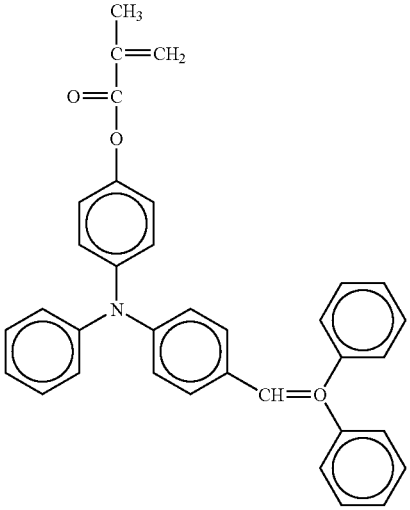
No. 46
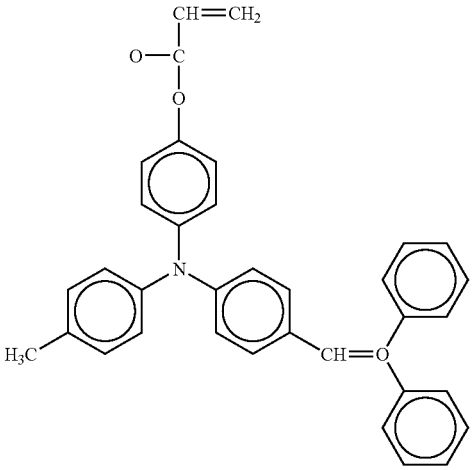
No. 47
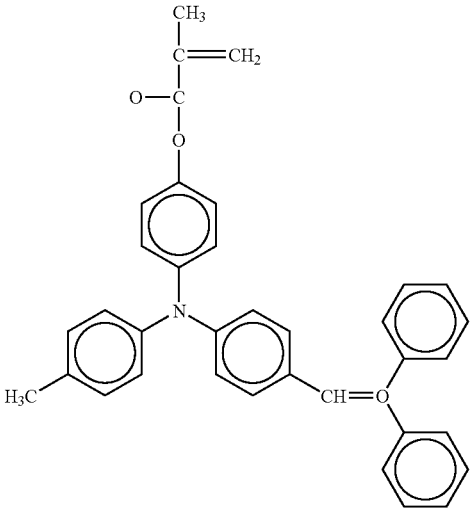
No. 48

-continued
[Chemical Structures 8]
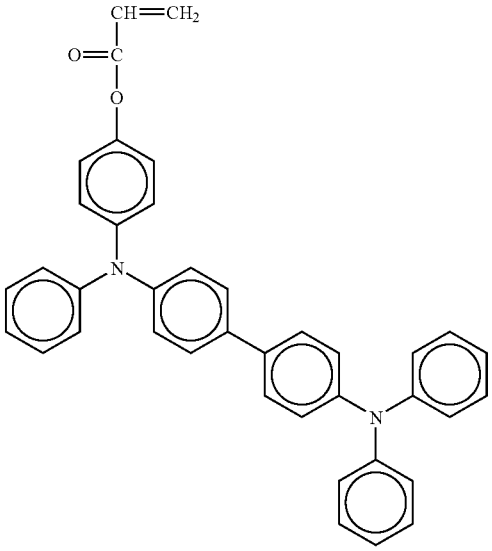
No. 49
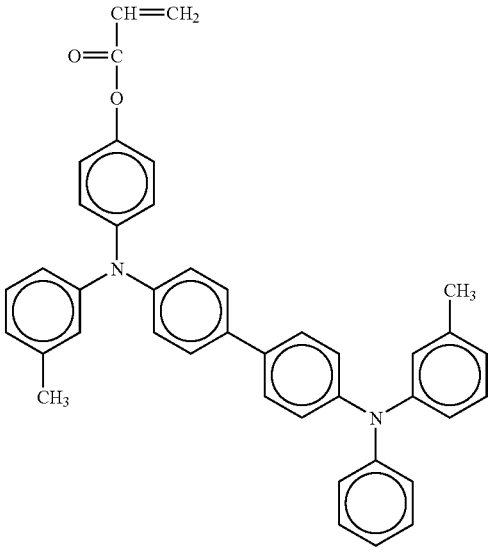
No. 50
-continued
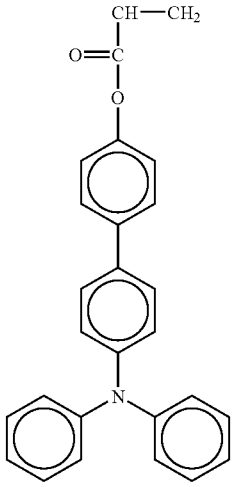
No. 51
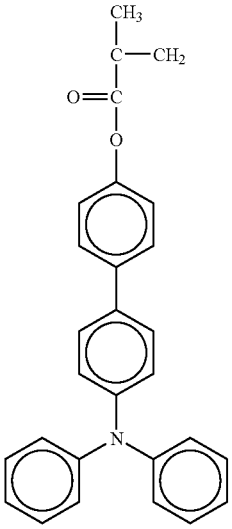
No. 52
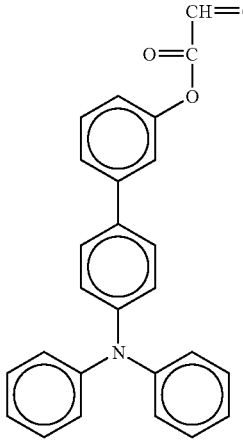
No. 53
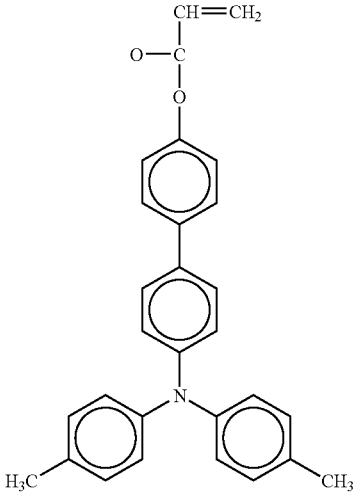
No. 54

-continued
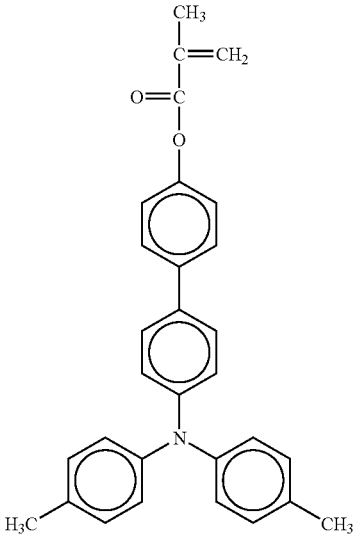
No. 55
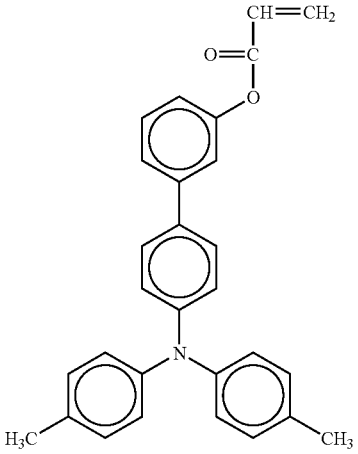
No. 56
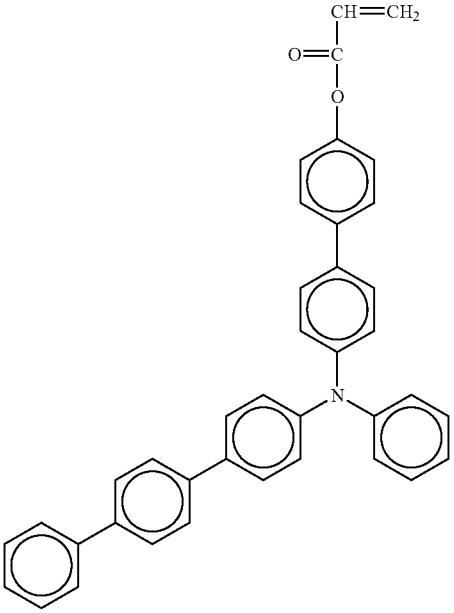
No. 57
-continued
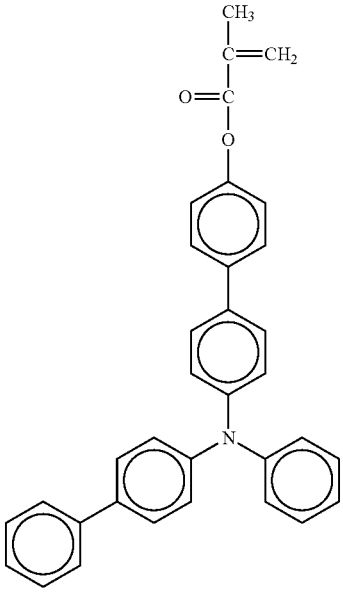
No. 58
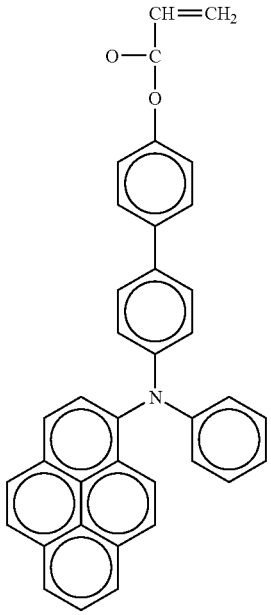
No. 59

-continued
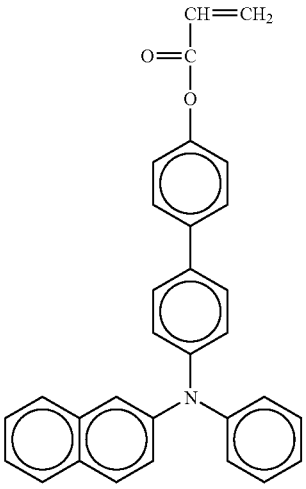
No. 60
-continued
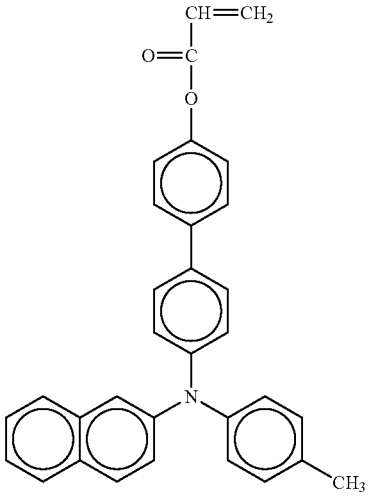
No. 63
[Chemical Structures 9]
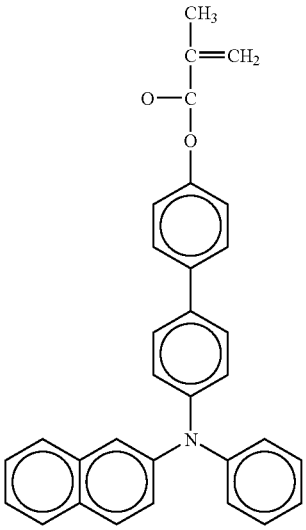
No. 61
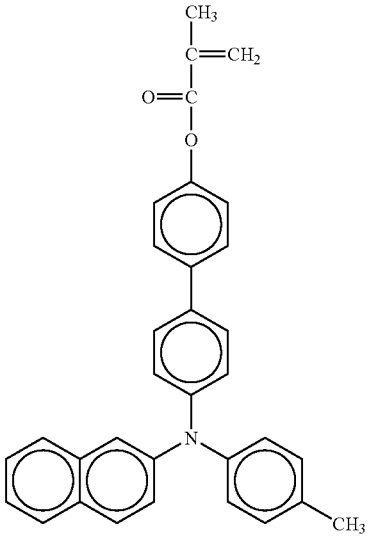
No. 64
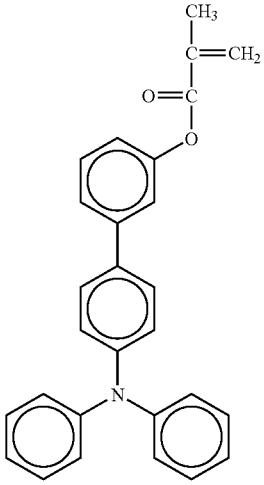
No. 62
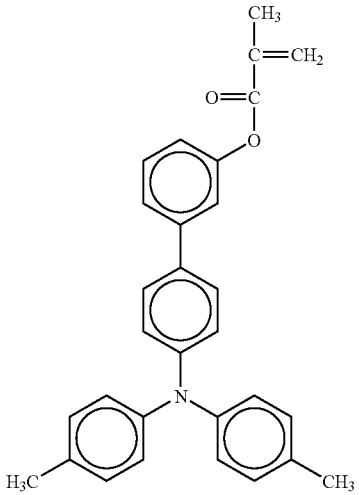
No. 65

-continued
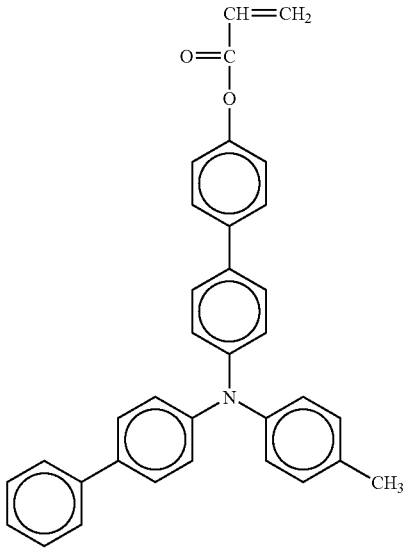
No. 66
-continued
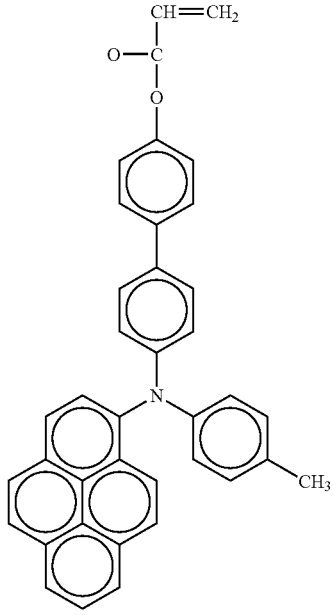
No. 68
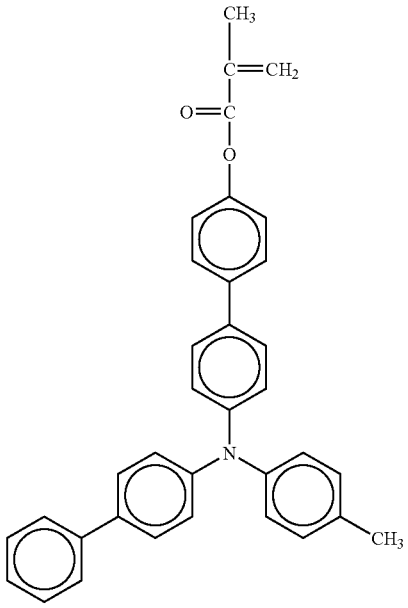
No. 67
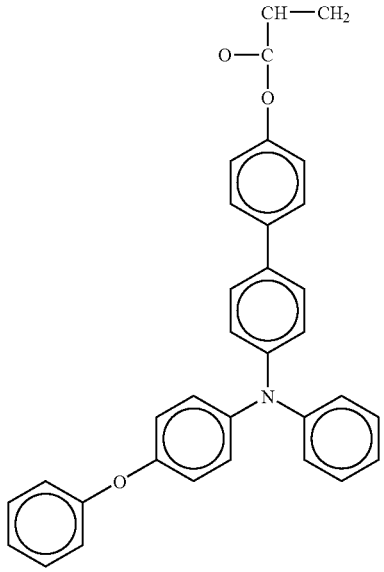
No. 69

-continued
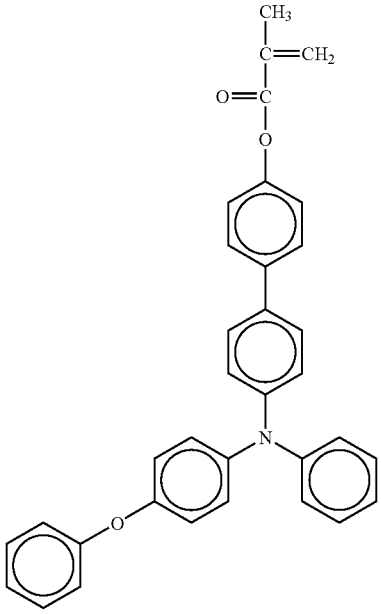
No. 70
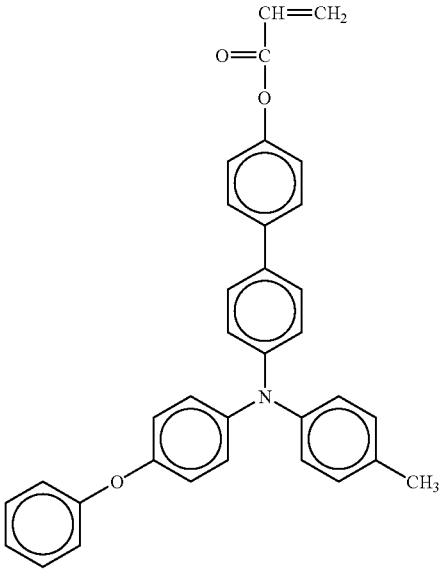
No. 71
-continued
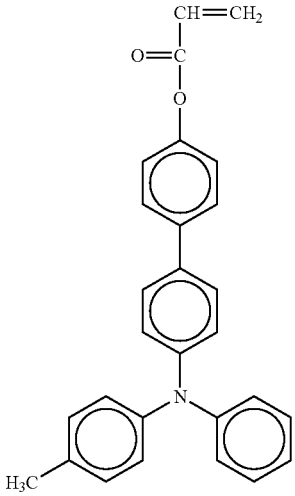
No. 72
[Chemical Structures 10]
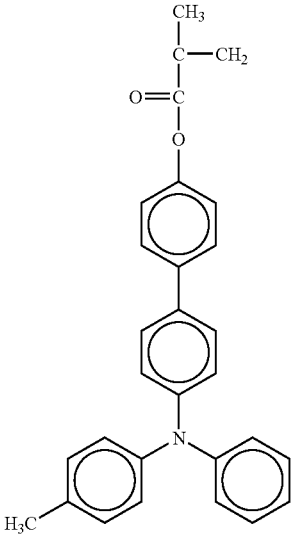
No. 73
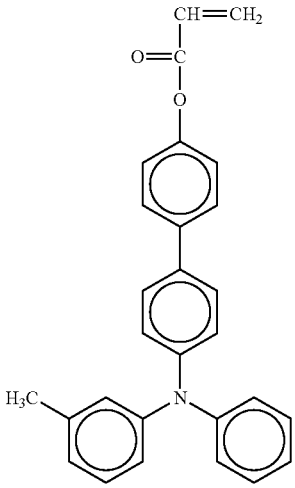
No. 74

-continued
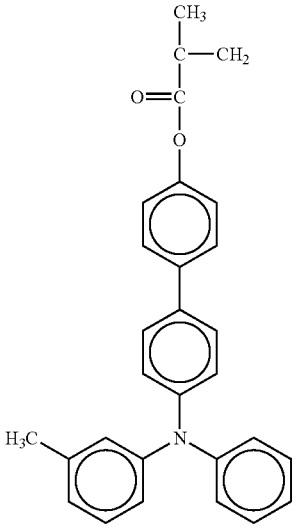
No. 75
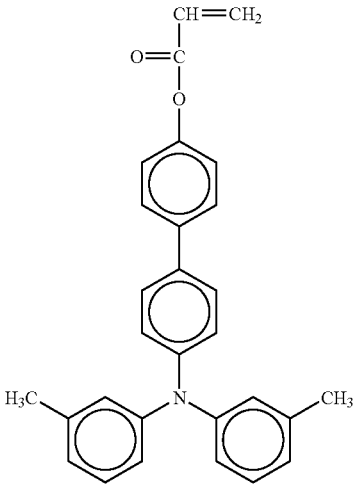
No. 76
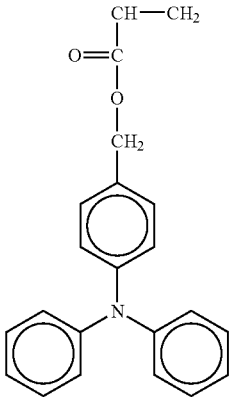
No. 77
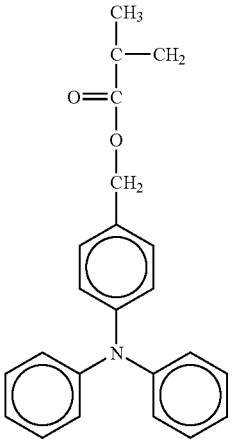
No. 78
-continued
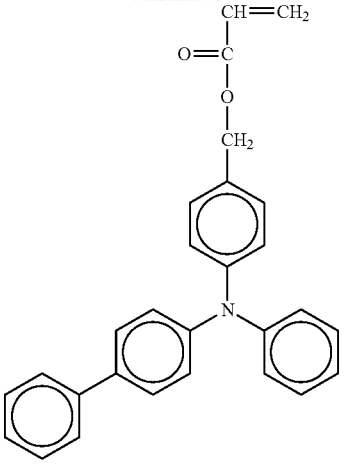
No. 79
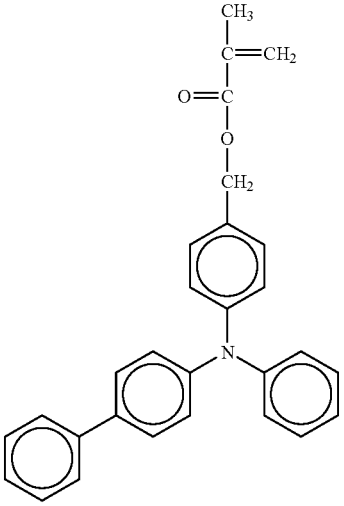
No. 80
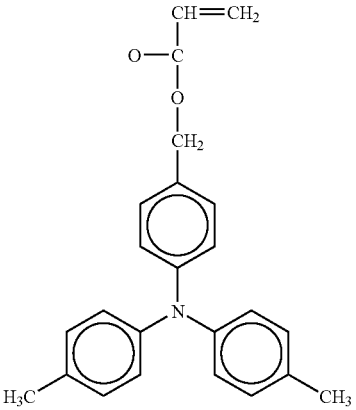
No. 81

-continued
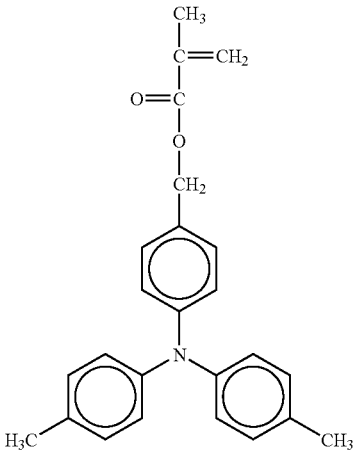
No. 82
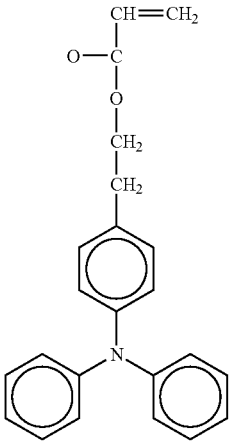
No. 83
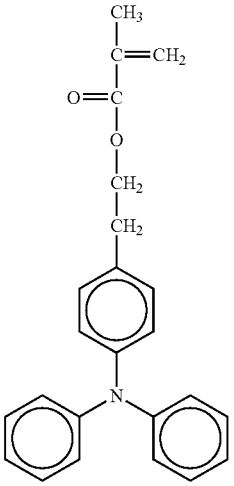
No. 84
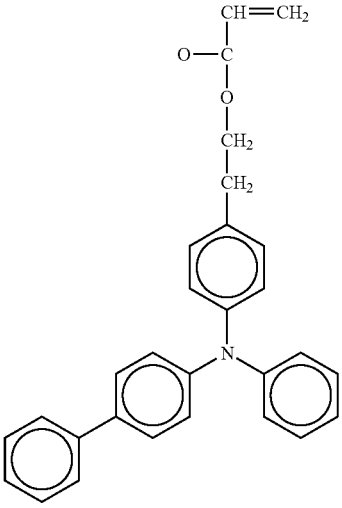
No. 85
-continued
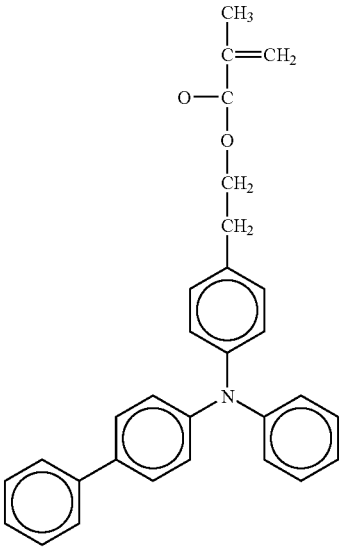
No. 86
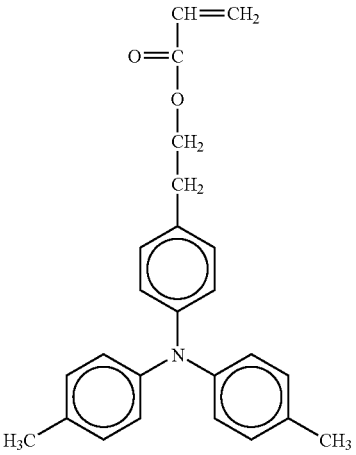
No. 87
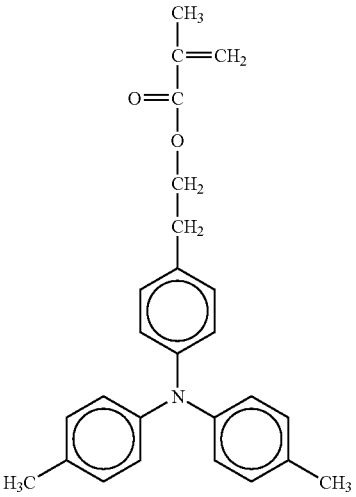
No. 88

-continued
[Chemical Structures 11]
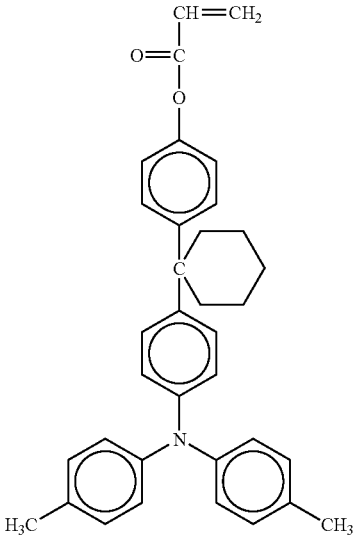
No. 89
-continued
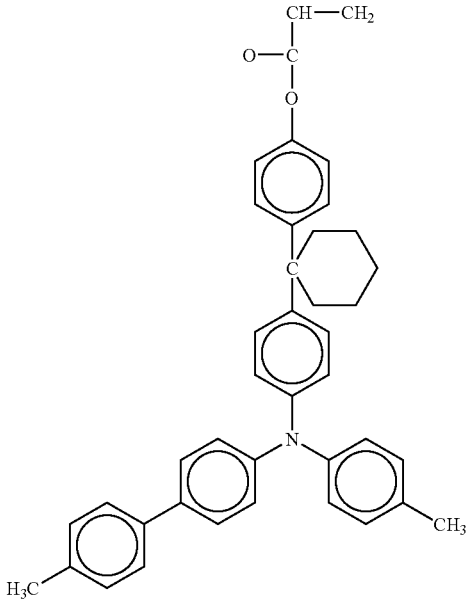
No. 91
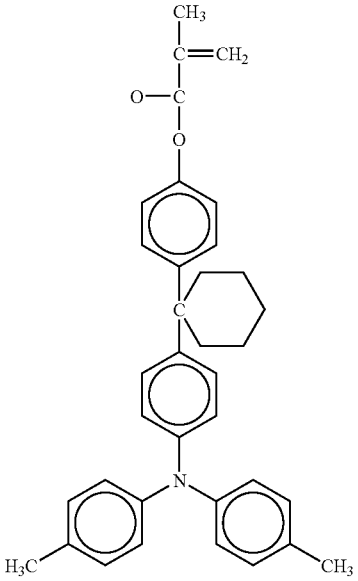
No. 90
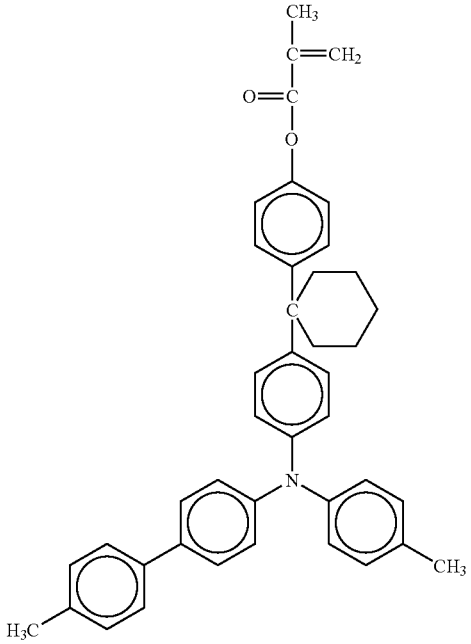
No. 92

-continued
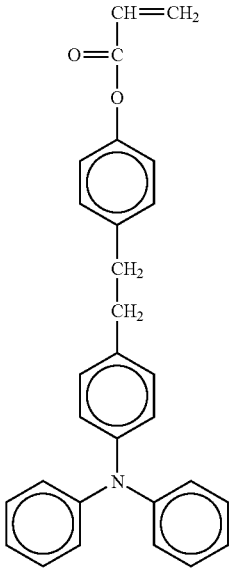
No. 93
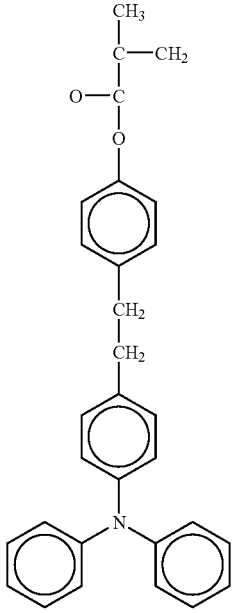
No. 94
-continued
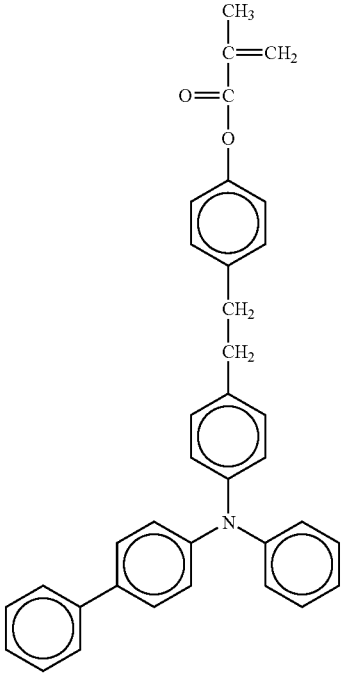
No. 96
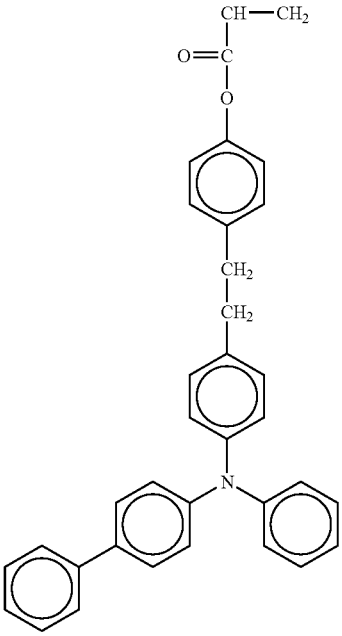
No. 95
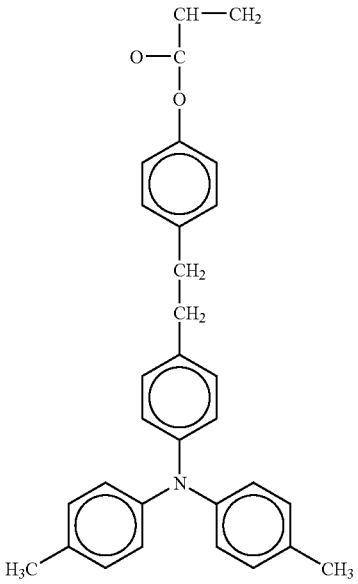
No. 97

-continued
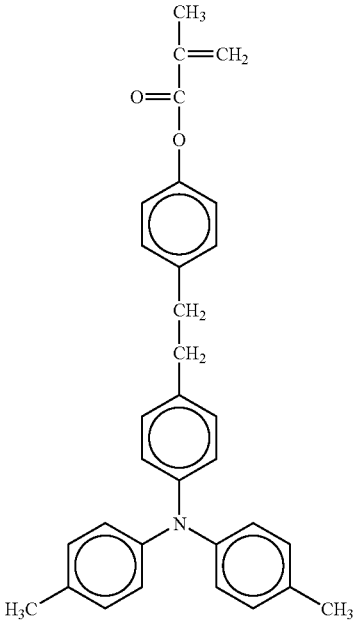
No. 98
-continued
[Chemical Structures 12]
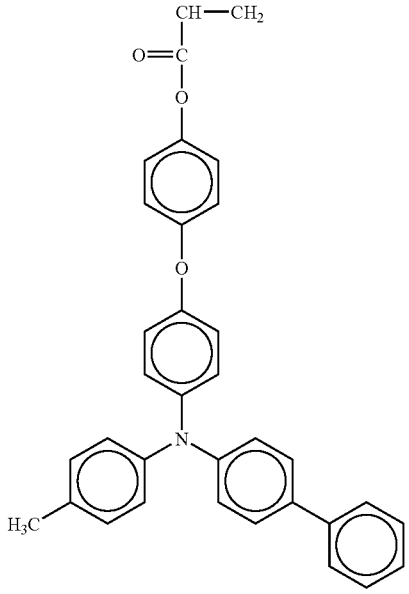
No. 101
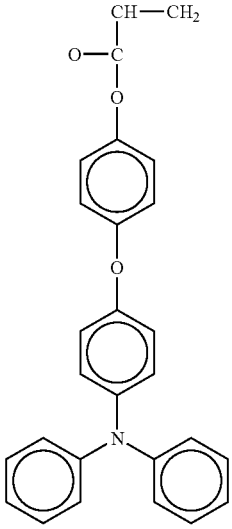
No. 99
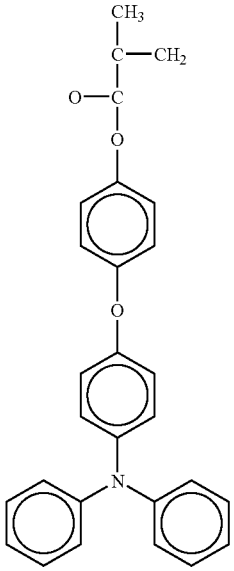
No. 100
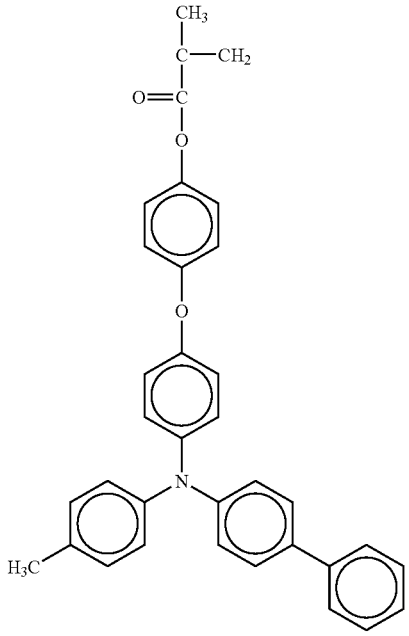
No. 102

-continued
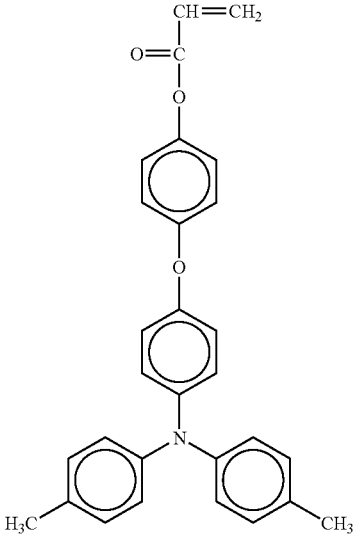
No. 103
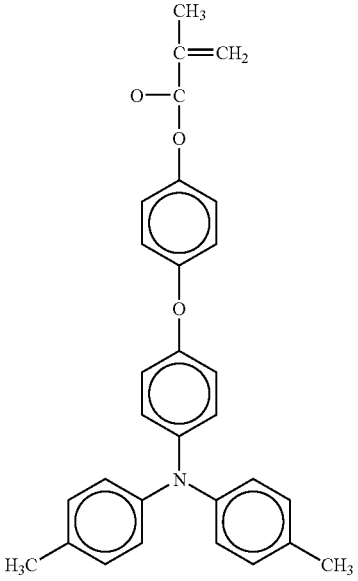
No. 104
-continued
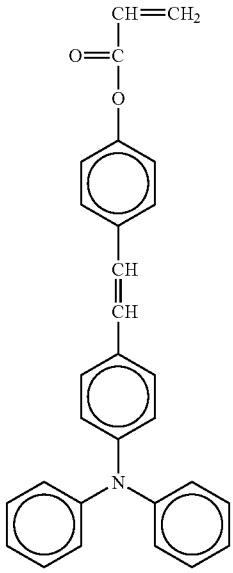
No. 105
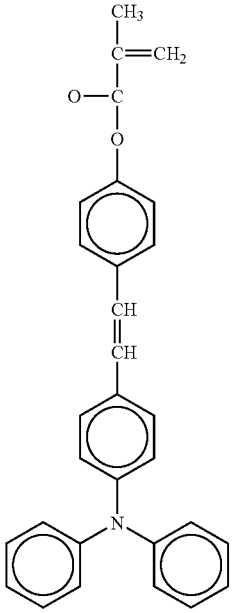
No. 106
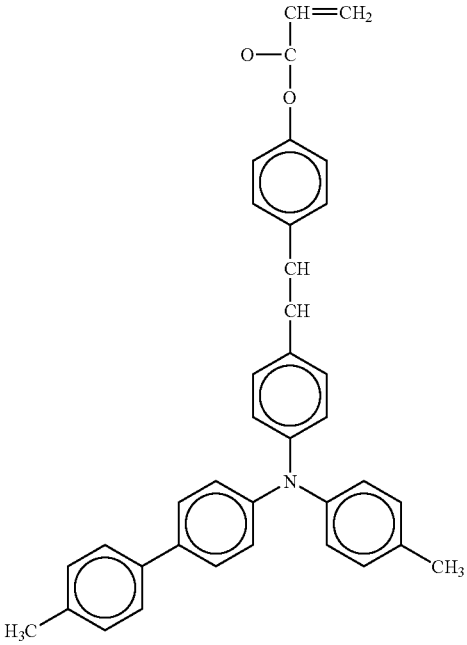
No. 107

-continued
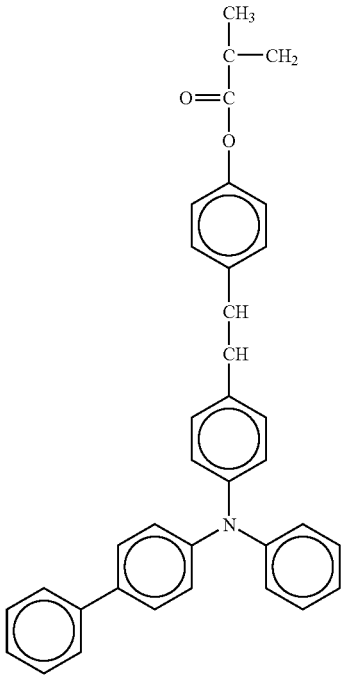
No. 108
-continued
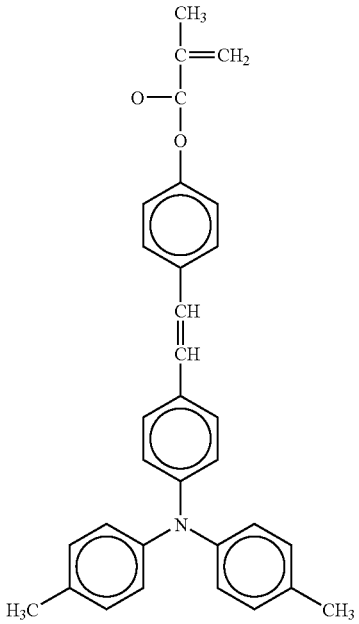
No. 110
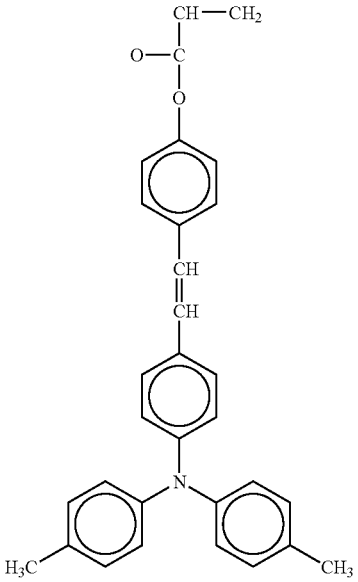
No. 109
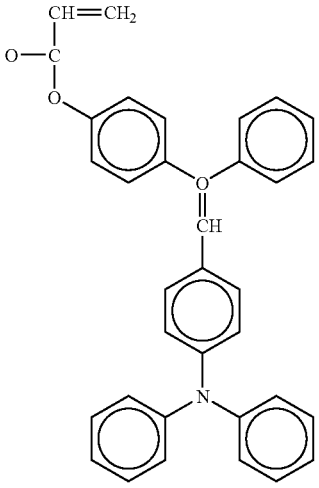
No. 111

-continued
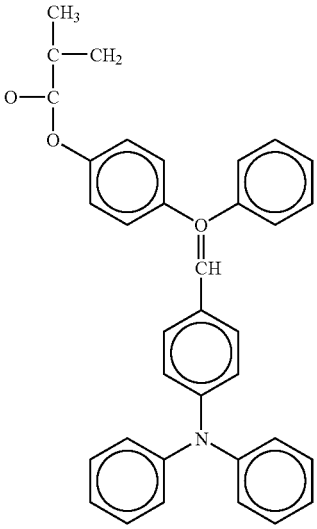
No. 112
[Chemical Structures 13]
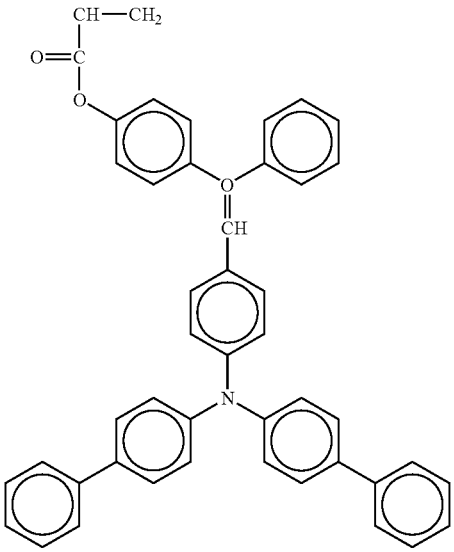
No. 113
-continued
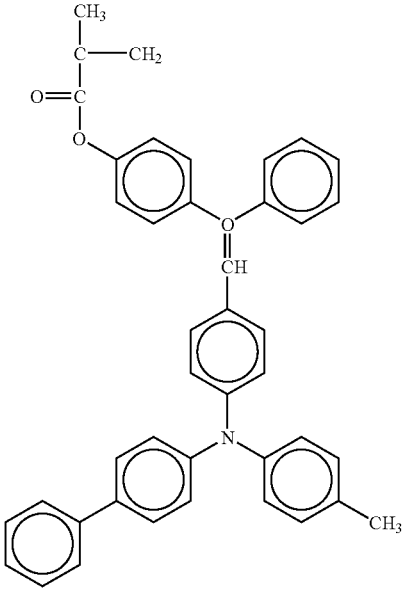
No. 114
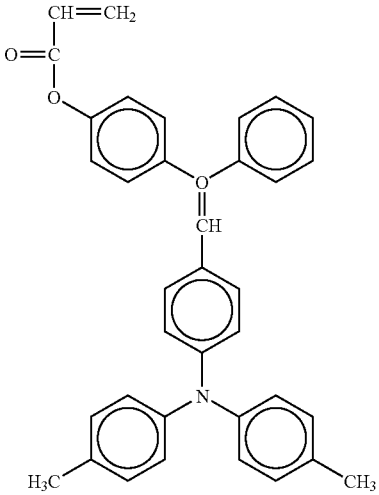
No. 115
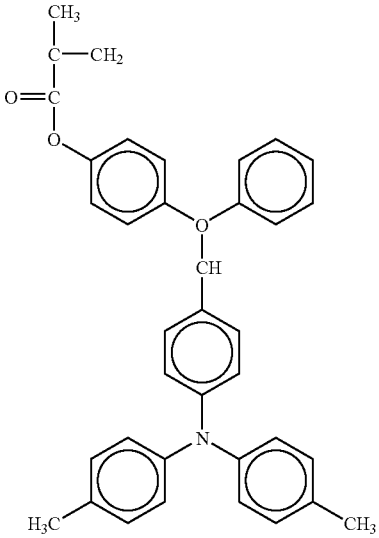
No. 116

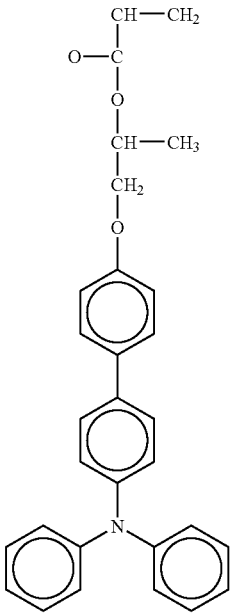
No. 117
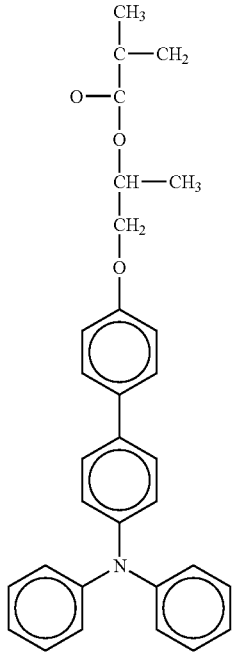
No. 118
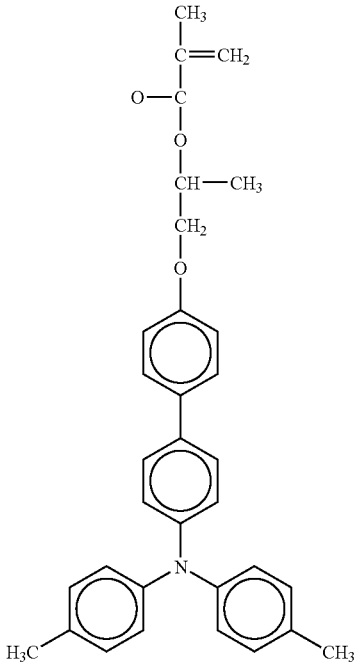
No. 120
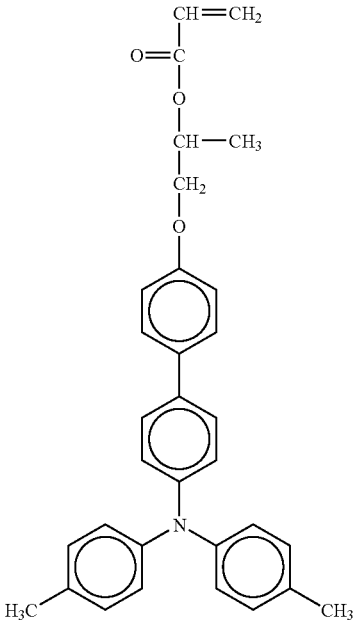
No. 119
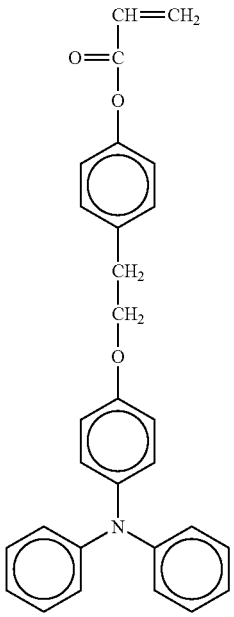
No. 121
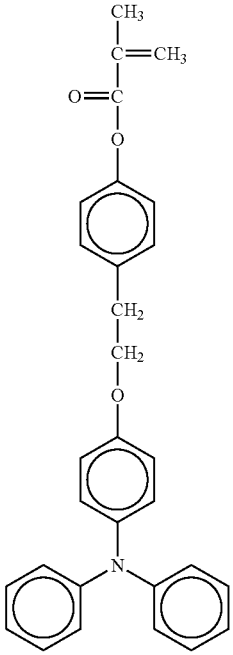
No. 122

-continued
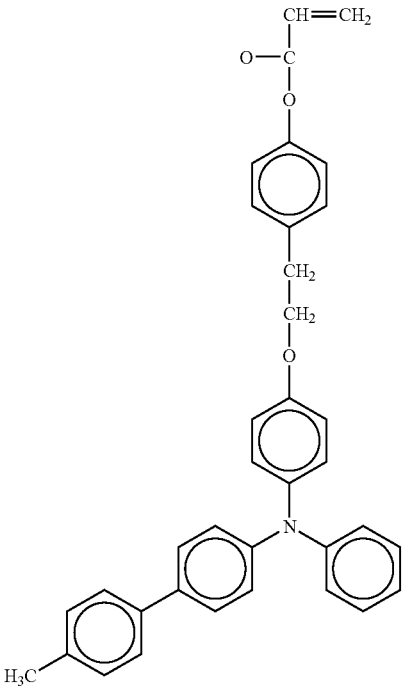
No. 123
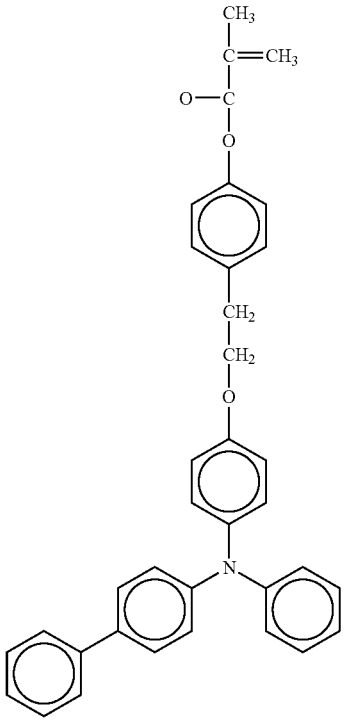
No. 124
-continued
[Chemical Structures 14]
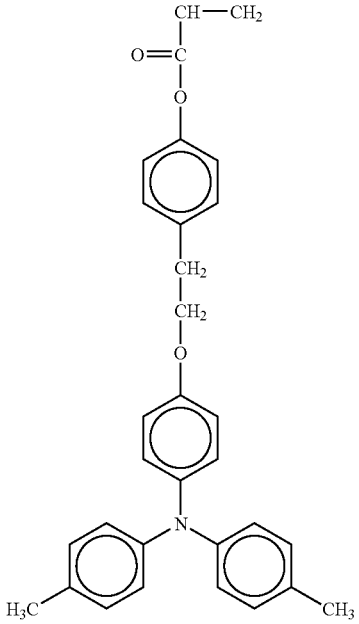
No. 125
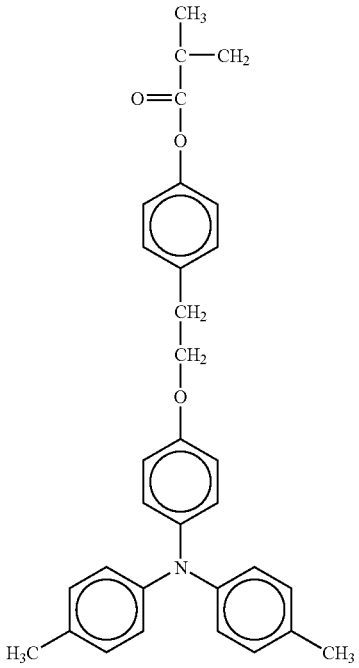
No. 126

-continued
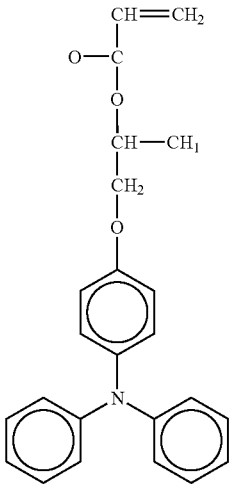
No. 127
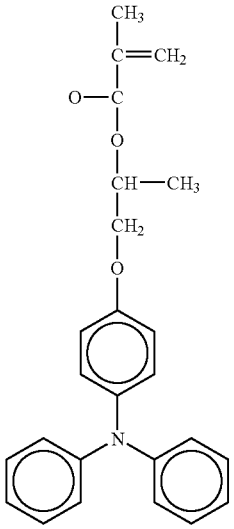
No. 128
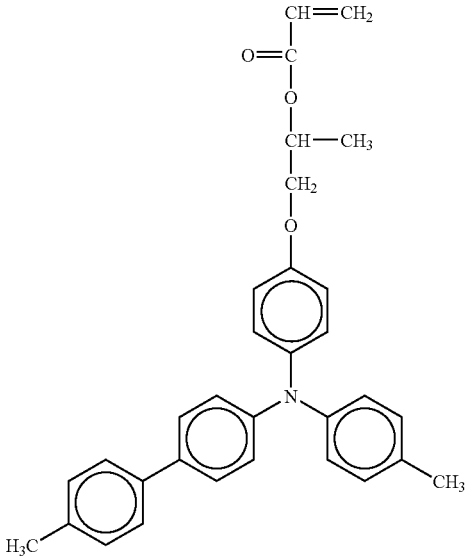
No. 129
-continued
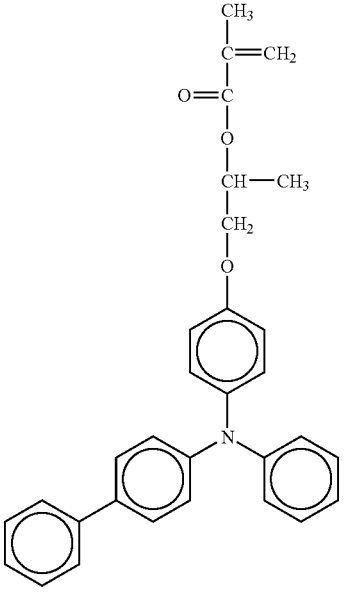
No. 130
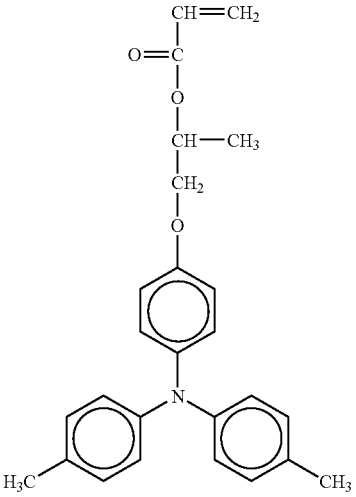
No. 131
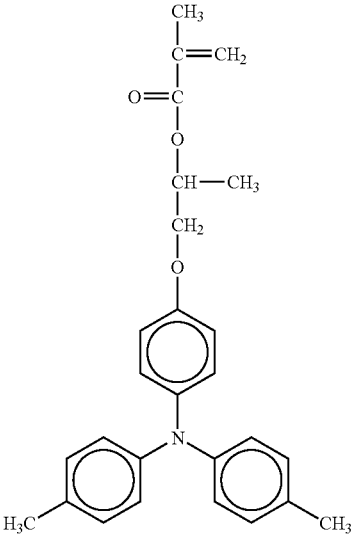
No. 132

-continued
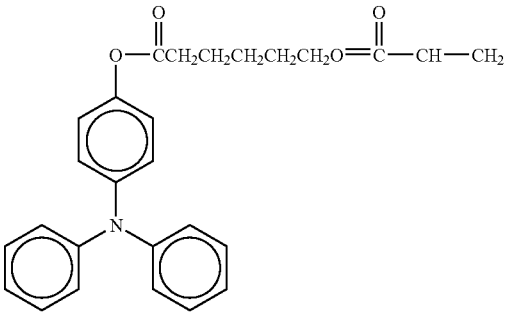
No. 133
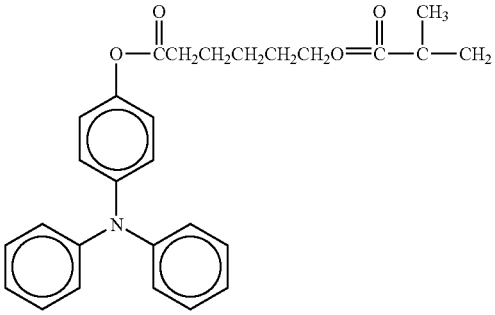
No. 134
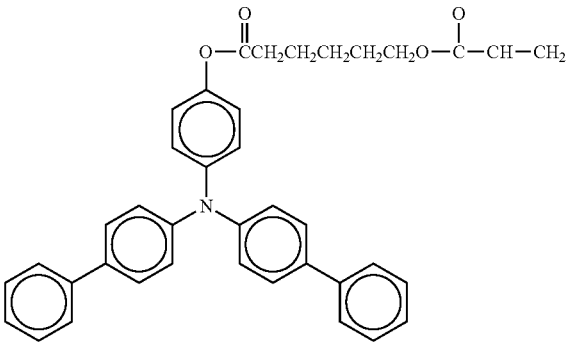
No. 135
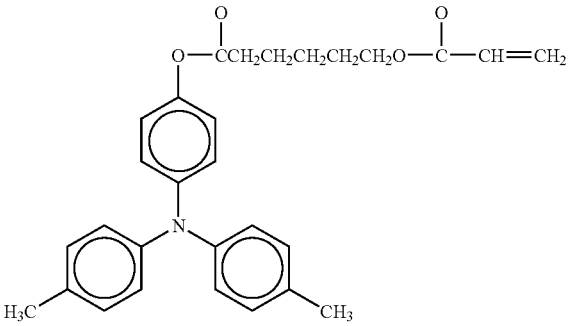
No. 136
-continued
[Chemical Structures 15]
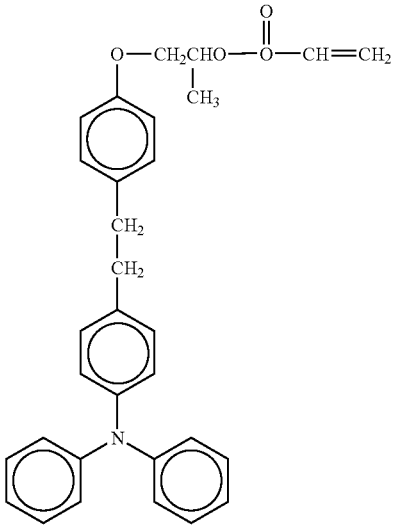
No. 137
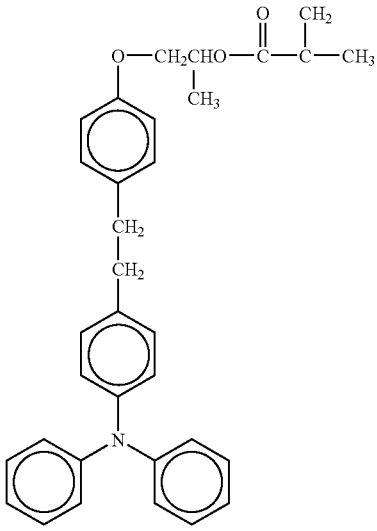
No. 138

-continued
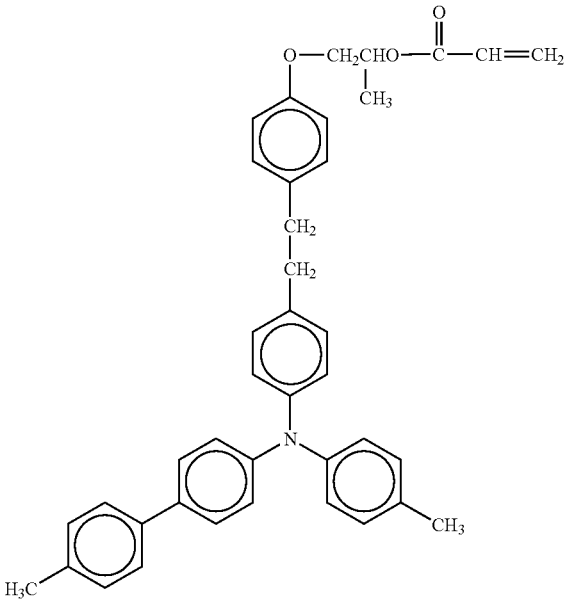
No. 139
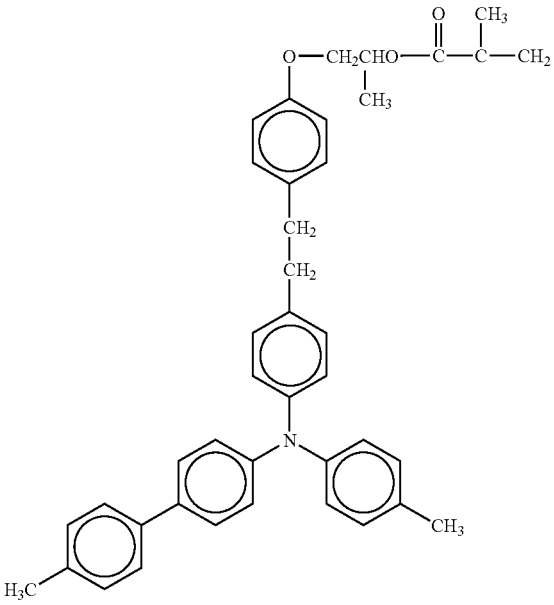
No. 140
-continued
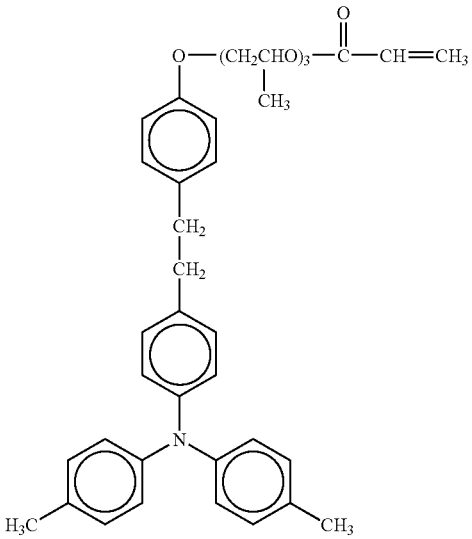
No. 141
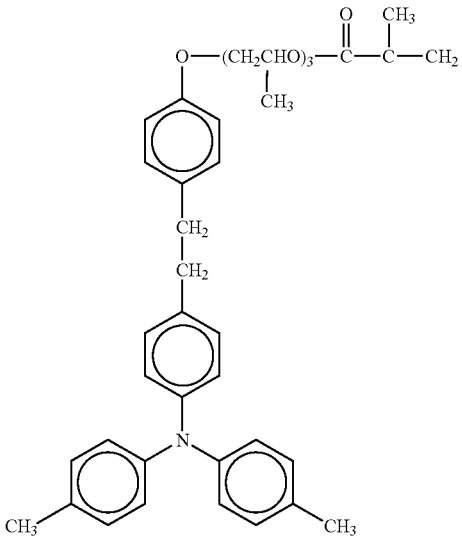
No. 142
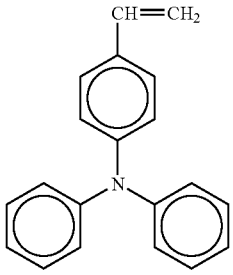
No. 143

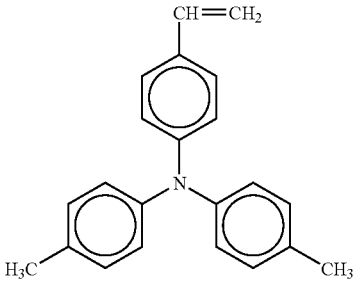
No. 144
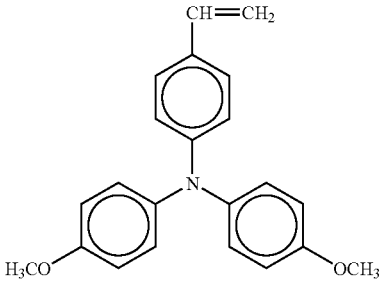
No. 145
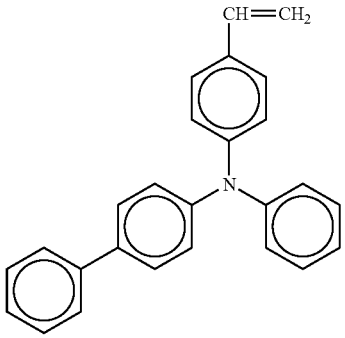
No. 146
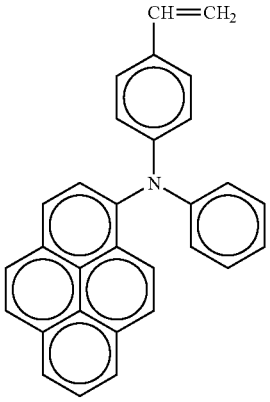
No. 147
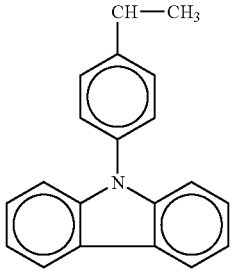
No. 148
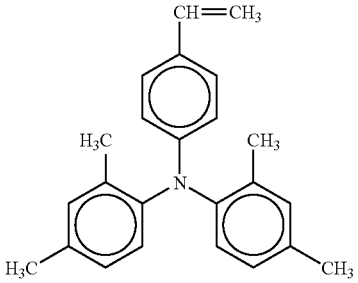
No. 149
[Chemical Structures 16]
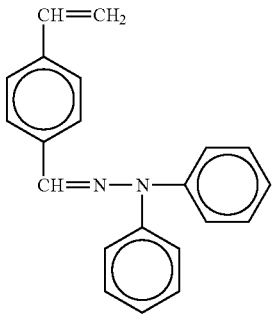
No. 150
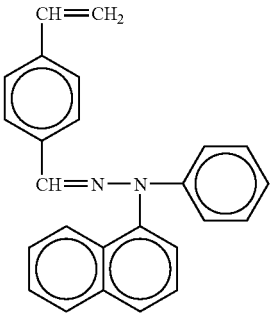
No. 151
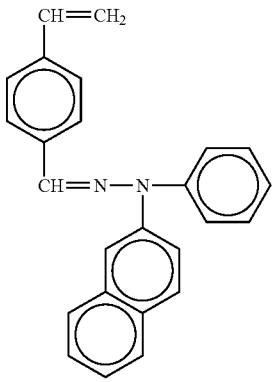
No. 152
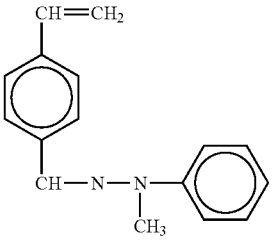
No. 153

-continued

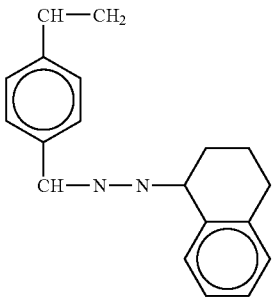

No. 154

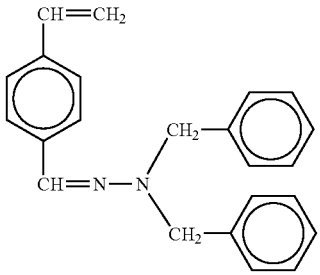

No. 155

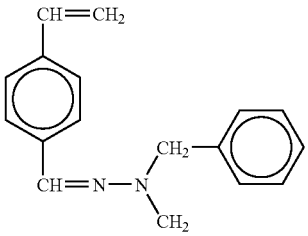

No. 156

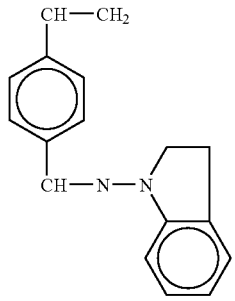

No. 157

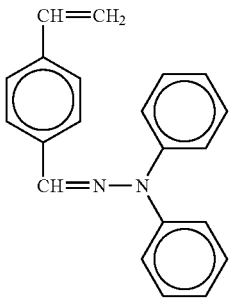

No. 158

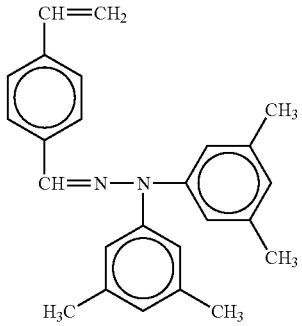

No. 159

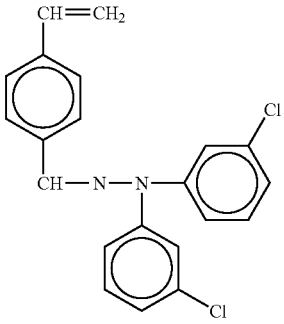

No. 160

Below are specific examples of the radical polymeric monomer for use in the present invention having a functional group with a charge transport structure. But the radical polymeric monomers are not limited thereto.

The radical polymeric monomer for use in the present invention having a functional group with a charge transport structure imparts a charge transport function to a cross linking charge transport layer. The content of the cross linking charge transport layer is from 20 to 80% by weight, and preferably from 30 to 70% by weight. When the content is too small, the charge transport function of a cross linking charge transport layer is not maintained, which may lead to the deterioration of the electric characteristics, for example, the decrease in the sensitivity and the rise in the residual voltage, during repetitive use. When the content is too large, the content of the radical polymeric monomer having at least three functional groups without a charge transport structure decreases. That is, the cross linking density decreases, resulting in the shortage of anti-abrasion property. Desired electric characteristics and anti-abrasion property vary depending on the process. Therefore, it is difficult to jump to any conclusion but considering the balance of both characteristics and property, the addition amount is preferably from 30 to 70% by weight.

In the present invention, the cross linking charge transport layer is preferably formed by curing at least a radical polymeric monomer having at least three functional groups which does not have a charge transport structure, a radical polymeric compound having one functional group which has a charge transport structure and a radical polymeric compound (hereinafter referred to as the reactive silicone compound) having a dimethylsiloxane structure as a repeated unit.

Specific examples of the reactive silicone compound include vinyl monomer, acrylic esters, and methacrylic esters, for example, acryloyl polydimethyl siloxane ethyl, methacryloyl polydimethyl siloxane ethyl, acryloyl polydimethyl siloxane propyl, acryloyl polydimethyl siloxane butyl, diacryloyl polydimethyl siloxane diethyl, which have 20 to 70 siloxane repeated units and are set forth in published examined Japanese patent applications Nos. H05-60503 and H06-45770.

The reactive silicone compounds can be prepared by a method of conducting a condensation reaction of an ester of acrylic acid (or a methacrylic acid) and alkylene glycol and a trimethyl silyl compound or a polydimethyl siloxane compound, or a method of conducting an addition polymerization reaction of an ester of acrylic acid (or a methacrylic acid) and arylalcohol and a trimethyl silyl compound or a polydimethyl siloxane compound. It is also possible to use market products. Specific examples thereof are as follows but not limited thereto:

X-22-164A (molecular weight: 860), X-22-164B (molecular weight: 1630), X-22-164C (molecular weight: 2370), X-22-174DX (molecular weight: 4600), X-24-8201 (molecular weight: 2100), X-22-2426 (molecular weight: 12,000), all of which are manufactured by Shin-Etsu Chemical Co., Ltd., bi-terminal type SILAPLANE FM-7711 (molecular weight: 1,000), bi-terminal type SILAPLANE FM-7721 (molecular weight: 5,000), bi-terminal type SILAPLANE FM-7725 (molecular weight: 10,000), mono-terminal type SILAPLANE FM-0711 (molecular weight: 1,000), mono-terminal type SILAPLANE FM-0721 (molecular weight: 5,000), mono-terminal type SILAPLANE FM-0725 (molecular weight: 10,000), mono-terminal type SILAPLANE TM-0701 (molecular weight: 423), and mono-terminal type SILAPLANE TM-0701T (molecular weight: 423), all of which are manufactured by Chisso Corporation, BYK-UV3500, BYK-UV3510, and BYK-UV-3570, all of which are manufactured by Byk Chemie Japan, TEGO RAD 2100, TEGO RAD 2200N, TEGO RAD 2250, TEGO RAD 2500, TEGO RAD 2600, and TEGO RAD 2700, all of which are manufactured by Tego Chemie Service.

These reactive silicone compounds can be used alone or in combination. The addition amount of the reactive silicone compound is from 0.01 to 30% by weight and more preferably from 0.05 to 20% by weight. An addition amount of the reactive silicone compound that is too small may not reduce the surface energy, which leads to bad cleaning performance. When the addition amount thereof is too large, the amount of the non-reacted components which have not cured increases, which causes problems such that the electric characteristics vary during repeated electrophotographic process. This may cause the decrease in the image density and the narrowed characters. Desired electric characteristics and anti-abrasion property vary depending on the process, it is difficult to jump to any conclusion but considering the balance of both characteristics and property, the addition amount is preferably from 0.05 to 20% by weight.

In the present invention, the cross linking charge transport layer is formed by curing at least a radical polymeric monomer having at least three functional groups which does not have a charge transport structure and a radical polymeric compound having one functional group which has a charge transport structure. In addition to this, a radical polymeric monomer having one or two functional groups which does not have a charge transport structure, a functional monomer which does not have a charge transport structure and a radical polymeric oligomer which does not have a charge transport structure can be used to adjust the viscosity upon coating, relax the stress, decrease the surface energy, reduce the friction index, etc.

Specific examples of the radical polymeric monomer having one functional group which does not have a charge transport structure include 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxytetraethylene glycol acrylate, cetyl acrylate, isostearyl acrylate, stearyl acrylate, and styrene.

Specific examples of the radical polymeric monomer having two functional groups which does not have a charge transport structure include 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopentyl glycol diacrylate, bisphenol A EO modified diacrylate, bisphenol F EO modified diacrylate and neopentyl glycol diacrylate.

Specific examples of the functional monomer which does not have a charge transport structure include monomers in which a fluoro group of, for example, octafluoro pentyl acrylate, 2-perfluorooctylethyl acrylate, 2-perfluorooctylethyl methacrylate and 2-perfluoroisononylethyl acrylate is substituted.

Specific examples of the radical polymeric oligomer which does not have a charge transport structure include epoxyacrylate based, urethane acrylate based, and polyester acrylate based oligomers.

When a radical polymeric monomer having one or two functional groups which does not have a charge transport structure and a radical polymeric oligomer which does not have a charge transport structure are contained in a large amount, the cross linking density of the cross linking charge transport layer substantially decreases, which invites the deterioration of the anti-abrasion property. Therefore, the content of these monomers and oligomers is not greater than 50 parts by weight and preferably not greater than 30 parts by weight based on 100 parts by weight of a radical polymeric monomer having at least three functional groups which does not have a charge transport structure.

In the present invention, when a cross linking charge transport layer is formed, a polymerization initiator can be added, if desired, to effectively conduct the curing reaction.

Specific examples of the thermal polymerization initiator include peroxide-based initiators, for example, 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3,di-t-butyl peroxide, t-butylhydroperoxide, cumene hydroperoxide and lauroyl peroxide, and azo based initiators, for example, azobis isobutylnitrile, azobiscyclohexane carbonitrile, azobis methyl isobutyric acid, azobis isobutyl amidine hydrochloride salts, and 4,4'-azobis-4-cyano valeric acid.

Specific examples of photo polymerization initiators include acetophenone based or ketal based photo polymerization initiators, for example, diethoxy acetophenone, 2,2-dimethoxy-1,2-diphenylethane-1-one, 1-hydroxy cyclohexyl phenylketone, 2-benzyl-2-dimethylamino-1-(4-morpholinophenyl)butanone-1,2-hydroxy-2-methyl-1-phenyl propane-1-one, 2-methyl-2-morpholino(4-methylthiophenyl) propane-1-one, and 1-phenyl-1,2-propane dione-2-(o-ethoxycarbonyl)oxime; benzoin ether based photo polymerization initiators, for example, benzoin, benzoin methyl ether, benzoin ethyl ether, benzoin isobutyl ether and benzoin isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triazine based compounds, and imidazole based compounds. In addition, compounds having photo polymerization promotion effect can be used alone or in combination with the photo polymerization initiators. Specific examples thereof include triethanol amine, methyldiethanol amine, 4-dimethylamino ethyl benzoate, 4-dimethylamino isoamyl benzoate, benzoic acid (2-dimethylamino)ethyl, and 4,4'-dimethylamino benzophenone.

These polymerization initiators can be used alone or in combination. The addition amount of the polymerization initiator is from 0.5 to 40 parts by weight and preferably from 1 to 20 parts by weight based on 100 parts by weight of the total weight of the radical polymeric compound.

Furthermore, a liquid of application for a cross linking charge transport layer can contain additives, for example, various kinds of a plasticizing agent (to relax stress and improve adhesibility), a leveling agent, and a low molecular weight charge transport material which is not radical polymeric, if desired. Known additives can be used.

Specific examples of the plasticizing agent include compounds, for example, dibutyl phthalate and dioctyl phthalate, which are used for typical resins. The addition amount of the plasticizing agent is not greater than 20% by weight and more preferably not greater than 10% by weight based on all the solid portion of a liquid of application for a cross linking charge transport layer.

In addition, specific examples of the leveling agent include silicone oils, for example, dimethyl silicone oil, and methylphenyl silicone oil, and polymers or oligomers having a perfluoroalkyl group in its branch chain. The addition amount of the leveling agent is not greater than 3% by weight based on all the solid portion of a liquid of application for a cross linking charge transport layer.

In the present invention, a dip coating method, a spray coating method, a bead coating method and a ring coating method can be applied as a method of coating a liquid of application for a cross linking charge transport layer. It is preferred to use a spray coating method because the amount of remaining solvent in the coated layer upon application can be suitably adjusted.

In the present invention, a cross linking charge transport layer can be formed by applying a liquid of application for a cross linking charge transport layer and then imparting an external energy thereto for curing. Heat, light and radioactive ray can be used as the external energy.

Specific examples of the method of imparting thermal energy include a method of heating the layer in the direction of the surface layer or the electroconductive substrate using, for example, air, for example, atmosphere and nitrogen, steam, various kinds of thermal media, infra-red light, and electromagnetic wave. The heating temperature is not lower than 100° C. and preferably from 100 to 170° C. When the heating temperature is too low, the reaction speed may be slow, which leads to the decrease in the reaction ratio. When the heating temperature is too high, the reaction may not be conducted uniformly, which causes a great distortion in a cross linking charge transport layer. To conduct the curing reaction uniformly, it is effective to apply heat to the layer at not higher than 100° C. first and then raise the temperature to not less than 100° C. for further reaction. It is possible to use a high pressure mercury lamp mainly having its luminescent wavelength in the ultraviolet range, and a UV irradiation light source, for example, a metal halide lamp, as the light source to impart light. It is also possible to select a visible light source according to the absorption wavelength of a radical polymeric monomer and a photo polymerization initiator. The amount of irradiation light is not less than 50 $mW/cm^2$ and preferably from 50 to 1,000 $mW/cm^2$. When the amount of irradiation is too small, it may take a relatively long time to conduct a curing reaction. When the amount of irradiation is too large, the reaction does not uniformly advance, which may increase the roughness of a cross linking charge transport layer. Electron beam can be used as the radioactive ray.

Among these energies, heat or light is preferred in terms of easiness of controlling the reaction speed and easy handling of the device.

The thickness of a cross linking charge transport layer is preferably from 1 to 10 μm and more preferably from 2 to 8 μm. When the thickness is too low, the durability may vary due to the non-uniformity of the layer. When the thickness is too high, the total thickness of the charge transport layer and the cross linking charge transport layer thickens and the reproducibility of images may deteriorate due to the diffusion of charges.

Next, the image forming method and the image forming apparatus of the present invention are described.

The image forming method and the image forming apparatus of the present invention use the image bearing member of the present invention and includes the processes of at least charging the image bearing member, irradiating the image bearing member to form a latent electrostatic image thereon, developing the latent electrostatic image with toner, transferring the toner image to an image bearing body (transfer medium), fixing the image and cleaning the surface of the image bearing member. The method in which a latent electrostatic image is directly transferred to a transfer medium and then developed with a toner does not necessarily have the processes mentioned above relating to the image bearing member.

Figure 3:
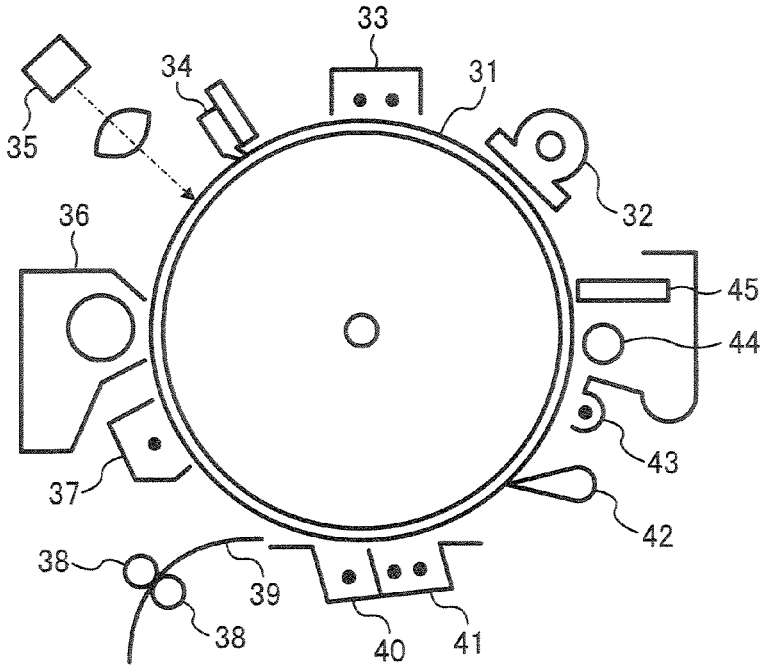
FIG. 3 is a schematic diagram illustrating an example of the image forming apparatus of the present invention.

FIG. 3 is a diagram illustrating the image forming apparatus of the present invention. A charging device 33 is used as the charging device to uniformly charge an image bearing member 31. Also, known charging devices, for example, a corotron device, a scorotron device, a solid discharging element, a needle electrode device, a roller charging device and an electroconductive brush device, can be used.

Especially, the structure of the present invention is effective for contact type charging or close type charging by which the composition of an image bearing member may be dissolved. The contact charging system is a charging system in which a charging roller, a charging brush, a charging blade, etc., is brought into contact with an image bearing member. The proximity charging system is that, for example, a charging roller and an image bearing member are arranged with a space of not greater than 200 μm therebetween, i.e., not in a contact state. This space is from 10 to 200 μm and preferably from 10 to 100 μm. When this space is too wide, the charging tends to be not stable. When the space is too narrow, the surface of a charging device may be contaminated by toner remaining on an image bearing member.

Next, an image irradiation portion 35 is used to form a latent electrostatic image on the image bearing member 31 which is uniformly charged. As the light source, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used. Various kinds of filters, for example, a sharp cut filter, a band pass filter, an infrared cut filter, a dichroic filter, a coherency filter and a color conversion filter can be used to irradiate the image bearing member 31 with light having only a desired wavelength. With regard to the latent electrostatic image on the image bearing member 31, the charge on the non-image portion is erased by an eraser 34.

Next, to visualize a latent electrostatic image formed on the image bearing member 31, a developing unit 36 is used. As the developing method, there are a single component developing method and a two component developing method which use a dry toner and a wet developing method which uses a wet toner. When the image bearing member is positively (negatively) charged and image irradiation is performed, a positive (negative) latent electrostatic image is formed on the surface of the image bearing member 31. When this positive (negative) latent electrostatic image is developed with a toner (electric detecting particulates) having a negative (positive) polarity, a positive image is obtained. When the image is developed with a toner having a positive (negative) polarity, a negative image is obtained.

Next, a transfer charging device 40 is used to transfer the visualized toner image on the image bearing member 31 to a transfer medium 39. In addition, to perform a good transferring, a prior to transfer charging device 37 can be used. As a transfer device, an electrostatic transfer system using a transfer charging device or a bias roller, a mechanical transfer system using an adhesive transfer method or a pressure transfer method, and a magnetic transfer system can be used. As the electrostatic transfer system, the same device as the charging device can be used.

Next, as a device to separate the transfer medium 39 from the image bearing member 31, a separation charging device 41 and a separation claw 42 are used. As other separating devices, electrostatic absorption guiding separation, side end belt separation, front end grip transfer, curvature separation, etc. can be used. As the separation charging device 41, the same device as the charging device can be used.

Next, after transfer, to remove the toner remaining on the image bearing member 31, a fur brush 44 and a cleaning blade 45 are used. In addition, to effectively perform cleaning, a prior to cleaning charging device 43 can be used. There can be used other cleaning devices, for example, a web-system device and a magnet brush system device. These cleaning devices can be used alone or in combination.

Next, if desired, a discharging device is used to remove the latent electrostatic image on the image bearing member 31. A discharging lamp 32 and a discharging charger can be used as the discharging device. The same devices as the irradiation light sources and the charging devices can be used as each.

In addition to those mentioned above, known devices can be used in the processes of scanning originals, paper feeding, fixing images, discharging recording media, etc., which are performed not in the vicinity of the image bearing member 31. For example, the transfer medium 39 is fed from a feeder cassette included in a paper feeder by paper feeding rollers, separated into one by one by a separation roller, and send to a pair of registration rollers 38 via a paper feeding path by a paper sending roller. The pair of registration rollers 38 can send the transfer medium 39 to a transfer device 56 (shown in FIG. 4) in timing in which the visualized image on the image bearing member 31 and the transfer medium 39 are synchronous to the nip between the image bearing member 31 and a transfer belt.

The image forming apparatus of the present invention can be applied to a photocopying machine, a facsimile machine, a printer, etc. Also a process cartridge can be detachably incorporated in the main body of the image forming apparatus.

Figure 4:
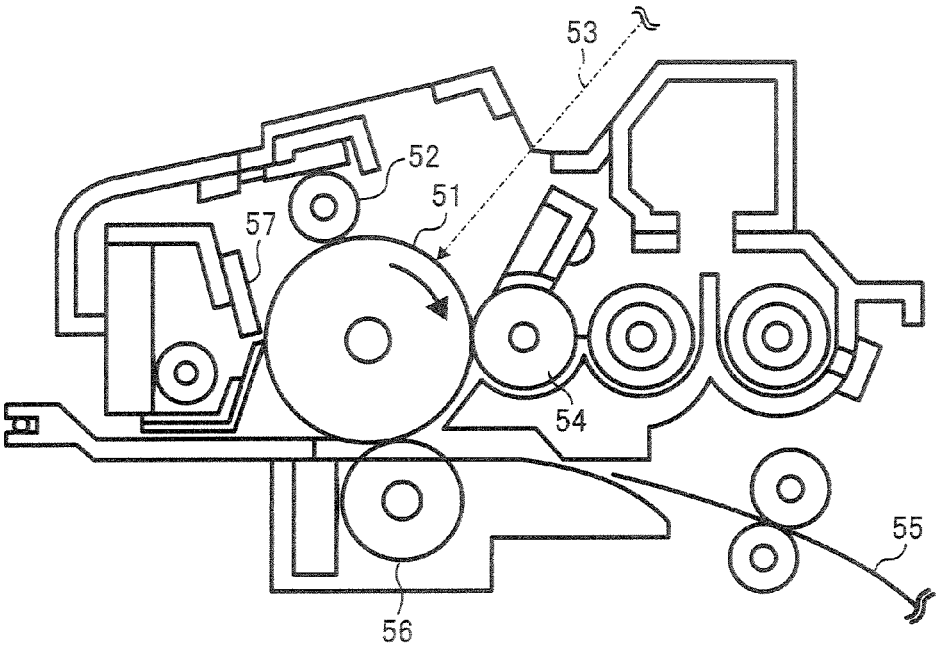
FIG. 4 is a diagram illustrating an example of the process cartridge for use in the present invention.

FIG. 4 is a diagram illustrating an example of the process cartridge detachably provided to the image forming apparatus of the present invention. The process cartridge is a device (part) detachably provided to the main body of an image forming apparatus and includes an image bearing member 51, and at least one of a charging device 52, a developing device 54, the transferring device 56, a cleaning device 57, and a discharging device (not shown). The image bearing member 51 is an example of the image bearing member of the present invention.

Figure 5:
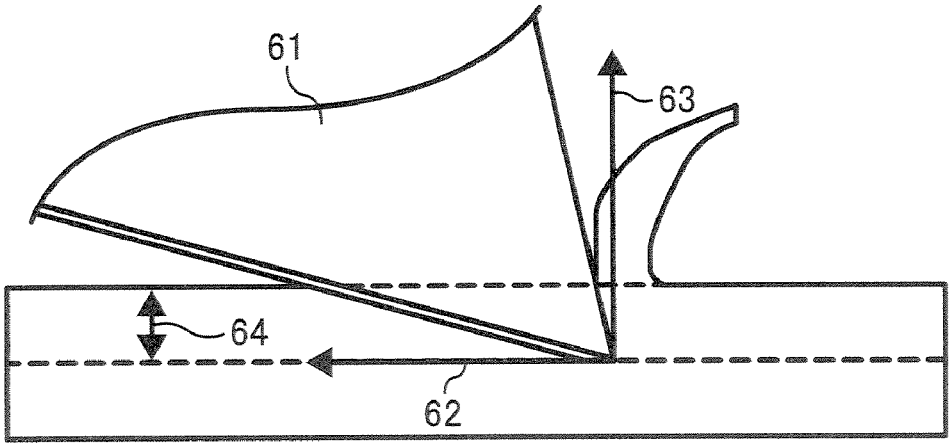
FIG. 5 is a diagram illustrating a surface and interfacial cutting analysis system (SAICAS).

The image formation process by the process cartridge illustrated in FIG. 5 is: the image bearing member 51 in rotation along the direction indicated by the arrow is charged and irradiated with the charging device 52 and an irradiating device 53 to form a latent electrostatic image corresponding to the irradiation image on the surface of the image bearing member 51; the latent electrostatic image is developed with toner by the developing device 54; the toner image is transferred to a transfer medium 55 with the transfer device 56; the transferred image is then printed out; on the other hand, the surface of the image bearing member 51 after transfer is cleaned by the cleaning device 57 and discharged by the discharging device (not shown); and all the operations mentioned above continues in a repeated manner.

As apparent from the description above, the image bearing member of the present invention can be applied not only to an a photocopier using the electrophotographic system, but also widely to the applied electrophotographic field including, for example, a laser beam printer, a CRT printer, an LED printer, a liquid crystal printer, and laser plate making.

In the present invention, a radical polymeric compound having one functional group which has a charge transport structure can be prepared by, for example, the method described in JP 3164426. One specific example thereof is as follows.

(1) Synthesis of Hydroxyl Group Substituted Triarylamine

[Chemical structure 17]

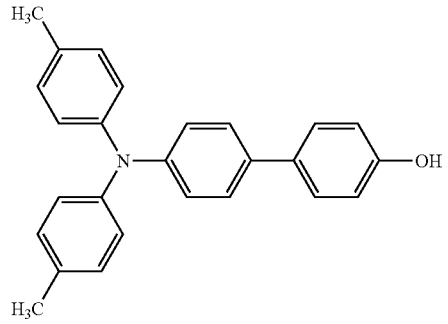

[Chemical structure 18]

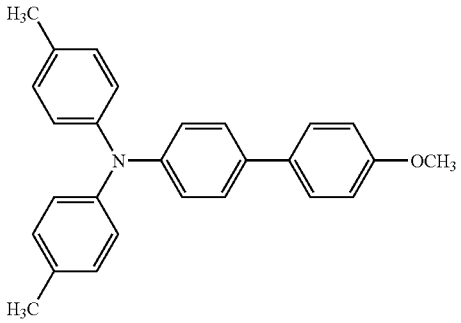

240 ml of sulfolane is added to 113.85 g (0.3 mol) of methoxy group substituted triarylamine represented by the chemical structure (18) illustrated above and 138 g (0.92 mol) of sodium iodide and the mixture is heated to 60° C. in nitrogen air stream. Into the resultant liquid, 99 g (0.91 mol) of trimethyl chlorosilane is dropped in one hour, followed by 4 and a half hour stirring at about 60° C. to completely conduct the reaction. About 1.5 litter of toluene is added to this reaction liquid and the resultant is cooled down to room temperature and repeatedly washed with water and sodium carbonate aqueous solution. Thereafter, the solvent is removed from the obtained toluene solution. The resultant is refined by being subject to a column chromatography treatment (absorbing solvent: silica gel, expanding solvent: a mixture solvent of toluene and ethyl acetate with a volume ratio of 20 to 1). Cyclohexane is added to the obtained light yellow oil to precipitate crystal. Consequently, 88.1 g (yield ratio: 80.4%) of white crystal of hydroxyl group substituted triarylamine is obtained. The melting point of the obtained product is from 64.0 to 66.0° C. and its elemental analysis (%) is shown in Table 1.

TABLE 1

| | C | H | N |
|---|---|---|---|
| Measured value | 85.06 | 6.41 | 3.73 |
| Calculation value | 85.44 | 6.34 | 3.83 |

(2) Synthesis of the Illustrated Compound No. 54

82.9 g of the hydroxyl group substituted triarylamine is dissolved in 400 ml of tetrahydrofuran. Sodium hydroxide (NaOH: 12.4 g, Water: 100 ml) is dropped to the liquid in nitrogen air stream. The solution is cooled down to 5° C., and 25.2 g (0.272 mol) of chlorinated acrylic acid is dropped thereto in 40 minutes, followed by 3 hour stirring at 5° C. to complete the reaction. This reaction solution is poured in water and extracted by toluene. The extracted solution is repeatedly washed with sodium hydrogen carbonate and water. Thereafter, the solvent is removed from the obtained toluene solution, followed by column chromatography treatment (absorbing solvent: silica gel, expanding solvent: toluene) for refinement. n-hexane is added to the obtained transparent oil to precipitate crystal. Consequently, 80.73 g (yield ratio: 84.8%) of the illustrated compound No. 54 is obtained. The melting point of the obtained product is from 117.5 to 119.0° C. and its elemental analysis (%) is shown in Table 2.

TABLE 2

| | C | H | N |
|---|---|---|---|
| Measured value | 83.13 | 6.01 | 3.16 |
| Calculation value | 83.02 | 6.00 | 3.33 |

(3) Synthesis of the Illustrated Compound No. 2

In a reaction container equipped with a stirring device, a thermometer and a tap funnel, 38.4 g of 2-hydroxybenzyl alcohol (manufactured by Tokyo Chemical Industry Co., Ltd.) and 80 ml of o-xylene are placed. 62.8 g of triethyl phosphate (manufactured by Tokyo Chemical Industry Co., Ltd.) is dropped to the liquid in nitrogen air stream and the reaction is conducted for one hour. Next, the produced ethanol, o-xylene solvent and non-reacted triethyl phosphite are removed by distillation with a reduced pressure to obtain 66 g (yield ratio: 90%) 2-hydroxybenzyl diethyl phosphonate. The melting point of the obtained product is 120.0° C./1.5 mmHg.

In a reaction container equipped with a stirring device, a thermometer and a tap funnel, 14.8 g of potassium tert-buthoxide and 50 ml of tetrahydrofuran are replaced. In nitrogen airstream, a solution in which 9.90 g of 2-hydroxy benzyl diethyl phosphonate and 5.44 g of 4-(N,N-bis(4-methylphenyl)amino)benzaldehyde are dissolved in tetrahydrofuran is slowly dropped to the reaction container at room temperature and the reaction is conducted for 2 hours. Next, while cooled down by water, water is added to the resultant and thereafter 2N hydrochloric acid is added to acidify the resultant. Furthermore, tetrahydrofuran is removed by an evaporator and the obtained coarse product is extracted by toluene. The toluene phase is washed with water, sodium hydrogen carbonate aqueous solution and saturated salt solution in this order. Magnesium sulfide is added to the resultant for dehydration. Subsequent to filtration, toluene is removed and an oily coarse product is obtained. Subsequent to column refinement by silica gel, the resultant is crystallized in hexane and 5.09 g (yield ratio: 72%) of 2-hydroxy-4'-(N,N-bis(4-methylphenyl)amino)stilbene is obtained. The melting point of the product is 136.0 to 138.0° C.

In a reaction container equipped with a stirring device, a thermometer and a tap funnel, 14.9 g of 2-hydroxy-4'-(N,N-bis(4-methylphenyl)amino)stilbene, 100 ml of tetrahydrofuran and 21.5 g of 12% by weight sodium hydroxide aqueous solution are placed. In nitrogen air stream, 5.17 g of chlorinated acrylic acid is dropped to the reaction container at 5° C. and the reaction is conducted for 3 hours. The reaction liquid is poured into water and extracted by toluene. Subsequent to condensation, column refinement by silica gel is performed. The obtained coarse product is re-crystallized by ethanol to obtain 13.5 g of yellow needle-like crystal of the illustrated compound No. 2 (4'-(N,N-bis(4-methylphenyl)amino)stilbene-2-ylacrylate). The melting point of the product is from 104.1 to 105.2° C. and the elemental analysis (%) is shown in Table 3.

TABLE 3

| | C | H | N |
|---|---|---|---|
| Measured value | 86.46 | 6.06 | 3.18 |
| Calculation value | 83.57 | 6.11 | 3.14 |

As described above, various kinds of esters of acrylic acid can be synthesized by synthesizing and esterifying a derivative of 2-hydroxystilbene obtained by reacting an ester derivative of 2-hydroxy benzyl phosphonate and a derivative of 2-hydroxy stilbene.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is further described referring to Examples but not limited thereto.

Example 1

An undercoating layer having a thickness of 3.5 μm, a charge generating layer having a thickness of 0.2 μm and a charge transport layer having a thickness of 22 μm are formed on an aluminum drum having a diameter of 30 mm by applying and drying a liquid of application for an undercoating layer having the following composition, a liquid of application for a charge generating layer having the following composition and a liquid of application for a charge transport layer having the following composition thereto in this order with a dip coating method. A liquid of application for a charge transport layer containing filler having the following composition is applied on the charge transport layer by spraying to obtain a charge transport layer containing filler having a thickness of 1 μm. The liquid of application for a charge transport layer is applied in an amount such that the charge transport layer has a thickness of 22 μm in a dry state. The liquid of application for a charge transport layer containing filler is applied in an amount such that the charge transport layer containing filler has a thickness of 1 μm in a dry state. The surface roughness (Ra) of the charge transport layer containing filler is 0.36 μm when measured according to a surface roughness testing method, which is described later.

Furthermore, the liquid of application for a cross linking charge transport layer having the following composition is applied on the charge transport layer containing filler by a spray coating method. Light irradiation is performed using a UV lamp (valve type: H valve, manufactured by Fusion UV system Japan KK) with a lamp power of 200 W/cm and an irradiation intensity of 450 mW/cm$^2$ for 30 seconds. Thereafter, the liquid of application is dried for 20 minutes at 130° C. to obtain a cross linking charge transport layer having a thickness of 5 μm. Thus, the image bearing member of the present invention is obtained.

Liquid of Application for Undercoating Layer

| | |
|---|---|
| Alkyd resin (BECKOZOLE 1307-60-EL, manufactured by Dainippon Ink and Chemicals, Incorporated) | 6 parts |
| Melamine resin (SUPER NECKAMINE, G-821-60, manufactured by Dainippon Ink and Chemicals, Incorporated) | 4 parts |
| Titanium oxide (CR-EL, manufactured by Ishihara Sangyo Kaisha Ltd.) | 40 parts |
| Methyl ethyl ketone | 200 parts |
| Liquid of Application for Charge Generating Layer Bisazo pigment represented by the following chemical structure (19) | 2.5 parts |
| Polyvinyl butyral (XYHL, manufactured by Union Ca4rbide Corporation (UCC)) | 0.5 parts |
| Cyclohexane | 200 parts |
| Methylethyl ketone | 80 parts |

[Chemical structure 19]

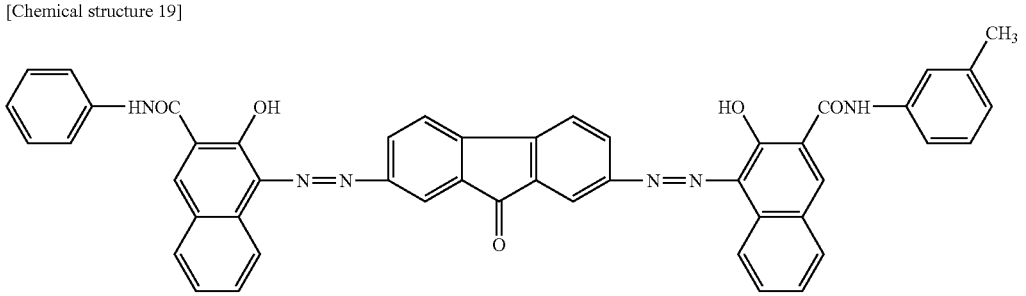

Liquid of Application for Charge Transport Layer

| | |
|---|---|
| Bisphenol Z polycarbonate resin (PANLITE TS-2050, manufactured by Teijin Chemicals Ltd.) | 10 parts |
| Low molecular weight charge transport material represented by the following chemical structure (20) | 7 parts |
| Tetrahydrofuran | 100 parts |
| Silicone oil, 1% tetrahydrofuran ssolution | 0.2 parts |

(KF50-100CS, Shin-Etsu Chemical Co., Ltd.)

[Chemical Structure 20]

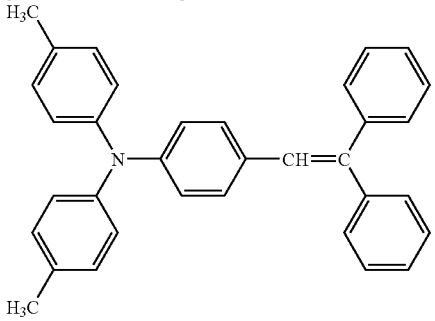

Liquid of Application for Charge Transport Layer Having Filler

| | |
|---|---|
| Bisphenol Z polycarbonate (PANLITE TS-2050, manufactured by Teijin Chemicals Ltd.) | 10 parts |
| Low molecular weight charge transport material represented by the following chemical structure (?) | 7 parts |
| Tetrahydrofuran | 100 parts |
| Silicone oil, 1% tetrahydrofuran solution (KF50-100CS, Shin-Etsu Chemical Co., Ltd.) | 0.2 parts |
| Aluminum oxide (average primary particle diameter: 0.3 μm, refraction index: 1.7) (SUMIKORANDOM AA-03, manufactured by Sumitomo Chemical Co., Ltd.) | 2 parts |
| Vibration dispersion by ball milling | 60 minutes |

Liquid of Application for Cross Linking Charge Transport Layer

| | |
|---|---|
| Radical polymeric monomer having at least three functional groups which does not have a charge transport structure (trimethyl propane triacrylate (KAYARAD TMPTA, manufactured by Nippon Kayaku Co., Ltd., molecular weight: 296, number of functional groups: 3) | 10 parts |
| Charge transport compound having radical polymeric functional groups (Triarylamine acryl acid ester No. 12 illustrated above, molecular weight 445, number of functional groups: 1) | 10 parts |
| Photo polimerization initiator [1-hydroxy-cyclohexyl-phenyl-ketone (IRGACURE 184, manufactured by Chiba Specialty Chemicals)] | 1 part |
| Reactive silicone compound (BYK-UV3570, manufactured by BYK-Chemie U.S. Inc.) | 0.02 parts |
| Tetrahydrofuran | 120 parts |
| Conditions of Spray Coating | |
| Applied amount of liquid of application | 10 ml/min (5 to 25 cc/min) |
| Pressure of pouring liquid of application | 2.4 Kgf/cm$^2$ (1.0 to 3.0 Kg/cm$^2$) |
| Number of rotation of material where liquid of application is applied | 120 rpm (120 to 640 rpm) |
| Speed of application | 28 mm/sec (5 to 40 mm/sec) |
| Distance between spraying gunhead and material where liquid of application is applied | 5 cm (3 to 15 cm) |
| Number of application: 1 | |

Example 2

Image bearing member 2 is manufactured in the same manner as in Example 1 except that aluminum oxide contained in the charge transport layer having filler is changed to the following material. Silicon oxide (Average primary particle diameter: 0.1 μm refraction factor: 1.48) (X-24-9163A, manufactured by Shin-Etsu Chemical Co., Ltd.)

Example 3

Image bearing member 3 is manufactured in the same manner as in Example 1 except that aluminum oxide contained in the charge transport layer having filler is changed to the following material.

| | |
|---|---|
| Titanium oxide (average primary particle diameter: 0.25 μm refraction factor: 2.72) (CR-97, manufactured by Ishihara Sangyo Kaisha) | 2 parts |

Example 4

Image bearing member 4 is manufactured in the same manner as in Example 1 except that aluminum oxide contained in the charge transport layer having filler is changed to the following material.

| | |
|---|---|
| Melamine resin particulate (EPOSTAR S, manufactured by Nippon Shokubai Co., Ltd., average primary particle diameter: 0.2 μm, refraction index: 1.66) | 2 parts |

Example 5

Image bearing member 5 is manufactured in the same manner as in Example 1 except that aluminum oxide contained in the charge transport layer having filler is changed to the following material.

| | |
|---|---|
| Silicone resin particulates (TOSPEARL 105, manufactured by GE Toshiba Silicone Co., Ltd., average primary particle diameter: 0.5 μm, refraction index: 1.42 to 1.43) | 2 parts |

Example 6

Image bearing member 6 is manufactured in the same manner as in Example 1 except that the liquid of application for a charge transport layer and the liquid of application for a charge transport layer having filler are changed to the following.

| | |
|---|---|
| Liquid of Application for Charge Transport Layer | |
| Polyarylate resin (U polymer, manufactured by Unitika Ltd.) | 10 parts |
| Low molecular weight charge transport material represented by the following chemical structure (?) | 7 parts |
| Tetrahydrofuran | 100 parts |
| Silicone oil, 1% tetrahydrofuran solution (KF50-100CS), manufactured by Shin-Etsu Chemical Co., Ltd.) | 0.2 parts |
| Liquid of Application for Charge Transport Layer Having Filler | |
| Polyarylate resin (U polymer, manufactured by Unitika Ltd.) | 10 parts |
| Low molecular weight charge transport material represented by the following chemical structure (?) | 7 parts |
| Tetrahydrofuran | 100 parts |
| Silicone oil, 1% tetrahydrofuran solution (KF50-100CS, manufactured by Shin-Etsu Chemical Co., Ltd.) | 0.2 parts |
| Aluminum oxide (average primary particle diameter: 0.3 μm, Refraction index: 1.7) (SUMICORANDOM AA-03, manufactured by Sumitomo Chemical Co. Ltd.) | 2 parts |

Example 7

Image bearing member 7 is manufactured in the same manner as in Example 6 except that aluminum oxide contained in the charge transport layer having filler is changed to the following material.

| | |
|---|---|
| Silicon oxide (Average primary particle diameter: 0.1 μm, fraction index: 1.48) (X-24-9163A, manufactured by Shin-Etsu Chemical Co., Ltd.) | 2 parts |

Example 8

Image bearing member 8 is manufactured in the same manner as in Example 6 except that aluminum oxide contained in the charge transport layer having filler is changed to the following material.

| | |
|---|---|
| Titanium oxide (CR-97, manufactured by Ishihara Sangyo Kaisha, average primary particle diameter: 0.25 μm, refraction factor: 2.72) | 2 parts |

Example 9

Image bearing member 9 is manufactured in the same manner as in Example 6 except that aluminum oxide contained in the charge transport layer having filler is changed to the following material.

| | |
|---|---|
| Melamine resin particulate (EPOSTAR S, manufactured by Nippon Shokubai Co., Ltd., average primary particle diameter: 0.2 μm, refraction index: 1.66) | 2 parts |

Example 10

Image bearing member 10 is manufactured in the same manner as in Example 6 except that aluminum oxide contained in the charge transport layer having filler is changed to the following material.

| | |
|---|---|
| Silicone resin particulates (TOSPEARL 105, manufactured by GE Toshiba Silicone Co., Ltd., average primary particle diameter: 0.5 μm, refraction index: 1.42 to 1.43) | 2 parts |

Example 11

Image bearing member 11 is manufactured in the same manner as in Example 1 except that aluminum oxide contained in the charge transport layer having filler is changed to the following material and the spray coating conditions for the charge transport layer having filler is changed to the following to form a charge transport layer having filler with a thickness of 8 μm.

Aluminum oxide (SUMICORANDOM AA-05, manufactured by Sumitomo Chemical Co. Ltd., average primary particle diameter: 0.5 μm, Refraction index: 1.7)

Spray coating conditions (the number of applications): 8 times

Example 12

Image bearing member 12 is manufactured in the same manner as in Example 6 except that aluminum oxide contained in the charge transport layer having filler is changed to the following material and the spray coating conditions therefor is changed to the following to form a charge transport layer having a thickness of 27 μm and a charge transport layer having filler having a thickness of 3 μm.

| | |
|---|---|
| Aluminum oxide (AEROXIDE Alu C, manufactured by Japan Aerosil Co., Ltd., average primary particle diameter: 0.013 μm, Refraction index: 1.7)<br>Spray coating conditions (the number of applications): 3 times | 3 parts |

Example 13

Image bearing member 13 is manufactured in the same manner as in Example 1 except that aluminum oxide contained in the charge transport layer having filler is changed to the following material and the spray coating conditions therefor is changed to the following to form a charge transport layer having a thickness of 23 μm and a charge transport layer having filler having a thickness of 7 μm.

Silicon oxide (AEROSIL R202, manufactured by Japan Aerosil Co., Ltd., average primary particle diameter: 0.014 μm, refraction index: 1.45 to 1.46) 1.5 parts Spray coating conditions (applied amount of liquid of application: 9 ml/min., number of coatings: 7)

Example 14

Image bearing member 14 is manufactured in the same manner as in Example 1 except that aluminum oxide contained in the charge transport layer having filler is changed to the following material and the spray coating conditions therefor is changed to the following to form a charge transport layer having a thickness of 25 μm and a charge transport layer having filler having a thickness of 5 μm.

| | |
|---|---|
| Silicon oxide (average primary particle diameter: 0.25 μm, refraction index: 1.46) (SO-C1, manufactured by Admatechs Corporation Limited)<br>Spray coating conditions (applied amount of liquid of application: 9 ml/min., number of coatings: 5). | 2.5 parts |

Example 15

Image bearing member 15 is manufactured in the same manner as in Example 6 except that aluminum oxide contained in the charge transport layer having filler is changed to the following material and the spray coating conditions therefor is changed to the following to form a charge transport layer having a thickness of 27 μm and a charge transport layer having filler having a thickness of 3 μm.

| | |
|---|---|
| Silicon oxide (SO-C2, manufactured by Admatechs Corporation Limited, average primary particle diameter: 0.5 μm, refraction index: 1.46)<br>Spray coating conditions (applied amount of liquid of application: 11 ml/min., number of coatings: 3). | 3 parts |

Example 16

Image bearing member 16 is manufactured in the same manner as in Example 1 except that aluminum oxide contained in the charge transport layer having filler is changed to the following material and the spray coating conditions therefor is changed to the following to form a charge transport layer having a thickness of 24 μm and a charge transport layer having filler having a thickness of 6 μm.

| | |
|---|---|
| Titanium oxide (AMT-100, manufactured by Tayca Corporation, average primary particle diameter: 0.006 μm, refraction index: 1.5)<br>Spray coating conditions (applied amount of liquid of application: 8 ml/min., number of coatings: 6). | 1.5 parts |

Example 17

Image bearing member 17 is manufactured in the same manner as in Example 6 except that aluminum oxide contained in the charge transport layer having filler is changed to the following material and the spray coating conditions therefor is changed to the following to form a charge transport layer having a thickness of 26 μm and a charge transport layer having filler having a thickness of 4 μm.

| | |
|---|---|
| Titanium oxide (MT-100HD, manufactured by Tayca Corporation, average primary particle diameter: 0.015 μm, refraction index: 2.72)<br>Spray coating conditions (number of coatings: 4). | 2.5 parts |

Comparative Example 1

Image bearing member 18 is manufactured in the same manner as in Example 1 except that a charge transport layer having a thickness of 23 μm is formed without using the liquid of application for a charge transport layer containing filler.

Comparative Example 2

Image bearing member 19 is manufactured in the same manner as in Example 1 except that a charge transport layer is formed such that a thickness of 22 μm is formed by a dip coating method and a thickness of 1 μm is formed by a spray coating method without using the liquid of application for a charge transport layer containing filler.

Comparative Example 3

Image bearing member 20 is manufactured in the same manner as in Example 6 except that a charge transport layer having a thickness of 23 μm is formed without using the liquid of application for a charge transport layer containing filler.

Comparative Example 4

An image bearing member is manufactured in the same manner as in Example 1 except that a charge transport layer having a thickness of 23 μm is formed without using the liquid of application for a charge transport layer containing filler. Next, the surface of the charge transport layer is made rough by a buffing machine under the following condition: Fix the image bearing member by chucking; Place a wool felt disk buff having a diameter of 20 cm at a position with an amount of buff misalignment of 6 cm; The buff misalignment means the distance between the centerline of the image bearing member in the longitudinal direction and the center point of the disk buff; Next, the image bearing member is work-rotated at 200 rpm; Rotate the disk buff at 850 rpm; Perform buff-sending at 1.5 cm/min while pressing the disk buff against the image bearing member with a buff load of 4 kg; and discharge purified water in which an abrading agent (aluminum having a particle diameter of 4 μm and the amount is 2.5 g/l) is dispersed to the contact phase of the image bearing member and the disk buff according to the behavior of the buff at a rate of 1 l/min from the liquid discharging nozzle.

Then, Image bearing member 21 is manufactured by forming a cross linking charge transport layer having a thickness of 5 μm in the same manner as in Example 1.

Below are descriptions of the test methods for the average primary particle diameter and refraction index of a filler, the surface roughness of a photosensitive layer, the anti-peeling-off strength of a cross linking charge transport layer and the anti-abrasion property of an image bearing member.

Measuring of Average Primary Particle Diameter

The average primary particle diameter of a filler is measured by using a surface area measuring device (QUANTASORB, model QS-14, manufactured by Quantachrome Instruments). The primary particle diameter of the filler is calculated by dividing the specific surface area of the measured BET by the absolute specific gravity of the filler.

Measuring of Refraction Index

The refraction index of the filler is measured by Abbe refractometer method. Particles are dipped in liquid under the condition of 589 nm at from 24.5 to 25.5° C. While gradually changing the refraction index, the refraction index is calculated by the refraction index of the liquid at which the particle interface is not clear.

Surface Roughness Test

The surface roughness Ra of the photosensitive layer related to the present invention is measured by using a surface texture and contour measuring instrument (SURFCOM 1400D, manufactured by Tokyo Seimitsu Co., Ltd.) according to JIS-B0601: '82 with a measuring length of 2 mm, a measuring speed of 0.06 mm/s, and a cutoff wavelength of 0.8 mm. The surface roughness Ra in the present invention represents a calculation value from two-dimensional form. Therefore, considering measuring errors, etc., the surface roughness is measured for 6 selected points, three of which are selected in the axis direction of the image bearing member and the rest in the circumferential direction. Thereafter, the 6 measured values are averaged to calculate the surface roughness Ra of the photosensitive layer.

Anti-Peeling-Off Strength

The anti-peeling-off strength of a cross linking charge transport layer is measured by using a Surface And Interfacial Cutting Analysis System (SAICAS) (DN-20, manufactured by Daipla Wintes Co., Ltd.) illustrated in FIG. 5. Anti-peeling-off strength is measured by using a single crystal diamond cutting blade 61 having a blade width of 0.5 mm, a blade angle of 60°, a rake angle of 20°, and a relief angle of 10° with a constant cutting mode of a horizontal cutting speed of 0.1 μm/s and a vertical cutting speed of 0.01 μm/s. When anti-peeling-off strength is measured, the image bearing member is suitably cut for use. The testing time is determined such that the cutting depth is larger than the layer thickness of the cross linking charge transport layer. The data collected are the horizontal force 62, vertical force 63 and perpendicular displacement 64 to the cutting blade for the single crystal diamond cutting blade 61. The anti-peeling-off strength is calculated by dividing the horizontal load of the cutting depth, which corresponds to the layer thickness of the cross linking charge transport layer, by the blade width. The anti-peeling-off is measured at 22° and 55% RH.

Image Quality Characteristics Evaluation Test

The manufactured image bearing members are implemented into a process cartridge for use in electrophotography. The charging system is a contact type charging system. The image irradiating light source is a semiconductor laser having a wavelength of 655 nm. These are implemented into a remodeled imagio MF 2200, manufactured by Ricoh Co., Ltd., in which the contact pressure of the cleaning blade against the image bearing member is set twice as high as the original contact pressure. With the charging voltage of the remodeled apparatus set at −900V, 50,000 sheets are continuously printed and then the voltage of the irradiated portion is measured at initial prints and after the 50,000 prints. With regard to the image bearing members of Examples and Comparative Examples, the results of the surface roughness Ra of the charge transport layer and the anti-peeling-off strength of the cross linking charge transport layer are shown in Table 4. In addition, the voltage at the irradiated portions and the image quality evaluation are shown in table 5. The image quality is evaluated by observing printed out images having white spots ascribable to the shielding of a laser beam occurring when electroconductive particles are attached on an image bearing member.

Deficiency of Image Output

The evaluation of images with regard to white spots is determined by using half tone images and solid black images. The number and the size of white spots are measured. In the image having the greatest number of the white spots having a size not smaller than 0.1 mm, the quality of the image is ranked according to how many white spots are present per A3 sheet.

A: both the surface of the image bearing member and the output images are good

B: the number of white spots having a size not greater than 0.1 mm are not greater than 3 and there is no white spot having a size not less than 0.3 mm in the image.

C: the number of white spots having a size not greater than 0.3 mm are not greater than 5 and there is no white spot having a size not less than 0.5 mm in the image.

TABLE 4

| Image bearing member | Surface roughness Ra (μm) | Anti-peeling-off strength (N/mm) |
|---|---|---|
| Example 1 | 0.36 | 0.42 |
| Example 2 | 0.41 | 0.45 |
| Example 3 | 0.43 | 0.45 |
| Example 4 | 0.41 | 0.40 |
| Example 5 | 0.36 | 0.35 |
| Example 6 | 0.37 | 0.37 |
| Example 7 | 0.40 | 0.42 |
| Example 8 | 0.37 | 0.39 |
| Example 9 | 0.30 | 0.30 |
| Example 10 | 0.38 | 0.35 |
| Example 11 | 0.55 | 0.47 |
| Example 12 | 0.57 | 0.46 |
| Example 13 | 0.53 | 0.43 |
| Example 14 | 0.45 | 0.45 |
| Example 15 | 0.63 | 0.37 |
| Example 16 | 0.31 | 0.35 |
| Example 17 | 0.49 | 0.39 |
| Comparative Example 1 | 0.03 | 0.03 |
| Comparative Example 2 | 0.11 | 0.06 |
| Comparative Example 3 | 0.76 | 0.15 |
| Comparative Example 4 | 0.61 | 0.06 |

TABLE 5

| | Initial | | After 50,000 prints | |
|---|---|---|---|---|
| Image bearing member | Voltage at irradiated portion (−V) | Image quality | Voltage at irradiated portion (−V) | Image quality |
| Example 1 | 110 | A | 115 | A |
| Example 2 | 110 | A | 120 | A |
| Example 3 | 115 | A | 120 | A |
| Example 4 | 110 | A | 120 | A |
| Example 5 | 110 | A | 120 | A |
| Example 6 | 110 | A | 115 | A |
| Example 7 | 115 | A | 120 | A |
| Example 8 | 110 | A | 120 | A |
| Example 9 | 110 | A | 120 | A |
| Example 10 | 110 | A | 120 | A |
| Example 11 | 105 | A | 110 | A |
| Example 12 | 115 | A | 125 | A |
| Example 13 | 110 | A | 115 | A |
| Example 14 | 115 | A | 125 | A |
| Example 15 | 115 | A | 125 | A |
| Example 16 | 110 | A | 115 | A |
| Example 17 | 115 | A | 125 | A |
| Comparative Example 1 | 115 | A | 125 | C |
| Comparative Example 2 | 110 | A | 120 | C |
| Comparative Example 3 | 115 | A | 125 | B |
| Comparative Example 4 | 120 | A | 130 | C |

As seen in the result of the evaluation above, it is confirmed that the voltage at irradiated portions of the image bearing member having a filler in the most distant area of the photosensitive layer from the substrate does not significantly rise not only at initial printing but also after 50,000 continuous print outs. In addition, partial peeling-off is restrained. Therefore, the quality images are stably obtained. Furthermore, it is also confirmed that the anti-peeling-off strength is significantly improved by controlling the surface roughness Ra of the photosensitive layer in the range of from 0.3 to 0.7 μm.

On the other hand, in the case of the image bearing members not having a filler in the most distant area of the photosensitive layer from the substrate or having a photosensitive layer the surface of which is roughened by buffing, a great number of defects, i.e., white spots, are observed in the output after 50,000 prints.

Considering the results described above, it can be said that the image bearing member having a filler in the most distant area of the photosensitive layer from the substrate can impart excellent adhesibility to the layer interface between the photosensitive layer and the cross linking charge transport layer.

This document claims priority and contains subject matter related to Japanese Patent Application No. 2005-342062 filed on Nov. 28, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member, comprising:

a substrate;

a photosensitive layer, provided overlying the substrate; and a cross linking charge transport layer provided overlying the photosensitive layer, wherein a portion of the photosensitive layer which is most distant from the substrate comprises a charge transport material, a binder resin and a filler, wherein the filler is present in an amount of from 1.5 to 3 parts per 10 parts of binder resin.

2. The image bearing member according to claim 1, wherein the photosensitive layer has a surface roughness Ra of from 0.3 to 0.7 μm before the cross linking charge transport layer is formed thereon.

3. The image bearing member according to claim 1, wherein the filler has a particle diameter of from 0.005 to 0.5 μm.

4. The image bearing member according to claim 1, wherein the filler has a refraction index of from 1.2 to 2.8.

5. The image bearing member according to claim 1, wherein the filler is at least one particulate selected from the group consisting of aluminum oxide, silicon oxide, titanium oxide, silicone resins and melamine resins.

6. The image bearing member according to claim 1, wherein the binder resin is a bisphenol polycarbonate or a polyarylate resin.

7. The image bearing member according to claim 1, wherein the photosensitive layer comprises a charge generating layer and a charge transport layer.

8. The image bearing member according to claim 1, wherein the cross linking charge transport layer is formed by curing a liquid of application comprising a radical polymeric monomer having at least three functional groups which does not have a charge transport structure, a radical polymeric compound having one functional group and a charge transport structure, and a reactive silicon compound having a repeated unit of a radical polymeric functional group and a dimethyl siloxane structure.

9. The image bearing member according to claim 8, wherein the cross liking type charge transport layer has a thickness of from 1 to 10 μm.

10. The image bearing member according to claim 8, wherein the functional groups of the radical polymeric monomer having at least three functional groups which does not have a charge transport structure is at least one of an acryloyloxy group and a methacryloyloxy group.

11. The image bearing member according to claim 8, wherein a ratio (M/F) of a molecular weight (M) of the radical polymeric monomer having at least three functional groups which does not have a charge transport structure to the number of functional groups (F) is not greater than 250.

12. The image bearing member according to claim 8, wherein the functional group of the radical polymeric compound having one functional group and a charge transport structure is either of an acryloyloxy group or a methacryloyloxy group.

13. The image bearing member according to claim 8, wherein the charge transport structure of the radical polymeric compound having one functional group and a charge transport structure is triarylamine structure.

14. The image bearing member according to claim 8, wherein the functional group of the radical polymeric compound having one functional group and a charge transport structure is at least one kind of the following represented by a chemical structure (1) and a chemical structure (2):

Chemical Structure (1)

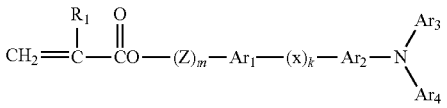

Chemical structure (2)

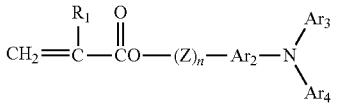

wherein $R_1$ represents one of hydrogen atom, a halogen atom, a substituted or non-substituted alkyl group, a substituted or non-substituted aralkyl group, a substituted or non-substituted aryl group, cyano group, nitro group, alkoxy group, —$COOR_7$, wherein $R_7$ represents hydrogen atom, a substituted or non-substituted alkyl group, a substituted or non-substituted aralkyl group, and a substituted or non-substituted aryl group, a halogenized carbonyl group or $CONR_8R_9$ ($R_8$ and $R_9$ independently represent one of hydrogen atom, a halogen atom, a substituted or non-substituted alkyl group, a substituted or non-substituted aralkyl group and a substituted or non-substituted aryl group, $Ar_1$ and $Ar_2$ independently represent a substituted or non-substituted arylene group, $Ar_3$ and $Ar_4$ independently represent a substituted or non-substituted aryl group, X represents one of a substituted or non-substituted alkylene group, a substituted or non-substituted cycloalkylene group, a substituted or non-substituted alkylene ether group, oxygen atom, sulfur atom, and vinylene group, k represents 0 or 1, Z represents a substituted or non-substituted alkylene group, a substituted or non-substituted bivalent alkylene ether group, and a bivalent alkyleneoxy carbonyl group, and m and n represent an integer of from 0 to 3.

15. The image bearing member according to claim 8, wherein the radical polymeric compound having one functional group and a charge transport structure is represented by at least one of the following chemical structure (3):

Chemical structure 3

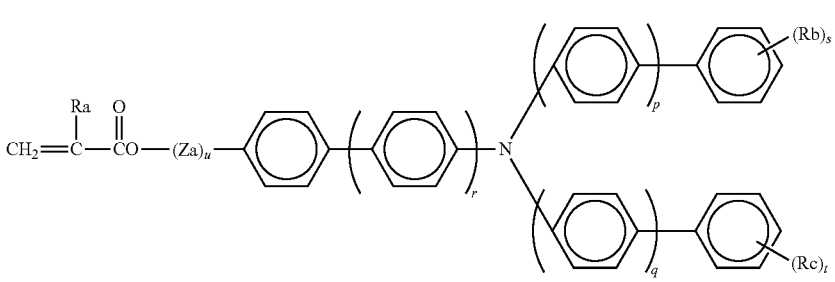

wherein r, p and q independently represent 0 or 1, Ra represents hydrogen atom or methyl group, Rb and Rc represent a hydrogen atom or an alkyl group having 1 to 6 carbon atoms, s and t independently represent an integer of from 1 to 3, each of Rb and Rc can be different when s and t are 2 or 3, Za represents methylene group, ethylene group, —$CH_2CH_2O$—, —$CHCH_3CH_2O$—, or —$C_6H_5CH_2CH_2$—, and u represents 0 or 1.

16. An image forming method comprising:

charging an image bearing member of claim 1;

irradiating the image bearing member to form a latent electrostatic image thereon;

developing the latent electrostatic image with a developer;

cleaning a surface of the image bearing member; and transferring the developed image to a recording medium.

17. An image forming apparatus comprising:

the image bearing member of claim 1;

a charging device configured to charge the image bearing member;

an irradiating device configured to irradiate the image bearing member to form a latent electrostatic image thereon;

a developing device configured to develop the latent electrostatic image with a developer;

a cleaning device configured to clean a surface of the image bearing member; and a transferring device configured to transfer the developed image to a recording medium.

* * * * *